US007024897B2

(12) United States Patent
Pfaffmann et al.

(10) Patent No.: US 7,024,897 B2
(45) Date of Patent: Apr. 11, 2006

(54) METHOD OF FORMING A TUBULAR BLANK INTO A STRUCTURAL COMPONENT AND DIE THEREFOR

(75) Inventors: George D. Pfaffmann, Farmington Hills, MI (US); William C. Dykstra, Rockford, MI (US); Marc R. Matsen, Seattle, WA (US)

(73) Assignee: Hot Metal Gas Forming Intellectual Property, Inc., Ann Arbor, MI (US)

( * ) Notice: Subject to any disclaimer, the term of this patent is extended or adjusted under 35 U.S.C. 154(b) by 184 days.

(21) Appl. No.: 10/659,403

(22) Filed: Sep. 10, 2003

(65) Prior Publication Data

US 2004/0200550 A1 Oct. 14, 2004

Related U.S. Application Data

(63) Continuation-in-part of application No. 10/613,642, filed on Jul. 3, 2003, which is a continuation of application No. 09/944,769, filed on Sep. 4, 2001, now Pat. No. 6,613,164, which is a continuation of application No. 09/481,376, filed on Jan. 11, 2000, now Pat. No. 6,322,645, said application No. 10/659,403.

(60) Provisional application No. 60/155,969, filed on Sep. 24, 1999, provisional application No. 60/409,788, filed on Sep. 11, 2002.

(51) Int. Cl.
*B21D 26/02* (2006.01)

(52) U.S. Cl. ..... 72/60; 72/62; 72/342.94; 72/709; 72/370.06; 72/370.22; 72/370.24; 148/520; 148/570; 29/421.1

(58) Field of Classification Search ..... 72/60, 72/62, 324.94, 370.06, 370.22, 370.24; 148/520, 148/570; 29/421.1
See application file for complete search history.

(56) References Cited

U.S. PATENT DOCUMENTS

| | | | |
|---|---|---|---|
| 4,584,860 | A | 4/1986 | Leonard |
| 4,637,844 | A | 1/1987 | Pfaffmann |
| 5,205,470 | A | 4/1993 | Cadwell |
| 5,214,949 | A | 6/1993 | Cadwell |
| 5,410,132 | A | 4/1995 | Gregg et al. |
| 5,530,227 | A | 6/1996 | Matsen et al. |
| 5,645,744 | A | 7/1997 | Matsen et al. |

(Continued)

FOREIGN PATENT DOCUMENTS

| | | |
|---|---|---|
| EP | 0 930 109 | 7/1999 |

(Continued)

OTHER PUBLICATIONS

Hot Metal Gas Forming (HMGF) by Auto Body Consortium, Inc. Mar. 18, 1998.

*Primary Examiner*—David Jones
(74) *Attorney, Agent, or Firm*—Fay Sharpe Fagan Minnich & McKee; Brian E. Turung; Robert V. Vickers

(57) ABSTRACT

A method of forming an elongated metal blank into a structural component having a predetermined outer configuration. The method includes providing a shape imparting cavity or shell section formed from a rigid material which includes an inner surface defining the predetermined shape, placing the metal blank into the cavity or shell section, and forming the metal blank into the component by heating axial portions of the metal blank and forcing a fluid at a high pressure into the metal blank until the metal blank at least partially conforms to at least a portion of the inner surface of the cavity or shell section to form the structural component.

30 Claims, 28 Drawing Sheets

U.S. PATENT DOCUMENTS

| | | | |
|---|---|---|---|
| 5,661,992 | A | 9/1997 | Sanders |
| 5,728,309 | A | 3/1998 | Matsen et al. |
| 5,747,179 | A | 5/1998 | Matsen et al. |
| 5,868,023 | A | 2/1999 | Wehner et al. |
| 5,960,658 | A | 10/1999 | Hudson et al. |
| 5,992,197 | A | 11/1999 | Freeman et al. |
| 6,017,477 | A | 1/2000 | Lu et al. |
| 6,067,831 | A | 5/2000 | Amborn et al. |
| 6,151,940 | A | 11/2000 | Amborn et al. |
| 6,322,645 | B1 | 11/2001 | Dykstra et al. |
| 6,349,583 | B1 | 2/2002 | Kleinschmidt et al. |
| 6,401,509 | B1 | 6/2002 | Amborn et al. |
| 6,460,250 | B1 | 10/2002 | Amborn et al. |
| 6,578,400 | B1 | 6/2003 | Bonny et al. |
| 6,609,301 | B1 | 8/2003 | Morris et al. ..... 29/421.1 |
| 6,613,164 | B1 | 9/2003 | Dykstra et al. |
| 2003/0221474 | A1 | 12/2003 | Sorgi |
| 2004/0094244 | A1 | 5/2004 | Dykstra et al. |

FOREIGN PATENT DOCUMENTS

| | | |
|---|---|---|
| WO | WO 98/43759 | 10/1998 |

FIG. 27
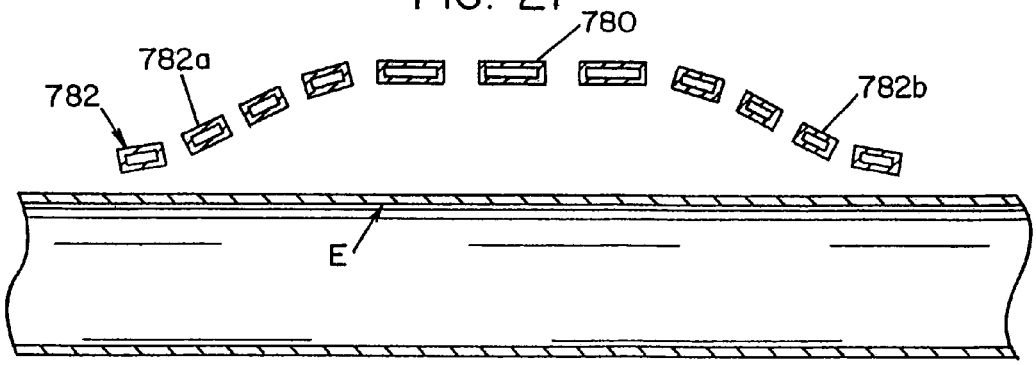
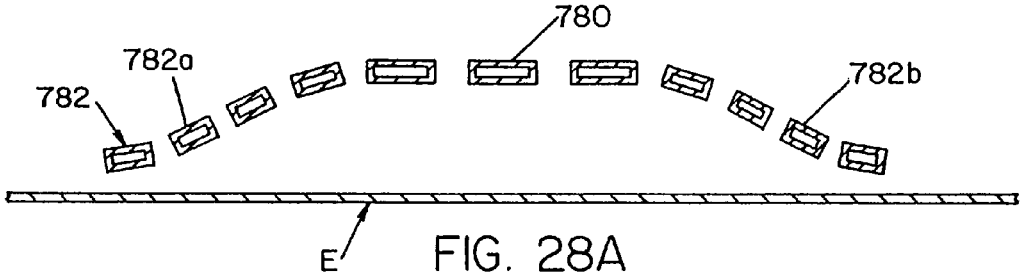
FIG. 28A
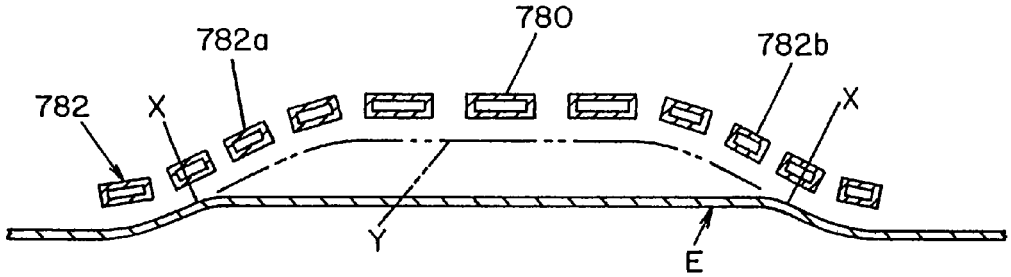
FIG. 28B

METHOD OF FORMING A TUBULAR BLANK INTO A STRUCTURAL COMPONENT AND DIE THEREFOR

The present invention is a continuation-in-part of U.S. patent application Ser. No. 10/613,642 filed Jul. 3, 2003 entitled "Method of Forming a Tubular Blank into a Structural Component and Die Therefor," which in turn is a continuation of U.S. patent application Ser. No. 09/944,769 filed Sep. 4, 2001 entitled "Method of Forming a Tubular Blank into a Structural Component and Die Therefor," now U.S. Pat. No. 6,613,164, which in turn is a continuation of U.S. patent application Ser. No. 09/481,376 filed Jan. 11, 2000 entitled "Method of Forming a Tubular Blank into a Structural Component and Die Therefor," now U.S. Pat. No. 6,322,645, which in turn claims priority of U.S. Provisional Patent Application Ser. No. 60/155,969 filed Sep. 24, 1999 entitled "Method of Forming a Tubular Blank into a Structural Component and Die Therefor."

The present invention also claims priority on co-pending U.S. Provisional Patent Application Ser. No. 60/409,788 filed Sep. 11, 2002 entitled "Improved Method of Forming a Tubular Blank into a Structural Component and Die Therefor."

The present invention relates to the art of forming structural components by use of high pressure fluid, and more particularly to a method of forming a tubular blank into a structural component by use of high pressure fluid.

INCORPORATION BY REFERENCE

The invention particularly involves formation of tubular metal components into a structural component by use of high pressure fluid. In particular, a tubular blank is formed to match the shape defined by the inner surface of a shell or cavity by use of a high pressure fluid. Such components can be used in various types of industries such as, but not limited to the automotive industry. In accordance with the invention, the shell or cavity is in a low permeability support structure wherein heating elements (e.g., induction heating coils, etc.) are supported therein to heat the tubular blank preparatory to formation into the desired shape imparted by the shell or cavity. A related technology has been developed by Boeing Company wherein a flat plate is formed against a contoured wall by gas pressure. This process is referred to as superplastic forming of a metal plate and is disclosed in Gregg U.S. Pat. No. 5,410,132, which is incorporated by reference herein. The '132 patent illustrates a process whereby the temperature of the metal plate is increased to a superplastic temperature by induction heating conductors mounted in a ceramic, low permeability cast die surrounding the metal forming chamber defined between two dies. This gas pressure chamber includes one surface against which the metal plate is formed. The Boeing process, as disclosed in the '132 patent, utilizes induction heating coils for the purposes of heating the metal preparatory to forming against a shaped surface by using high pressure gas on one side of the plate. The extent to which the '132 patent defines a ceramic die with embedded induction heating coils and the use of a high pressure inert gas for forming the metal sheet are incorporated herein, thus the details of such die induction heating coils and high pressure gas forming are not be repeated herein.

In Matsen U.S. Pat. No. 5,530,227; Matsen U.S. Pat. No. 5,645,744; and Matsen U.S. Pat. No. 5,683,608, the Boeing Company further illustrated more details about the die, induction heating coils in a cast die forming material and the dies used by Boeing Company for superplastic forming of a sheet metal plate. Matsen U.S. Pat. No. 5,530,227; Matsen U.S. Pat. No. 5,645,744; and Matsen U.S. Pat. No. 5,683,608 are also incorporated by reference herein so that the details of the technology developed by the Boeing Company do not again need to be repeated.

Another hydroforming process is disclosed in Amborn U.S. Pat. No. 6,067,831, Amborn U.S. Pat. No. 6,151,940; Amborn U.S. Pat. No. 6,205,736; Amborn U.S. Pat. No. 6,401,509; Amborn U.S. Pat. No. 6,460,250 which are also incorporated herein by reference.

Methods of hydroforming a metal blank are disclosed in Bruggemann U.S. Pat. No. 5,333,775; Hudson U.S. Pat. No. 5,960,658; Freeman U.S. Pat. No. 5,992,197; Jaekel U.S. Pat. No. 6,014,879; Marando U.S. Pat. No. 6,016,603; Amborn U.S. Pat. No. 6,067,831, Amborn U.S. Pat. No. 6,151,940; Amborn U.S. Pat. No. 6,205,736; Kleinschmidt U.S. Pat. No. 6,349,583; Amborn U.S. Pat. No. 6,401,509; are Amborn U.S. Pat. No. 6,460,250. These hydroforming techniques can be used in the present invention. Bruggemann U.S. Pat. No. 5,333,775; Hudson U.S. Pat. No. 5,960,658; Freeman U.S. Pat. No. 5,992,197; Jaekel U.S. Pat. No. 6,014,879; Marando U.S. Pat. No. 6,016,603; Amborn U.S. Pat. No. 6,067,831, Amborn U.S. Pat. No. 6,151,940; Amborn U.S. Pat. No. 6,205,736; Kleinschmidt U.S. Pat. No. 6,349,583; Amborn U.S. Pat. No. 6,401,509; are Amborn U.S. Pat. No. 6,460,250 are incorporated by reference herein so that the details of this technology need not be repeated.

Hot metal gas forming of steel is generally described in a joint venture proposal to the National Institute of Standards and Technology on Mar. 18, 1998. This proposal is incorporated by reference herein as background information.

Related United States patents and patent application Nos. U.S. Pat. Nos. 6,613,164; 6,322,645; Ser. No. 10/613,642 filed Jul. 3, 2003; 60/409,788 filed Sep. 11, 2002; and 60/155,969 filed Sep. 24, 1999 are all incorporated herein by reference for all their teachings related to the present invention.

BACKGROUND OF INVENTION

The present invention relates to the art of forming structural components by use of high pressure fluid, and more particularly to a method of forming a tubular blank into a structural component by use of high pressure fluid. The application of the method of forming a tubular blank into a structural component is primarily directed toward the production of structural components of the type used in the automotive field, and it will be described in this invention with particular reference thereto; however, the invention has much broader applications and may be used to form various structural components from metal blanks for use in many other industries (e.g. aeronautics industry, shipping industry, chemical and petroleum industry, biomedical industry, etc.).

In the past, metal structural components were normally produced by stamping, forming and welding. In an effort to obtain complex shapes, metal components have been formed by a hydroforming process using metal tubular blanks formed of sheet steel material having specific initial strength and elongation properties. The metal tubular blank was cut to length and pre-bent or preformed into a shape approximating the shape of the finished structural component. The preformed metal tubular element was then loaded into a two-piece die and closed in a hydraulic press typically having a closing pressure between about 3500–8000 tons.

The exposed ends of the metal tubular blank were sealed, and the metal tubular blank was then filled with a water and oil mixture. The internal pressure of the water and oil mixture inside the metal tubular blank was raised to a high level in the general neighborhood of 20,000–80,000 psi, which pressurized liquid expanded the metal tubular blank into the shape of the steel die cavity formed in the two die members of the die set carried by the hydraulic press. The cavities of the two die members have the desired final shape for the structural component so that as the metal tubular blank was expanded into the cavity, the outer shape of the component captured the shape of the cavity. This process produced a relatively accurate complex outer shape for the structural component. To relieve the fluid pressure in the formed structural component, holes were pierced into the formed structural component. Thereafter, the two die members were opened by the hydraulic press and the liquid was drained from the formed structural component. Secondary machinery operations, such as trimming and cutting mounting holes, were then performed to produce a desired component for final assembly.

This process for forming a metal tubular blank has gained in popularity because it forms the final structural component from the inside so complex shapes are possible; however, the total cycle time for hydroforming is at least about 25–45 seconds. The equipment to direct high pressure liquid into the metal tubular blank is extremely large and expensive. In addition, the die members are expensive machined parts that have a relatively short life. Hydroforming operations have a general limitation in that the process is used primarily to bend of the tubular blank, since the metal being formed is processed at ambient temperature which limits the maximum strain rate for the formed metal. The pressure of the liquid used in the hydroforming must be extremely high to deform the relatively cold sheet metal of the tubular blank into simple configurations. Consequently, hydroforming is used primarily for bending and straightening metal tubular elements into the desired final shape. Even though there are process limitations in using hydroforming to make metal tubular structural components, a substantial technology field has developed around this process. In one feature of hydroforming, the sheet steel tubular blank is formed into a desired shape while additional metal material is forced axially into the die cavity so that the wall thickness of the formed structural component does not drastically decrease as the volume of a given cross section increases during the processing by high pressure liquid.

Hydroforming is the primary prior art constituting the background of the present invention. However, blow forming of plastic sheets has been used for years to produce high volume plastic containers using conventional steel die members. Of course, such die members used in plastic blow forming cannot be used for forming steel. For that reason, hydroforming is used for metal instead of blow forming which is principally used in the plastics industry. The highly developed technologies of hydroforming of steel tubes and blow forming of plastic sheets constitute the background of the present invention; however, these two forming processes are not economically usable for forming sheet steel tubular blanks into tubular structural components. In addition, these two processes do not have the capability of controlling the metallurgical characteristics along the length of the metal tubular blank, as obtainable by the present invention.

Although hydroforming of sheet steel and blow forming of plastic sheets constitute the principal background material to the present invention, it has been found that certain features of the technology disclosed by Boeing Company in the patents identified above for superplastic forming sheet metal plates by high pressure gas can be used in practicing the invention. The Boeing Company processes are not background information from the standpoint that such processes are not capable of forming a shaped metal blank into a structural tubular component and are not capable of controlling the metallurgical characteristics of the metal forming the structural tubular component.

In view of the prior art, there is a need for a process for forming metal tubular blanks into simple or complex shapes which process is more economical that past processes, which process is less complex that past processes, which process has extended life for the forming components used to form the metal structural blanks, which process can quickly form metal structural blanks into various shapes, and which process is capable of controlling the metallurgical characteristics of the metal forming the structural tubular component.

SUMMARY OF INVENTION

The present invention provides a different type of technology that is dissimilar to prior hydroforming processes for steel and blow forming of plastic sheets. In accordance with the present invention, a metal component is made from carbon sheet metal formed by controlled rolling of the carbon metal sheet. As can be appreciated, other metals can be used in the metal forming process of the present invention such as, but not limited to, aluminum or aluminum alloys, magnesium or magnesium alloys, copper or copper alloys, stainless steel, titanium or titanium alloys, nickel or nickel alloys, and any other metal that has sufficient electrical conductivity and responds to thermally enhanced forming capability using induction heating. In addition to metals, glass and certain types of composite materials can be formed by the apparatus and method of the present invention. When sheet metal is used, the carbon steel sheet metal is formed into a shaped blank by heating the blank and then preforming the blank to the desired axial profile. The metal blank can be partially preformed prior to the metal blank being inserted into a die for final or near final formation into the structural component. In addition or alternatively, the metal blank can be preheated prior to the metal blank being inserted into a die for final or near final formation into the structural component. If the metal blank is to be preformed (e.g., pre-bent, etc.), the preheating, if used, can occur prior to and/or after the pre-bending of the metal blank. The preforming and/or preheating of the metal blank is not required; however, when forming structural components having certain shapes, the preforming process and/or preheating process can facilitate in the formation of the final structural component. During the forming process of the metal blank, the metal blank can be preheated prior to a fluid being inserted into the interior of the metal blank, heated as the a fluid is inserted into the interior of the metal blank, and/or heated after a fluid is inserted into the interior of the metal blank to cause the metal blank to at least partially form into the desired structural component. The heating and/or preheating of the metal blank can be achieved be one or more arrangements such as, but not limited to resistance electric heating, RF lamps, inductive heating, furnace, gas jets, lasers, radiation, particle beam, heating coils, convection heating, etc. When induction heating is partially or fully used to heat and/or preheat the metal blank, the induction heating can be by use of solenoid coils, transverse flux inductors, or other types of inductor equipment. When preheating and/or heating the metal blank by induction heating, the induction heating conductors or coils induce an A.C. voltage into the metal of the blank which cause $I^2R$ heating of the metal blank. This type of heating can result in rapid heating of the metal blank which can be used to reduce the preheating times and/or expansion times of the metal blank. The metal blanks are heated in the die member to a forming temperature that is less than the melting temperature of the metal forming the metal blank. In addition, the metal blanks are heated in the die member to a temperature that is less than the degradation temperature of the cavity or shell sections in the die members. Metal blanks formed of carbon steel are generally heated to about 600° F.–2500° F. during the forming process. Metal blanks formed of magnesium are generally heated to about 400° F.–1050° F. Metal blanks formed of aluminum are generally heated to about 450° F.–1100° F. Metal blanks formed of copper are generally heated to about 550° F.–1800° F. As can be appreciated, other forming temperatures can be used. The metal blank typically has at least one open end which is at least partially are plugged or sealed; however, this not required. The metal blank typically has at least one open end which is used to allow fluid to flow into the interior of the metal blank to at least partially cause the formation of the structural component in the die. As can be appreciated, one or more opening in the metal blank can be used to allow fluid to be inserted and/or removed from the metal blank prior to, during and/or after the at least partial formation of the metal blank into a structural component. The multiple opening can be used to facilitate in regulating the pressure in one of more interior regions of the metal blank. The metal blank is expanded by a fluid such as, but not limited to, a gas (e.g., air, $CO_2$, nitrogen, noble gas or other inert gas, etc.) at a pressure sufficient to at least partially form the metal blank into a structural component. Generally, the pressure level of the fluid in the metal blank is about 50–5,000 psi, and typically about 200–1000 psi. As can be appreciated, other pressures can be used which can depend on several factors such as, but not limited to, the type of material used to form the metal blank, the thickness of the metal used to form the metal blank, the heating temperature of the metal blank, the shape of the structural component the metal blank is to be formed, the desired time of forming of the metal blank into the structural component, etc. The fluid that is inserted into the metal blank can be ambient temperature, below ambient temperature or preheated. The preheating of the fluid can result in faster formation times of the metal blank into the structural component. As can be appreciated, the metal blank can be pre-pressurized by a fluid prior to heating the metal blank in the cavity or shell sections. For example, the metal blank can be filled with a gas to a predetermined pressure. Thereafter, the metal blank is heated. As the temperature of the metal blank increases, the gas inside the metal blank also heats up and expands. The expansion of the gas causes the metal blank to expand in the cavity or shell sections. The pre-pressured metal blank can be pre-pressurized prior to the metal blank being inserted into the cavity or shell sections and/or be pre-pressurized i the cavity or shell section, but prior to heating. When the metal blank is pre-pressurized, the metal blank can be, but not required to be, plugged to maintain the pressure within the metal blank. After the metal blank is formed, the gas that is plugged in the metal blank can then be released from the metal blank if desired. The cavity or shell of the die the metal blank is inserted in has the desired predetermined shape surrounding the metal blank. As a result, has the metal blank is expanded, the cavity or die imparts on the outer surface of the metal blank the shape of the cavity or shell thereby at least partially forming the metal blank into the desired shaped structural component. The expansion of the metal blank is typically multidirectional; however, this is not required. After the metal blank has been expanded in the cavity or shell to at least partially form the structural component, the shaped structural component is cooled. Typically, the shaped blank is cooled at a controlled cooling or quenching rate to control the metallurgical characteristics of the shaped blank thereby enhancing the mechanical properties of the resulting shaped blank. When the metal blank is formed of mild steel, the shaped blank is generally quenched to form a high strength steel; however, quenching of the mild steel is not required. As can be appreciated, other metals can be quenched to achieved certain desired metallurgical properties of the metal such as, but not limited to, aluminum.

The forming process of the present invention reduces the cost to process formed structural components by 30–50% or more and reduces the time to build, and the cost to build the forming die members by at least about 20–40% or more. By using structural components formed by the unique process of the present invention, the structural component is reduced in weight by about 5–20% or more. Although the inventive method typically involves the use of a fluid in the form of gas to expand the sheet metal shaped blank into the desired configuration for the structural element, the invention actually involves substantial improvements in this general process. In other words, the present invention is not merely the use of high pressure gas as a substitute for high pressure liquid used in hydroforming. As a result, one or more of the improvements of the present invention can be used in prior hydroforming processes to improve the efficiencies of metal forming, to reduce the time and/or cost of metal forming, and/or to form superior structural components.

One aspect of the invention involves the formation of a unique cavity or shell which is mounted in the die members of the die set opened and closed by a hydraulic press or other device. The cavity or shell sections and die members are constructed so that the shaped blank being formed into the shape of the cavity or shell can be heated along its length of the cavity or shell to at least partially control the heat of the shaped blank before and/or during the forming process. Such a controlled heating profile cannot be done in prior hydroforming processes. One type of heating arrangement that can be used is induction heating; however, other and/or additional heating arrangements can be used to obtain controlled heating. When using induction heating, the heating conductors or coils can localize the heating along the length of the metal blank. The induction coils can formed in the cavity or shell and/or be spaced from the cavity or shell by locating the one or more induction coils in the tools and/or die members. The die set not only can be designed to support the one or more induction heating conductors, but also can (a) support the forces necessary to restrain the shaped blank being formed and/or (b) provide increased wear resistance. By using the present invention, the yield strength along the length of the resulting structural component or end product can be varied by proper heating and cooling. This arrangement of the present invention is particularly advantageous if extended deformation is required in producing the desired finished shape of the structural element. By using the present invention, a formed structural component can be formed having more detailed outer configurations than obtainable with prior hydroforming processes. Indeed, the invention obtains the result generally associated with blow forming plastic sheets, but for metal components.

In accordance with another aspect of the present invention, the formation of the metal blank is at least partially accomplished by utilizing a unique and novel material from which the die member containing the forming cavity is constructed. By using this novel material, the heating along the length of the shaped blank can be varied. In one embodiment of the invention, the material utilized for the shape defining cavity or shell is durable material. In one embodiment of the invention, the material utilized for the shape defining cavity or shell is a rigid and has low permeability; however, this is not required. In another and/or alternative embodiment of the invention, the novel material is supported in a cast material, molded material and/or machined material used to support and/or hold the forming cavity of at least one and typically all the die members. The cast material, molded material and/or machined material used to support and/or hold the forming cavity is also typically formed of a low permeability material; however, this is not required. Generally the material that forms the cavity or shell is different from the material used to support the cavity or shell; however, this is not required. The die members are typically movable together by a hydraulic press; however, other means can be used. By making and using this type of die member, heating along the shaped blank can be varied so that subsequent cooling of specific portions of the structural component, if desired, can provide the desired metallurgical characteristics of the formed metal blank.

In accordance with still another and/or alternative aspect of the present invention, there is provided a method of forming a metal blank into a formed metal structural component having a predetermined outer configuration, wherein the method uses a shape imparting cavity or shell that is formed from a low permeability, rigid material. The cavity or shell is in the form of a first and second sections, each of which includes an inner surface defining the predetermined shape of the final structural component. As can be appreciated, more than two cavity or shell sections can be used (e.g., 3 shell sections, 4 shell sections, etc.). The cavity or shell sections have laterally spaced edges which define a parting plane between the two cavity or shell sections when the cavity or shell sections are brought together. The two cavity or shell sections form a total cavity or shell having an inner surface defining the shape to be imparted to the structural component as the metal blank is expanded into the cavity or shell. The each of the two cavity or shell sections can represent a half of the total cavity or shell, or one cavity or shell section can form more or less than half of the total cavity or shell. One cavity or shell section is mounted or secured in one die member and the other cavity or shell section is mounted or secured in the other die member so the die set can be opened and closed to define the part forming cavity or shell. By employing a rigid, hard material defining the shape to be imparted to the final part, the cavity or shell can be supported as a separate element in a cast, machined and/or molded material held in the framework of the dies. The cast, machined and/or molded material can be formed of a partially magnetic or a non-magnetic material. By utilizing a cast, machined and/or molded material, together with an inner cavity or shell section engaging the metal blank itself, the properties of the cavity or shell are not dictated by the compressive force carrying capacity necessary for the cast, machined and/or molded material. Consequently, by using a cast, machined and/or molded material, which is different from the rigid, hard material forming the cavity or shell sections that engage the metal blank during the forming process, both the support material and the cavity or shell material can be optimized. As can be appreciated, the cast, machined and/or molded material and the rigid, hard cavity or shell section material can be formed of the same material. As can further be appreciated, the cast, machined and/or molded material and/or the rigid, hard cavity or shell section material can be formed of one or more materials. When heating of the metal blank is at least partially by induction heating at is at least partially positioned about the cavity or shell section, the material used to form the cavity or shell section and the material supporting the cavity or shell sections are typically both low permeability materials so as to be generally transparent to the magnetic fields created by the conductors embedded and/or positioned about the cast, machined and/or molded material; however, this is not required. For instance, material of the cavity or shell section (e.g., the rigid, hard inner surface material) and/or the material surrounding the cavity or shell section (e.g., cast, machined and/or molded material) can include materials that are not low permeability thereby casing a variance of heating of the metal blank in one or more locations about the metal blank. To expand the blank, one or more of the open ends of the metal blank can be plugged while in one or both of the half cavity or shell sections of the die members. Typically, one or more open ends of the metal blank are plugged prior to the insertion of the metal blank into the die or after the metal blank has been inserted into the die and prior to high pressure fluid being inserted into the metal blank. The one or more plug ends of the metal blank are at least partially used to achieve high pressures in the interior of the metal blank so as to at least partially form the metal blank in the cavity or shell. Prior to, during, and/or after the pressure is induced in the interior of the metal blank, the metal blank is heated. In one aspect of this embodiment, the metal blank is at least partially formed into the final shape of the structural component by heating select axial portions of the metal blank. When select axial portions of metal blank are heated, the metal blank is typically heated by induction heating that includes axially spaced conductors adjacent the cavity or shell; however, other or additional forms of heating can be used. In another and/or alternative aspect of this embodiment, the heating of the metal blank can be done prior to, during and/or after a high pressure fluid is inserted into the metal blank. Consequently, formation of the metal blank is accompanied by forcing a fluid such as, but not limited to, a gas (e.g., air, nitrogen, argon, etc.) at high pressure into the plugged metal blank until the metal blank conforms to at least a portion of the inner surface of the cavity or shell, which pressurized fluid is inserted into the metal blank prior to, during and/or after the metal blank is heated. The pressurized fluid can be preheat prior to being inserted into the metal blank; however, this is not required. When using conductors spaced axially along the metal blank an at least partially positioned in the cast, machined and/or molded material that at least partially supports the cavity or shell, the metal blank is inductively heated to facilitate in the forming operation caused by the expansion action of the internal fluid pressure. By using this method of forming, the total or partial length of the shaped blank can be heated inductively.

In accordance with yet another and/or alternative aspect of the present invention, there is provided a method of forming a metal blank into a formed metal structural component having a predetermined outer configuration, wherein the method uses a shape imparting cavity or shell that is formed from material that is different from the material that at least partially supports the cavity or shell. In one embodiment of the invention, there is provided a two component die member. The inner component (e.g., cavity or shell sections)

defines the shape and the outer component (e,g., cast, machined and/or molded material) defines the compressive force absorbing mass. Thus, the two components of the die member be optimized. A better shape imparting inner component can be used to facilitate in shaping the metal blank and an inexpensive compressive force absorbing material used for the outer component can be used. In another and/or alternative embodiment of the invention, outer component is used to support both the cavity or shell sections and one or more of the heating elements. For instance, when induction heating coils are used to at least partially heat the metal blank, one or more of the induction heating coils are at least partially supported by the outer component. The outer component is typically a cast, machined and/or molded material. When a cast material is used, the cast material at least partially embeds one or more of the induction heating conductors thereby substantially permanently affixing the induction coils in place. When a molded and/or machined material is used, the molded and/or machined material can be formed so as to support the one or more of the induction heating conductors and/or cavity or shell sections, and enable one or more of the induction heating conductors and/or cavity or shell sections to be removed for servicing and/or replacing.

In accordance with still yet another and/or alternative aspect of the present invention, one or more of the cavity or shell sections include a durable material. In one embodiment of the invention, the hardness of the cavity or shell sections is generally at least about 500 (indenter ksi), typically about 500–7000 (indenter ksi), more typically about 1000–5000 (indenter ksi), and even more typically about 2000–5000 (indenter ksi). In another and/or alternative embodiment of the invention, the compressive strength of one or more of the cavity or shell sections is generally at least about 25 ksi, typically about 25–1000 ksi, more typically about 50–800 ksi, and more typically about 60–700 ksi. In still another and/or alternative embodiment of the invention, the elastic modulus of one or more of the cavity or shell sections is generally at least about 2 Msi, typically about 2–90 Msi, more typically about 5–80 Msi, and even more typically about 10–65 Msi. In yet another and/or alternative embodiment of the invention, the thermal expansion of one or more of the cavity or shell sections is generally less than about 20 ppm/C, and typically about 0.1–15 ppm/C, and more typically about 0.1–10 ppm/C, and even more typically less than about 5 ppm/C. In still yet another and/or alternative embodiment of the invention, the thermal conductivity of one or more of the cavity or shell sections is generally at least about 0.1 Btu/hr-ft$^2$-ft, and typically at least about 0.6 Btu/hr-ft$^2$-ft, more typically about 1–80 Btu/hr-ft$^2$-ft, and even more typically about 2–50 Btu/hr-ft$^2$-ft. In a further and/or alternative embodiment of the invention, the electrical resistivity of one or more of the cavity or shell sections is generally at least about 1 ohm-cm, and typically at least about 10 ohm-cm, and more typically at least about 50 ohm-cm. In still a further and/or alternative embodiment of the invention, one or more of the cavity or shell sections include monolithic oxide, monolithic nitride, monolithic carbide, composite oxide, and/or composite carbide. The material may or may not be toughened. In one aspect of this embodiment, the monolithic oxide includes fused silica, alumina, mullite, zirconia, beryllium oxide and/or boron oxide. In another and/or alternative aspect of this embodiment, the monolithic nitride includes $Si_3N_4$. In still another and/or alternative aspect of this embodiment, the monolithic carbide includes SiC. When using SiC, SiC is typically coated with a nitride to harden the surface. In yet another and/or alternative aspect of this embodiment, the composite carbide includes SiC/SiC and/or C/SiC. In still yet another and/or alternative aspect of this embodiment, the composite oxide includes Silica/Alumina, Silica/Mullite, Silica/Zirconia, Alumina/Zirconia, Alumina/Mullite, and/or Mullite/Zirconia. In yet a further and/or alternative embodiment of the invention, various materials for the composition of the cavity or shell section can be selected such as, but not limited to, oxides, i.e., refractory cements, glass ceramics, high strength ceramics (e.g., silicon nitride, silicon carbide, aluminum oxide, zirconium oxide etc.). These materials can be either monolithic or with various forms of reinforcements (composites) such as, but not limited to, ceramic particulate reinforced glass. As an example, in one process for making the rigid hard cavity or shell section, powder silica is compressed by more than 60% of full density. In another process, a silica-based glass ceramic is melted, mixed with silicon carbide reinforcement and formed into the desired cavity or shell section shape. It has been found that silicon carbide imparts improved properties to the cavity or shell section such as, but not limited to, wear resistance, ability to withstand elevated temperature, and reduced thermal shock. The use of silicon carbide also allows for the use of thinner cavity or shell sections thereby reducing thermal stress which in turn allows for greater heat penetration in the cavity or shell section. Similar results can be observed by the use of silicon nitride and other ceramic matric compositions (e.g., alumino-boro-silicate, polymeric/sol-gel). In still yet a further and/or alternative embodiment of the invention, one or more of the cavity or shell section sections generally has a thickness of about 1/32–3 inches, typically about 1/16–2 inches, 1/8–1 inch, and even more typically about 1/8–5/8 inch. As can be appreciated, other thickness can be used. In one particular design, a hard cutting tool type ceramic can be coated on the shaped surface. In one non-limiting example, one or more of the cavity or shell sections is formed of silicon nitride. The silicon nitride may or may not be sintered. The cavity or shell section is at least partially formed from powdered silicon nitride that is compressed to 50%–70% and then the shape is machined into the block. A vacuum is can be used to remove the air while nitrogen is used to penetrate the machined block thus forming a silicon nitride cavity or shell section. The formed cavity or shell section may or may not be completely hardened by sintering. In another and/or alternative embodiment of the invention, one or more of the cavity or shell sections are at least partially supported in another material in the die member. The material used to construct the cavity or shell section can be a different material and typically a more expensive material than the one or more materials used to at least partially support the cavity or shell section. As a result, the less expensive materials used to at least partially support the cavity or shell sections primarily act as a compressive force resistant material that is typically supported in a metal framework or the like. Consequently, the cost of the die can be reduced. In still another and/or alternative embodiment of the invention, the die set for forming a metal blank comprises a shape imparting cavity or shell formed of two cavity or shell sections made of a low permeability, rigid material. The cavity or shell sections have a thickness of about 1/32–2 inches and typically about 1/16–0.75 inch and are formed of silicon nitride and/or a ceramic matrix composite (e.g., silicon carbide, alumino-boro-silicate, polymeric/sol-gel). When a non-sintered silicon nitride cavity or shell section is used, the cavity or shell section has a thin coating on the inner shaped surface of the cavity or shell section formed by sputter deposed dense silicon nitride. Coatings such as, but not limited to, silicon carbide, zirconia and/or titanium nitride can also be used. The inner surface of the cavity or shell section defines the predetermined shape of the cavity or shell. The cavity or shell sections are supported on an outer support and mounting surface having spaced lateral edges which define the parting plane between the two cavity or shell section. The first and second die members have an upper side and a lower side and a generally nonmagnetic support framework for carrying the one or the cavity or shell sections. The cavity or shell section can be secured to the support framework of the first and second die members by a variety of means (e.g., cast, adhesive, mechanical connector, etc.). The nonmagnetic support framework is made or includes a force transmitting generally nonmagnetic material. If the support framework includes a cast material, the cast material typically is fused silica, silicon nitrate, or COC material; however, other non-magnetic materials can be used. When a cast material is used, the cavity or shell sections are substantially permanently connected to the support framework. When a cast material is not used, the framework can be made of high strength, temperature stable material. One non-limiting material that can be used is G-10 and G-11 glass-epoxy laminates having extremely high strength and high dimensional stability over a large temperature range. When G-10 or G-11 is used, the material is typically machined so that the heating elements and cavity or shell section can be inserted in the G10 or G11 support framework. The first and second die members are designed to be moved together to capture the metal blank in the shape imparted cavity or shell sections. The two die members carry a cavity or shell sections formed from a hard, rigid material selected for the purposes of long die wear. By using this type of die set, the induction heating conductors or coils are at least partially embedded within the cast fill material surrounding the shape imparting inner surface of the hard, rigid cavity or shell section. When a material other than a cast material is used (e.g. G10 or G11, etc.), the induction heating conductors or coils are laid in machined slots or grooves for each of the conductors or coils and the shape imparting inner surface of the hard, rigid cavity or shell section is then place on the machined surface of the support material. The conductors or coils and the cavity or shell section is then secured to the support structure, typically in a releaseable fashion so that maintenance of a particular die member is simplified. The spacing of the induction heating conductors or coils from one another along the longitudinal length of a particular cavity or shell section can be uniform or be varied. Alternatively and/or in addition, the spacing of the induction heating conductors or coils from the anterior surface of a particular cavity or shell section can be uniform or can be varied the longitudinal length of the cavity or shell section. This spacing of the induction heating conductors or coils allows for a certain heating profile of the metal blank to be achieved during the preheating and/or forming of the metal blank. The inductor coil location relative to the surface of the cavity or shell section can be selected to create tailored heating profiles of the metal blank during the forming process. As such, the heating profiles can be tailored for selected areas of the metal blank, to both complement the forming process and/or reduce thermal shock to the die member. During the forming of the metal blank, one or more ends of the metal blank are at least partially plugged. The fluid that is inserted into the metal blank to form the metal blank into structured component is typically a gas such as, but not limited to, air or an inert gas (e.g., nitrogen, argon, etc.). The metal that is used to form the metal blank is typically carbon steel; however, other metals can alternatively or additionally be used such as, but not limited to, aluminum, aluminum alloys, magnesium, magnesium alloys, copper, copper alloys, nickel, nickel alloys, stainless steel, titanium, titanium alloys, metal alloys that include electrically conductive materials (e.g., Al—Fe, etc.) and any other metal that has sufficient electrical conductivity and responds to thermally enhanced forming capability using induction heating. The use of metal blank forming process can also be used for bimetal or other multimetal structures (aluminum and steel), as well as metal matrix composites which have significant electrical conductivity and respond to thermally enhanced forming capabilities using induction heating. The metal forming process can also be applied to dual sheet welded enclosures that can also be adhesively bonded, metal brazed, and/or combined with internally filled activated foams (thermally and/or chemically). After the metal blank has ben formed into a structural component, the heated structural component is transferred to a cooling or quenching station where the component is at least partially selectively cooled or quenched along its axial length to obtain the metallurgical properties of the formed structural component. The induction heating of the metal blank can be at least partially varied along axial portions of the metal blank and/or the cooling or quenching of the formed structural component can be at least partially controlled along the axial length of the structural component to obtain and/or optimized the metallurgical properties and/or dimensional properties of the resulting structural component. The use of a hot metal gas forming process, increased forming times of the metal blank can be achieved (e.g., about 2–40 seconds and typically less than about 20 seconds), and increased deformable speeds can be obtained (strain rate greater than about 0.1 per second). The forming process can achieve more than about 100% uniform tensile elongation for several aluminum alloys, as compared to about 30% in cold forming processes. As such, the hot metal gas forming process of the present invention provides enhanced formability of the metal blank thereby greatly enhancing manufacturability of structural parts and offering increased design flexibility. Consequently, the process part has reduced weight, tooling costs and development time.

In accordance with a further and/or alternative aspect of the present invention, the predetermined shape formed by the cavity or shell section has an axial profile which can undulate. As a result, the final part formed from the metal blank can have curves and bends and/or other shapes.

In accordance with still a further and/or alternative aspect of the invention, the metal blank is at least partially preheated prior to high pressure fluid being inserted into the interior of the metal blank. The metal blank can be preheated prior to and/or after the metal blank is inserted into the cavity or shell sections. If the metal blank is to be preformed (e,g., pre-bent, etc.) prior to be inserted into the cavity or shell sections, the metal blank can be pre-heated prior to and/or after the metal blank is preformed. The metal blank is preheated to shorten the heating and/or forming times for the metal blank, reduce the amount of energy used to form the metal blank, and/or make it easier and/or faster to obtain a desired forming temperature. The preheating of the metal blank can avoid heat hardening of a weld zone prior to hot metal gas forming (HMGF). In addition, the preheating of the metal blank can improve the material grain profile of the metal blank, reduce processing costs, and/or increase the efficiency of forming the metal blank. By preheating the metal blank, the total metal blank is at an elevated temperature so that subsequent heating of the metal blank merely raises the temperature beyond the preheated temperature of the metal blank. The preheating of the metal blank can be accomplished by any number of heating methods such as, but not limited to, resistance electric heating, RF lamps, inductive heating, furnace, gas jets, lasers, radiation, particle beam, heating coils, convection heating, etc. In one embodiment of the invention, one or more cavity or shell sections are preheated by resistance heating such as induction heating. The resistance heating includes the passing of an alternating current, or direct current, through the metal of the metal blank, preparatory to moving the metal blank into the forming cavity or shell. Different materials forming the metal blank will be preheated to different temperatures. The amount of preheating of the metal blank can be varied depending on the type of metal to be processed and/or the thickness of the metal to be processed. For example, a metal blank formed of magnesium or magnesium alloy is typically preheated to about 300–800° F. A metal blank formed of aluminum or aluminum alloy is typically preheated to about 500–1200° F. A metal blank formed of carbon steel is typically preheated to about 1000–2450° F. As can be appreciated, other preheating temperatures can be used. As stated above, by preheating the metal blank prior to the metal blank being inserted into the forming die can result in a reduced amount of time of forming the metal blank within the die and further reduce the amount of energy needed during the forming process. As can be appreciated, the preheating of the metal blank can at least partially occur while the metal blank is positioned in the die.

In accordance with yet a further and/or alternative aspect of the present invention, heating is varied along the length of the metal blank and/or over specific regions of the metal such that different locations of the metal blank are heated to different temperatures and/or at different time intervals to achieve optimal strain distribution control of the metal blank. In one embodiment of the invention, axial portions of the metal blank can be inductively heated in different induction heating cycles dictated by the desired metallurgical characteristics and deformation amount at axial portions of the metal blank. As can be appreciated, other and/or additional means for selectively heating the metal blank can be used. By changing the induction heating effect along the blank preparatory to forming and/or during forming, the induction heating process is "tuned" with temperatures at different locations on the metal blank. In this manner, the desired metallurgical characteristics and/or the optimum forming procedure is obtainable. The use of induction heating to different degrees at various portions of the metal blank allows thermal processing of the various portions differently. As can be appreciated, other and/or additional means for selectively heating the metal blank can be used. In one aspect of this embodiment, variations in the induction heating along the length of the blank can be accomplished by a number of coils or conductors positioned along one or more the cavity or shell sections. The heating cycle of selected portions of the metal blank can be controlled by varying the frequency, the power, and/or the distance of the conductors from the metal blank; the spacing between two or more axially adjacent conductors; and/or the induction heating cycle time of one or more conductors. By changing one or more of these induction heating parameters, the metal blank being formed can achieve controlled heating along its length and/or in select portions of the metal blank. The temperature the metal blank is heated to can also be controlled. For metal blanks formed of carbon steel, the heating temperature during the forming process is generally about 600° F.–2500° F. Metal blanks formed of aluminum, copper and magnesium can be heated to a lower forming temperature. By using the heating process of the present invention, a specific temperature profile for the metal blank during the forming of the metal can be achieved to obtain the desired formability plasticity of the metal blank.

In accordance with still yet a further and/or alternative aspect of the present invention, the fluid that is inserted into the metal blank to at least partially cause the metal blank to form in the cavity or shell sections is heated. The fluid can be heated to several hundred or several thousand degrees Fahrenheit. Generally the fluid is preheated to at least about 300° F., and more typically about 400–2800° F. The temperature of the preheated fluid into the metal blank will generally depend on the type of metal forming the metal blank. For example, the preheated fluid that is inserted into a metal blank formed of magnesium or magnesium alloy is typically about 400–750° F. The preheated fluid that is inserted into a metal blank formed of aluminum or aluminum alloy is typically about 800–1200° F. The preheated fluid that is inserted into a metal blank formed of carbon steel is about 2000–2400° F. As can be appreciated, other preheating temperatures of the fluid can be used. The preheating of the fluid can facilitate in the speed of forming the metal blank in the cavity or shell sections. The insertion of preheated fluid into the metal blank prior to heating of the metal blank by resistance heating and/or other heating means will result in the preheating of the metal blank. The insertion of preheated fluid into the metal blank during heating or after heating of the metal blank in the cavity or shell sections results in the reduction of heat loss and temperature reduction of the metal blank during the forming process. When cool fluid is inserted into the heated metal blank, the cool fluid will be heated by the heated surface of the metal blank through heat transfer. However, during this heat transfer process, the surface of the metal blank is cooled. The cooling of the metal blank surface can result increased forming times of the meal blank. The cooling of the metal blank surface can also interfere with heating profiles of the metal blank during the forming process. By preheating the fluid being inserted into the metal blank, the preheated fluid during the forming process can heat metal blank and/or stabilize the temperature of the metal blank.

In accordance with another and/or alternative aspect of the present invention, the region about the metal blank while the metal blank is positioned in the cavity or shell is maintained at ambient pressure (1 atm.) or under a vacuum. The regulation of the pressure about the metal blank during the forming of the metal blank can facilitate is the formation of the metal blank. High pressure about the metal blank as the metal blank is formed in the cavity or shell can interfere with the formation of the metal blank thereby resulting in increased formation times and/or improper formation of the metal blank in the cavity or shell. Maintenance of the pressure about the metal blank at or below ambient pressures facilitates in the formation of the metal blank. A vacuum in the region about the metal blank can result in faster formation times for the metal blank. The control of the pressure about the metal blank can be achieved by allowing fluids (e.g. air) about the metal blank to flow out one or more regions about the ends of the metal blank and/or flow through one or more openings in the cavity or shell sections.

In accordance with still another and/or alternative aspect of the present invention, the metal blank that has been heat and formed into metal structural component is transferred to a cooling or quench station. In the cooling or quench station, the heated structural component is liquid and/or gas cooled or quenched at least partially along its length. In accordance with one embodiment of the invention, the cooling or quenching action is also "tuned" along the length of the heated structural component. By controlling the amount of heating during the forming process and the cooling or quenching time of the formed structural component, the metallurgical properties and/or dimensional properties of the structural component are controlled atone or more regions of the formed structural component. The cooling rate of the formed structural component can be at least partially controlled by the flow rate and/or temperature of the cooling fluid (e.g., liquid and/or gas) about and/or within the heated structural component. In one aspect of this embodiment, the metal blank is inductively heated in a controlled fashion at various locations along the length of the metal blank and high pressure fluid is inserted into the heated metal blank to cause the metal blank to deform and form along the inner surfaces of the cavity or shell thereby forming the metal structural component. The formed metal structural component is then cooled or quenched in a controlled fashion to dictate the metallurgical characteristics along the length and/or in various regions of the metal structural component.

In accordance with yet another and/or alternative aspect of the present invention, metal is fed into the cavity or shell during the forming of the metal blank. The feeding of metal into the cavity or shell facilitates in maintaining a desired wall thickness of formed structural component. In one embodiment of the invention, as the metal blank is expanded into the shape of the cavity or shell, portions of the metal blank inside the cavity or shell are redistributed within the cavity or shell and/or metal outside of the cavity or shell are moved into the cavity or shell to provide the desired amount of metal to certain regions of the formed structural component. The adding of metal into the cavity or shell and/or the redistributing of metal inside the cavity or shell helps to prevent a drastic reduction in the wall thickness of the formed structural component when expansion of the metal blank has occurred in the cavity or shell.

In accordance with still yet another and/or alternative aspect of the invention, the pressure of the forming fluid (e.g., liquid and/or gas) within the metal blank is sensed and controlled at the desired pressure. The fluid pressure is controlled in the general range of about 200–2500 psi which is sufficient to expand the heated metal blank. As can be appreciated, other fluid pressures can be used. In one embodiment of the invention, the fluid pressure is at least partially controlled by controlling the pressure introduced into the metal blank and/or by controlling the venting of pressure from the metal blank.

In accordance with a further and/or alternative aspect of the present invention, the cavity or shell section of the die member includes materials that have increased wear resistance, withstand elevated temperatures and/or withstand the effects of thermal shock. In one embodiment of the invention, the cavity or shell section includes a mesh construction, which mesh construction increases the wear resistance of the cavity or shell section, and is able to withstand elevated temperatures and thermal shock during the forming of a metal blank. In one aspect of this embodiment, the mesh construction includes continuous or chopped fibers of silicon carbide, alumino-boro-silicate, and/or a polymeric/sol-gel (organocylene or glass ceramic sol). In another and/or alternative embodiment of this invention, the cavity or shell section includes silicon nitride. Coatings such as, but not limited to, silicon carbide, zirconia and/or titanium nitride can be used on the silicon nitride. In still another and/or alternative embodiment of this invention, the cavity or shell section includes the monolithic oxide (e.g., fused silica, alumina, mullite, zirconia, beryllium oxide, boron oxide, etc.), monolithic nitride (e.g., $Si_3N_4$, etc.), monolithic carbide (e.g., SiC, etc.), composite oxides (e.g., silica/alumina, silica/mullite, silica/zirconia, alumina/zirconia, alumina/mullite, and/or mullite/zirconia), and/or a ceramic matrix composite (e.g., silicon carbide, alumino-boro-silicate, polymeric/sol-gel). The cavity or shell section provides a more durable surface through better toughness (crack resistance) and improved thermal shock resistance. In one non-limiting example, the fabrication of a ceramic matrix composite on the die member includes the immersion of a fabric into a slurry which includes a ceramic matrix composite (e.g., SiC). The impregnated fabric is then laid upon the inner surface of the die member and subsequently cured on the die member at an elevated temperature (1200–2500° F.). The use of a cavity or shell section significantly improves the metal blank forming process. The design of an induction processing system can include dies contained in a phenolic box, a machined box, a molded box or other type of structure. When phenolic box is used, the phenolic box serves as the casting containment walls and pressure plates for subsequent reinforcement during the forming process. Heating elements such as, but not limited to, induction coils are positioned in the phenolic box to provided electromagnetic energy to the metal blank during the forming process. To provide a post-stress compressive state to the ceramic die and to enable improved durability to the system, reinforcement rods are commonly placed through the phenolic box before the ceramic die is formed or casted. One such die design is disclosed in U.S. Pat. No. 5,683,608, which is incorporated herein by reference. When a cast material is not used, a machined or molded box is typically used. The machined material such as, but limited to, G10 or G11 is machined to include openings or slots for the heating elements and the cavity or shell section. As with the cast system, the heating elements such as, but not limited to, induction coils are positioned in the box to provided electromagnetic energy to the metal blank during the forming process. A coolant typically runs through the induction coils to cool the induction coils during the heating process. An electrically conducting material and/or smart susceptor (which will be described in further detail below), can reside and collect electromagnetic energy and converts it into thermal energy during the forming process. The susceptor can be used to control the temperature of the heated metal blank by matching the Curie temperature of the metal blank with the critical processing temperature during the forming process. One use of susceptors is disclosed in U.S. Pat. Nos. 5,728,309 and 5,645,744, both of which are incorporated herein by reference. During the processing of the metal blank, a metallic strongback can be used as a stiffplate to keep the formed metal blank dimensionally accurate and a mechanical constraint can be used to keep the die halves together. The induction processing system can also include a flexible coil connection to provide the ability to open and close the dies while the coils are connected. In the past, when using a cast die system, the die included fiberglass rods. Since the cast ceramic had good compressive strength but low tensile strength, a technique similar to pre-stress concrete was utilized in the die construction. The fiberglass rods were fixed in the holes of the phenolic box and the induction coils between the rod and the OML surface of the die. After the casting was complete, the fiberglass rods were placed in tension by tightening of the ends of the rods by nuts or other connecters. The resulting compressive load on the phenolic member placed a subsequent compressive load onto the ceramic. This preapplied compressive load counteracted the tensile loads that developed during the processing of the metal blank, thus allowing the cast ceramic to be operated in the compressive load range where it performs better. When using a machined or molded die system that does not use a cast material, the use of such rods can be eliminated. Another feature of the fabrication of the metal blank is the location of the induction coils relative to the cavity or shell sections. Induction coils can be fabricated from one-inch diameter thick wall (0.0625 wall thickness) round copper tubing which is in a lightly drawn condition. This lightly drawn condition allows for deformation by the tube ending to properly bend these tubes to accurate dimensions within the die member. These coils affect the die thermouniformity by both depositing electromagnetic energy and by removing energy. This energy removal is due to the fact that the coils are cooled by water or some other type of coolant. When an oscillating electric current is supplied to the coils, a resulting electromagnetic flux is produced. This flux travels directly through the die member due to the dielectric properties of the die member. The flux then couples with the susceptors, if used, and the high magnetic permeability of the susceptors makes it the lowest energy path for the magnetic flux to reside. This coupled oscillating magnetic flux causes induced currents to flow in the susceptor and resistive losses (heating) to occur. Typically the susceptor is positioned about 0.5–4 inches from the inner surface of the cavity or shell section, and more typically about 0.5–1 inch from the inner surface of the cavity or shell section; however, other distances can be used. When the die member utilizes a material having a very low thermal expansion coefficient (e.g., cast material, G10, etc.) the die member can support the thermal gradient between the heated susceptor and the cooled coil without large stress gradients and subsequent spalling of the material. When the die member utilizes a material having a highly thermally insulative property, the die material saves virtually all the energy needed to heat the metal blank when using standard processing techniques (i.e. autoclaves, vacuum furnaces, hot presses, etc.). In addition, the time period needed to heat up and cool down of the die and/or metal blank can be significantly shortened, thus allowing for labor savings and energy savings, and/or more rapid processing of the metal bodies. In addition, improved performance of metal blank forming can be accomplished through the tailoring of the thermal cycles (i.e. integrated cycles for forming and heat treatment of metals). A susceptor itself can have an internal material base phenomenon that controls its temperature reached by induction heating to a set point. The set point temperature is the critical processing hold temperature and is made, through susceptor chemistry control, to substantially coincide with the Curie temperature of the susceptor material. The Curie temperature is a temperature at which the susceptor material becomes non-magnetic. While still magnetic, the susceptor entirely houses the magnetic flux generated by the coil. When the initial area of the susceptor first reaches the Curie temperature, the material become non-magnetic. The magnetic field becomes distorted due to the fact that the magnetic flux lines have an easier path going around the non-magnetic area by traveling through the magnetic material. Also, the flux is no longer tightly housed in the thickness of the susceptor. As a result, this will cause the lead thermocouple (from a group of thermocouples being monitored during a heating run using induction heating technology) to level off at the Curie temperature of the susceptor and the lagging thermocouples will then rise in temperature and level off at the Curie temperature. The cavity or shell sections are fabricated against the existing die member to replicate the OML surface of the part of the metal blank to be fabricated to take into account shrinkage due to cooldown after forming and from any processing shrinkage inherent in the die. The rest of the die is built up from the cavity or shell sections of the die. The use of the cavity or shell sections of the present invention in combination with cast materials, machined material or molded material, a much tougher and more impact resistant cavity or shell section can be achieved. In one particular design, the use of the cavity or shell sections enables lightweight and structurally efficient monolithic structures, thus provides cost savings over built-up aluminum, built-up composite, built-up titanium, and the like. Since these enabled structures are one piece or a limited number of pieces, these structures involve very little fastening with the part count reduced, thus the time taken to fabricate the structure, due to reduced labor of fastener installation, is significantly less and less inventory of the parts is required. In the past, the high cost of limited life steel and ceramic tooling for single sheet and multi-sheet SPF of titanium created a cost barrier to such use. Long life and relatively inexpensive tooling is enabling technology to change the cost structure of SPF titanium, thus will allow the process to be more cost sensitive to commercial applications.

In accordance with still a further and/or alternative aspect of the present invention, flux concentrators, when used, are used in association with induction coils to facilitate in tailoring the heating profile of the metal blank during the processing of the metal blank. In one embodiment of the invention, the flux concentrators enable the induction current path to the metal blank to be varied along the length of the coils. In another and/or alternative embodiment of the invention, the use of flux concentrator can extend the life of the die members. The thickness of the die member material can affect the temperature gradient between the induction coils and metal blank. Thinner thicknesses between the induction coils and the surface of the cavity or shell section can result in a lower surface temperature, thus increase the thermal shock to the die member. Increasing the distance between the induction heating coils and the surface of the cavity or shell sections can lower thermal shock to the die, thus increasing the life of the die. The inclusion of magnetic flux concentrators about the induction coils allows the induction coils to be spaced at a greater distance from the die surface, thus reducing thermal shock to the die without sacrificing the proper heating of the metal blank during the processing. In one aspect of this embodiment, laminations can be used to increase coupling distance of the inductor, thus reducing the required coupling efficiency of the induction coils. As can be appreciated, many types of flux concentrators can be used. The flux concentrators can be fully or partially positioned about one or more of the induction coils. As can further be appreciated, the amount and/or composition of flux concentrator can be varied from coil to coil so as to tailor the type of heating of the metal blank during the processing of the metal blank.

In accordance with yet a further and/or alternative aspect of the present invention, one or more induction coils can be insulated to improve the heating profile during the processing of the metal blank and/or reduce thermal shock to the die members. The thermal insulation of one or more induction coils can be used so the induction coils abstract less heat and allow the die members to operate at elevated temperatures. This technique can be varied so that it can be selectively applied to complement the forming operation and/or modify the net cooling effect during the processing of the metal blank. The temperature of the inner diameter of the die member is dependent on the rate of thermal energy flowing from the induction coils to the metal blank. The wrapping the coils with thermal insulating material allows the inner diameter of the die member to operate at higher temperatures and less thermal shock, thus increasing the life of the die member and the effectiveness of the die member during the forming of the metal blank. Many types of insulating material can be used to insulate one or more of the induction coils. The composition and/or amount of insulation about the one or more coils can be varied or maintained as constant. As such, the use of thermal insulation about one or more of the induction coils can facilitate in tailoring the heating profile of the metal blank during the forming process as well as to achieve the advantages as set forth above.

In accordance with another and/or alternative aspect of the present invention, the induction coils are cooled with a coolant that has a higher boiling point than water. The use of a coolant which has a higher boiling point than water facilitates in reducing thermal shock to the die member during the forming of the metal blank. The coolant can be water that includes one or more additives, or can include a coolant made from components other than water. The use of higher boiling point coolants also allows the die to operate at higher temperatures. In one embodiment of the invention, a material called Dynatherm is used as the coolant for one or more of the induction heating coils.

In still another and/or alternative aspect of the present invention, one or more current carrying materials are included in the cavity or shell section of one or more the die members to reduce thermal shock to the die member, provide tailored heating of the die member, and/or elevated heating by the die member. The inclusion of one or more metallic and/or magnetic materials in the die member results in elevation of the temperature of the die member, thus reducing the thermal shock to the die member during the forming process of the metal blank. As such, a suitable material can be added to the die member to increase its thermalelectrical conductivity sufficiently so that the die member can actually accept and/or provide the capability of receiving some of the energy from the induction coils to increase the temperature of the die member, thereby complement thermal shock requirements and/or forming activities. The electrically conductive materials can be concentrated or spaced in a manner to obtain tailored a heating profile of the metal blank during the forming of the metal blank. In one embodiment of the invention, the die member and/or cavity or shell section of the die member includes a current carrying material designed to reduce thermal shock to the die member during the formation of the metal blank. The use of a current carrying material is capable of reducing the repetitive thermal shock that the die member encounters during the repeated formation of metal bodies within the die member. The current carrying material can be embedded in the die member and/or laminated or the surface of the cavity or shell section, or otherwise bonded to the surface of the cavity or shell section. The current carrying material can be uniformly dispersed or positioned in the die member and/or on the surface of the cavity or shell section, and/or be selectively dispersed or positioned in the die member and/or on the surface of the cavity or shell section to facilitate in tailoring the desired heating effects by the die member during the formation of the metal blank within the die member. The current carrying material can also be used to increase the die member rigidity and/or rigidity of the surface of the cavity or shell section, thereby making the die member more durable during the formation process. As such, the current carrying material is used to increase the electrical conductivity of the die member so that the die member accepts or provides the capability of receiving some of the energy inductively produced by the one or more induction heating coils to thereby increase the temperature of the surface of the cavity or shell section, reduce the effects of thermal shock on the die member during formation of the metal blank, facilitate in increasing the temperature of the die member during the formation of the metal blank, better tailor the temperature profile of the metal blank during the forming process, and increase the strength of the die member. The current conducting material can be bonded and/or coated to the surface of the cavity or shell section; and/or can be at least partially embedded in the die member. The current conducting material can include discreet types of electrically conductive metallic fibers, powders, polymer coatings, metallic plates, metallic rods, polymer plates, polymer rods, and the like. Any type of current carrying material can be used such as, but not limited to, iron, copper, aluminum, and other current carrying metals, and/or other current carrying polymers and/or composites. In one non-limiting example, an aluminum oxide, copper oxide, and/or iron oxide coating is applied to the surface of the cavity or shell section such that the surface of the cavity or shell section can conduct current. In another and/or alternative non-limiting example, the die member includes a composite or complete construction using iron laminations or other metal laminations to control and contain the flux field of the induction coils.

In yet another and/or alternative aspect of the present invention, the die member and/or metal blank can be at least partially mechanically stimulated during the formation of the metal blank to enhance the metal blank formation in the die member. The use of mechanical stimulation during the formation of the metal blank can increase the rate of formation of the metal blank in the cavity or shell. Such mechanical stimulation can be in a form of many sources such as, but not limited to, a vibratory actuator mounted on the metal blank and/or one or more die members, a low or moderate frequency pulsating device located on one or more components of the die member and/or positioned at one or more ends of the metal blank, and/or a vibratory action and/or pulsing of the fluid which is inserted into the metal blank during the forming of the metal blank within the die. The vibratory action can be accomplished in many ways, such as by a servomotor, vibrating device, fluid valving network, and/or the like.

In still yet another and/or alternative aspect of the present invention, the metal blanks that are formed in the die member can be tailor made so as to facilitate in the proper formation of the metal blanks within the die member. The tailoring of the metal blank can be made by using different materials on different portions of the metal blank, having various thicknesses on different sections of the metal blank, forming unique shapes for the metal blank, etc. The tailored blank can be formed from one or more sheets of material. The use of tailor metal blank assemblies or sheets can be formed into various geometries wherein the metal bodies can vary in initial wall thickness of the material to complement the final resulting part with a desired wall thickness. The tailor metal blank can be pre-bent by use of conventional bending techniques to facilitate in the formation of the metal blank. The different metal bodies are typically welded together when forming the metal blank. The tailor made blank can include one or more internal metal stiffening members that can be incorporated into the internal metal blank to both substantially increase the stiffness of the formed metal blank and/or to cause the metal blank to form in a certain manner. These internal stiffening members are typically made of metal, composites, and/or the like. One or more metal stiffening members can be positioned in one or more regions of the metal blank so as to achieve the desired stiffness in a certain region of the metal blank and/or the desired shape of the metal blank in a certain region. In one embodiment of the invention, the metal blank is a piece of metal that starts with a flat blank or coil of material that is rolled and/or formed into a certain shaped structure. This structure can have a constant diameter throughout its length, can have a tapered shape (trapezoidal flat blank rolled into a cone shape which may be opened at one end only or opened at both ends), or a variety of other different shapes. The metal blank can be multi-thickness and/or made of multiple material grades and/or types. The ability to obtain metal blanks that have multiple thicknesses and/or multiple materials can be accomplished by prewelding the blank with a variety of different materials. For instance, two or more flat blanks or two or more coils of material can be joined by using a welding process (resistance welding, induction welding, laser welding, fusion welding, mig welding, tig welding, mash seam welding, friction stur welding, STT welding, and/or other types of welding). As can be appreciated, the one or more materials can be connected by other means in addition to or other than welding, such as bolting, bracing, soldering, melting, adhesives, and/or the like. Tailor made blank can also include regions of different materials so that certain regions of the formed metal blank will have certain physical and/or structural properties. Typically, these regions or patches can be welded on the blanks; however, other bonding means can be used. In yet another and/or alternative embodiment of the invention, the metal blank can be formed such that it is at least a partially sealed component, thereby designed to maintain pressure within the metal blank during the forming process. As such, the tailor made blank can be formed so as to tailor the regions wherein the fluid can enter the metal blank so as to facilitate in the proper forming of the metal blank in the die. The metal blank can have one or more fluid accesses and/or the accesses can have a certain size and/or shape to thereby facilitate in the forming of the metal blank. The tailor made blank can have specific weld lines during the connection of the parts of the tailor made blank so as to alter and/or control the forming of the metal blank in the die and/or to provide certain physical properties of the metal blank at such welded regions. As can be appreciated, various types of welds can also be used to facilitate in the desired shape forming of the tailored blank and/or the physical properties of the tailored blank. In sum, the tailored blank can have multiple shapes, multiple thicknesses, multiple material types, one or more welding profiles, one or more types of welds, one or more internal stiffening members, one or more controlled fluid inlets, one or more specially sized fluid inlets, and/or one or more sealed or capped regions. One or more of these features of the tailored metal blank facilitates in obtaining the desired shape of the metal blank during the formation in the die member the desired physical properties of the tailored metal blank prior to and after formation, the desired thicknesses of the metal of the tailor made blank, the desired strength of the tailored blank after formation, and/or the like.

In a further and/or alternative aspect of the present invention, capacitor shunts can be used to tailor the heating profiles of the metal blank during the formation of the metal blank within the die member. The use of capacitor shunts enables axial thermal energy profiling during the formation of the metal blank in the die member. This concept utilizes the ability to adjust energy distribution axially along the induction coil assembly by capacitor shunting appropriate sections of the coil assembly. This can be done statically or can be arranged to be done dynamically during the heating operation. The technique for changing the axial energy profile can include adding a shunt capacitance at the ends of the one or more inductor coils to vary temperature that is produced at the ends of the induction coils. The axial energy profiling also or alternatively can be used to change or adjust the temperature provided by a selected area of the induction coil to complement a particular part geometry or forming requirement of the metal blank within the die during the forming process. These shunts can be fixed or can be switched into operation and/or out of operation during the heating cycle to thereby further tailor the heating profile of the metal blank in the die. The switching of the capacitor shunts can be done manually and/or electronically to achieve the desired heating profiles.

In accordance with still a further and/or alternative aspect of the present invention, the end of the metal blank can be sealed during or prior to the formation of the metal blank to facilitate in the proper forming of the metal blank and/or achieve the desired thicknesses of the metal blank in certain regions of the metal blank. The end sealing of the metal blank can be accomplished by clamps on the outside of the metal blank and/or by compressively sealing the ends of the metal blank during the forming process. The clamps and/or compressive seals can also be used to pull or push the ends of the metal blank during the feeding of the metal blank into the die member to thereby impart a tension to the metal blank during the forming process to keep the metal blank from improperly thinning during the formation process and/or to achieve the desired shape of the metal blank during the forming process. In one aspect of the present invention, the end sealing device is designed to grasp the end of the metal blank independently of the die member and to seal the end of the die member without applying a compressive or tensile force on the metal blank, and/or to subsequently allow the end sealing and clamping mechanism to then provide end feeding for axial compression and/or even axial tension. Such a device can be individually or simultaneously controlled for each end of the metal blank during the forming process. The end clamping assembly can also facilitate in providing mechanical vibrations to the meal blank during the formation process.

In still yet another and/or alternative aspect of the present invention, a smart susceptor is used to control the heating profile of the metal blank during the forming process and/or to reduce the thermal shock to one or more die members during the forming process. The smart susceptor can be designed to be connected and/or disconnected during the heating cycle of the metal blank in the die member to thereby obtain tailored heating profiles and/or to control the thermal shock to the metal die during the forming process. Smart susceptors can be an effective method of controlling the temperature of the metal blank during application of induction heating. One method of using smart susceptors includes the heating of the susceptor and transferring energy via convection, conduction, or radiation to the metal blank. During fast thermal cycling, a hybrid direct heating/smart susceptor scenario can be designed to accomplish such a mechanism. These designs will take advantage of the rapid heating available through direct heating and the control of the smart susceptor. Specific smart susceptor designs can be constructed allowing significant magnetic energy through the susceptor to directly heat the part. This can be done by disconnecting the susceptor at the beginning of the cycle or any time during the cycle and allowing the magnetic energy to interact directly with the metal blank within the die member. Thereafter, the smart susceptor can be reconnected when the metal blank is nearing the processing temperature to take advantage of the thermal control feature of the smart susceptor. Other designs of the smart susceptor allow energy to pass through the susceptor when it is in a non-magnetic state and to directly heat the part. Energy is then scaled back when the forming of the metal blank begins to again capitalize on the control characteristics of the smart susceptor. A smart susceptor design can also be used to eliminate or remove hot spots during the formation of the metal blank. In one embodiment of the present invention, the current path to the smart susceptor is broken initially, thus does not heat appreciably during the initial heating of the metal blank. In this case, energy will flow through the susceptor and interact directly with the metal blank itself. This direct coupling of magnetic energy to the metal blank will cause the part to heat rapidly. When the metal blank gets close to the desired forming temperature, the smart susceptor is reconnected. The susceptor then heats rapidly just prior to or as the metal blank is being formed. The metal blank is then shielded from the magnetic field produced by the inductor coils. As a result, the smart susceptors will smooth the energy distribution to the metal blank, thereby reducing or eliminating hot spots to the metal blank. In another and/or alternative embodiment, the use of the smart susceptor would consist of selecting a frequency and a smart susceptor thickness that allows significant energy to penetrate the susceptor after the susceptor is activated to a non-magnetic state. The frequency would be such that it heats the metal blank efficiently and the smart susceptor would rapidly heat to the Curie point and then allow the metal blank to heat to a desired temperature for forming to begin. In such a situation, the smart susceptor would again smooth the energy distribution and reduce or eliminate hot spots. When an oscillating electric current supplied by a power supply passes through the induction coils, a resultant electromagnetic flux is produced. This flux then travels through the ceramic die due to its dielectric properties. When the one or more smart susceptors are activated, the flux is able to couple with the magnetic susceptors. The high magnetic permeability of the susceptors make it the lowest energy path for the magnetic flux to reside. This coupled oscillating magnetic flux causes induced currents to flow into the susceptor and a resistive loss (heating) to occur. When the initial area of the susceptor reaches the Curie temperature, the susceptor becomes non-magnetic. The magnetic field can then become distorted due to the fact that the magnetic flux has an easier path going around the non-magnetic area by traveling through the magnetic material. Also, the flux is no longer entirely housed in the thickness of the susceptor, thus will cause the leading thermocouple to level off at the Curie temperature of the susceptor and the lagging thermocouples will then rise in temperature and also level off at the Curie temperature. As such, a more uniform heating distribution of the metal blank can be achieved. As can be appreciated, the one or more smart susceptors can be used within the die member to achieve a desired tailored heating profile of the metal blank. In addition, the smart susceptors can be positioned at various distances from the surface of the metal blank in the die member to also achieve tailored heating of the metal blank. For example, one or more the smart susceptors can be positioned a) on the inner surface of the cavity or shell section, b) at least partially in the cavity or shell section, and/or c) positioned in the die member and spaced from the cavity or shell section. In addition, one or more smart susceptors can be activated and/or deactivated at different times or the same times to once again achieve a desired tailored heating profile of the metal blank during the formation of the metal blank in the die member.

In a further and/or alternative aspect of the present invention, a quick disconnect system is used for transferring electrical current from the top portion of the die member to a bottom portion of the die member to achieve the desired heating profile of the die during the forming process. Such a quick connect mechanism can be by a guillotine connecting mechanism. The use of a quick disconnect system allows the use of a more efficient encircling solenoid type induction coil configuration along with the ability to have a split opening type die to allow for part entry and exit. This concept allows for a high current density, individual electrical disconnect/connect capability for each coil with a unique contact wiping action. This arrangement also allows for a reasonably large daylight opening of the upper and lower half of the die members of the system for inserting and/or removing a metal blank. In addition, the cooling requirements of the induction coils can be handled independently for each half of the die member when using this quick disconnect switching system for the coil assembly.

In still a further and/or alternative aspect of the present invention, the metal blank can be continuously expanded or expanded in a plurality of steps. Typically the expanding of the metal blank in the cavity or die section generally takes less than about 30 minutes and typically less than about 15 minutes. In one embodiment of the invention, the metal blank can be continuously expanded in the cavity or die sections by heating the metal blank and inserting fluid into the metal blank until the metal blank substantially conforms to the shape of region formed by the cavity or die sections. Metal blanks that are formed of lower metal point materials (e.g. manganese, aluminum, etc.) are typically formed a continuous forming process. Higher metaling pont metals such as steel can also be continuously formed in the cavity or shell sections. In another and/or alternative embodiment of the invention, the expansion of the metal blank in the cavity or die sections can occur in a plurality of heating and/or pressure steps. Any metal used to form the metal blank can be formed by in a plurality of heating and/or pressure steps. The multiple heating and/or pressure steps can occur in a single set of cavity or die sections, or in a plurality of sets of cavity or die sections. When a plurality of sets of cavity or die sections are used, the metal blank is substantially fully expanded in a first set of cavity or die sections, and then the expanded metal blank is transferred to another set of cavity or die sections to be substantially fully expanded in this other set of cavity or die sections. This process can be continued until the metal blank has been expanded into its final expansion shape. As can be appreciated, in the expansion of the metal blank in one or more of the sets of cavity or die sections, multiple heating and/or pressure steps can occur. In one aspect of this embodiment, the metal blank is heated and pressured by a fluid until the metal blank partially deforms in the cavity or die sections. Thereafter, the metal blank is depressurized and cooled for a select period and then reheated and repressurized to continue the deformation of the metal blank in the cavity or die sections. This heating/cooling and pressurized/depressurize process can be conducted once or a plurality of times until the metal blank fully conforms to the region formed by the cavity or die sections. In another and/or alternative aspect of this embodiment, the metal blank is heated and pressured by a fluid until the metal blank partially deforms in the cavity or die sections. Thereafter, the metal blank is depressurized for a select period and then repressurized to continue the deformation of the metal blank in the cavity or die sections. This pressurized/depressurize process can be conducted once or a plurality of times until the metal blank fully conforms to the region formed by the cavity or die sections. In still another and/or alternative aspect of this embodiment, the metal blank is heated and pressured by a fluid until the metal blank partially deforms in the cavity or die sections. Thereafter, the metal blank is cooled for a select period and then repressurized to continue the deformation of the metal blank in the cavity or die sections. This heating/cooling process can be conducted once or a plurality of times until the metal blank fully conforms to the region formed by the cavity or die sections.

In yet a further and/or alternative aspect of the present invention, the cavity or shell form can be formed by a plurality of sets of cavity or die sections. For certain structural components, the longitudinal length of the structural component may be significant. As a result, the cavity or shell used to expand a metal blank to form the long structural component may be divided in longitudinal subdivisions thereby resulting in a modular design for the cavity or shell. This modular concept can be used when a material used to make a particular cavity or shell section may not perform well when having a large length. As such, by dividing the length of the cavity or shell into multiple subdivisions, the material forming the cavity or shell section can be successfully used. The modular design can also be used to allow mixing and matching of cavity or shell subdivisions for form a desired cavity or shell having a certain shape or configuration.

In still yet a further and/or alternative aspect of the present invention, the hot metal gas forming (HMGF) process of the present invention includes a) the use of a metal material such as, but not limited to, steel tube cut to length and pre-bent, if required, into a metal blank using conventional metal bending techniques, b) preheating the metal blank, is desired, using in-position electrical heating such as, but not limited to, induction heating, c) inserting the metal blank into a die and heating the metal blank to a forming temperature (e.g. 1600–2000° F.) by use of induction coils positioned in the die, d) sealing the ends of the metal blank and injecting a gas, that may or may not be preheated, into the metal blank at a relatively low pressure (e.g. 500–1500 psi) to cause the metal blank to expand in the cavity or shell of the die to form a structural component, and e) cooling or quenching the formed structural component at a desired rate to obtain the desired microstructure of the metal of the structural component so as to obtain the desired mechanical properties, weldability properties, and size control of the formed structural component. During the heating of the metal blank, different heating zones can be used to tailor the heating of the metal blank during the forming process. In addition, during the cooling or quenching of the metal blank, different cooling rates can be used to tailor the cooling or quenching of the metal blank during the cooling process. By placing induction coils in close proximity to the metal blank during the forming process, a small gap is formed between the induction coils and the metal blank resulting in a smaller induction loop having reduced induction heating losses. By using the method of forming a metal blank of the present invention, several advantages are obtainable over past hydroforming and stamping processes such as, but not limited to, a) induction heating can be used to rapidly heat the metal blank and increase the formability of the metal blank without adversely affecting the microstructure of the metal blank, b) high formability rates of the metal blank can be obtained, c) lower production costs of the formed metal blank, d) lower tooling costs for forming the metal blank, d) tailored heating of the metal blank, e) tailored cooling or quenching of the metal blank, f) formation of complex shapes of the formed metal blank with high precision, g) integration of rapid part heating into the die member to reduce cycle time, h) use of a wider range of metal materials to be formed, i) increased tool life, and j) use of microprocessor-based smart sensors to monitor and/or control the heating and/or cooling of the metal blank.

The primary object of the present invention is the provision of a method of forming a metal blank into a structural component, with the desired outer shape, which apparatus and/or method controls the heating by controlled heating and/or controlled cooling or quenching.

Another object of the present invention is the provision of a method and/or apparatus, as defined above, which method overcomes the disadvantages of hydroforming such as limited shapes, low die life and high equipment costs.

Still another and/or alternative object of the present invention is the provision of a method and/or apparatus, as defined above, which apparatus and/or method improves the material formability of a metal blank, improves the strength and toughness of the formed metal blank, and has improved dimensional precision of the formed metal blank.

Yet another and/or alternative object of the present invention is the provision of a method and/or apparatus, as defined above, which apparatus and/or method controls the metallurgical characteristics of the formed metal blank by controlled heating and/or controlled cooling or quenching.

Still yet another and/or alternative object of the present invention is the provision of a method and/or apparatus, as defined above, which apparatus and/or method has reduced the tooling cost, reduced process cycle time and/or increased design flexibility.

A further and/or alternative object of the present invention is the provision of a method and/or apparatus, as defined above, which apparatus and/or method enables product that include the formed blanks to have a reduced weight due to the use of a tailored formed blank that has higher yield strengths and which is tailored to a particular application.

Still a further and/or alternative object of the present invention is the provision of a method and/or apparatus, as defined above, which apparatus and/or method allows size or shape changes substantially over 10% of the original cross-sectional shape without requiring secondary operations or material annealing operations between processing.

Yet a further and/or alternative object of the present invention is the provision of a die set for practicing the method as defined above, which die set includes cavity or shell sections formed from one type of material and supported in the die by a material having different properties than cavity or shell sections.

Still yet a further and/or alternative object of the present invention is the provision of a die set for practicing the method as defined above, which die set includes cavity or shell sections formed from a hard and rigid material and supported in the die by a material having high compressive force characteristics.

Another and/or alternative object of the present invention is the provision of a die set for practicing the method as defined above, which die set includes cavity or shell sections formed from a hard and rigid material having a high material cost and supported in the die by a material having different properties than cavity or shell sections which has a lower material cost to thereby reduce the cost of the die.

Still another and/or alternative object of the present invention is the provision of a die set for practicing the method as defined above, which die set includes cavity or shell sections that are cast and supported in the die by a material having different properties than cavity or shell sections.

Yet another and/or alternative object of the present invention is the provision of a die set for practicing the method as defined above, which die set includes cavity or shell sections that are removably secured and supported in material having different properties than cavity or shell sections.

Still yet another and/or alternative object of the present invention is the provision of a die set for practicing the method as defined above, which die set includes cavity or shell sections that are removably secured and supported in material that has been machined and/or molded.

A further and/or alternative object of the present invention is the provision of a method and/or apparatus, as defined above, which apparatus and/or method involves expanding a metal blank by heating the metal blank and then cooling or quenching the metal blank.

Still a further and/or alternative object of the present invention is the provision of a method and/or apparatus, as defined above, which apparatus and/or method involves expanding a metal blank by inductively heating the metal blank by controlled heating cycles.

Yet a further and/or alternative object of the present invention is the provision of a method and/or apparatus, as defined above, which apparatus and/or method involves expanding a metal blank by heating the metal blank and then selectively cooling or quenching the metal blank.

Still yet a further and/or alternative object of the present invention is the provision of a method and/or apparatus, as defined above, which apparatus and/or method involves expanding a metal blank by inductively heating the metal blank by controlled heating cycles, and then selectively cooling or quenching the metal blank to control the metallurgical properties of the finished product using rapid cooling or quenching, arrested cooling or combinations thereof.

Another and/or alternative object of the present invention is the provision of an apparatus and/or method, as defined above, which apparatus and/or method includes the use of a cavity or shell section in a die which provides improved wear resistance properties to the die, helps the die to withstand elevated temperatures, and/or facilitates in reducing thermal shock to the die.

Still another and/or alternative object of the present invention is the provision of an apparatus and/or method, as defined above, which apparatus and/or method includes the use of flux concentrators in the die so as to provide better tailored heating profiles of the metal blank and/or to reduce thermal shock to the die.

Yet another and/or alternative object of the present invention is the provision of an apparatus and/or method, as defined above, which apparatus and/or method includes the insulation of one more induction coils within the die to better tailor the heating profile of a metal blank within the die and/or to reduce thermal shock to the die.

Still yet another and/or alternative object of the present invention is the provision of an apparatus and/or method, as defined above, which apparatus and/or method involves the preheating of the metal blank prior to the forming of the metal blank within the die to thereby shorten the heating times of the metal blank during the forming process and/or to reduce the forming times of the metal blank within the die. The preheating of the metal blank may also avoid heat hardening of the blank at one or more weld zones in the metal blank, and/or improve the grain profile of the metal blank during the forming process.

A further and/or alternative object of the present invention is the provision of an apparatus and/or method, as defined above, which apparatus and/or method preheats the die prior to and/or while a metal blank is positioned in the die.

Still a further and/or alternative object of the present invention is the provision of an apparatus and/or method, as defined above, which apparatus and/or method preheats a fluid to be inserted into the metal blank.

Yet a further and/or alternative object of the present invention is the provision of an apparatus and/or method, as defined above, which apparatus and/or method uses a coolant having a higher boiling point temperature than water to cool one or more induction heating coils, which in turn can reduce thermal shock to the die and/or allow the die to be heated to higher temperatures.

Still yet a further and/or alternative object of the present invention is the provision of an apparatus and/or method, as defined above, which apparatus and/or method involves the use of a current carrying material in the cavity or shell sections of the die, which current carrying material allows for tailored heating profiles of the metal blank in the die, reduces thermal shock to the die, increased strength and/or rigidity of the die, and/or allows the die to obtain elevated temperatures during the forming of the metal blank within the die.

Another and/or alternative object of the present invention is the provision of an apparatus and/or method, as defined above, which apparatus and/or method includes the use of mechanical stimulation of the metal blank within the die so as to enhance the formation of the metal blank within the die.

Still another and/or alternative object of the present invention is the provision of an apparatus and/or method, as defined above, which apparatus and/or method involves the use of tailored blanks which are formed within the die. These tailored blanks can include various materials, various thicknesses, various shapes, internal stiffening members, various fluid access points, various fluid inlet profile points, various welding profiles, and/or the like so as to form a desired shaped metal blank within the die.

Yet another and/or alternative object of the present invention is the provision of an apparatus and/or method, as defined above, which apparatus and/or method produces a specific temperature profile for a metal blank so as to create the proper formability plasticity of the metal blank.

Still yet another and/or alternative object of the present invention is the provision of an apparatus and/or method, as defined above, which apparatus and/or method incorporates the use of rapid heating to increase the formability of the metal blank without adversely affecting the microstructure of the metal blank.

A further and/or alternative object of the present invention is the provision of an apparatus and/or method, as defined above, which apparatus and/or method that incorporates the use of moderate forming pressures to allow for the use of lower cost tooling and forming equipment.

Still a further and/or alternative object of the present invention is the provision of an apparatus and/or method, as defined above, which apparatus and/or method that incorporates the integration of rapid heating of a metal blank in th die to reduce cycle times.

Yet a further and/or alternative object of the present invention is the provision of an apparatus and/or method, as defined above, which apparatus and/or method that incorporates in-line integration of post-heat treatment of the metal blank by quench hardening to produce formed structural components having locally tailored yield strengths.

Still yet a further and/or alternative object of the present invention is the provision of an apparatus and/or method, as defined above, which apparatus and/or method involves the use of capacitor shunts so as to achieve a tailored heating profile of the metal blank within the die and/or reduce thermal shock to the die during the formation of the metal blank.

Another and/or alternative object of the present invention is the provision of an apparatus and/or method, as defined above, which apparatus and/or method involves the use of electrically conductive materials within the body of the die (i.e. iron, copper, aluminum oxide) and/or electrically conducted polymer materials. The use of such materials can be used to tailor the heating profiles of the die during the forming process, reduce the thermal shock to the die, and/or strengthen the die.

Still another and/or alternative object of the present invention is the provision of an apparatus and/or method, as defined above, which apparatus and/or method involves the use of end sealing the metal blank during and/or prior to the forming of the metal blank so as to achieve desired shape profile of the metal blank and/or to reduce thinning of the metal blank during the forming process.

Yet another and/or alternative object of the present invention is the provision of an apparatus and/or method, as defined above, which apparatus and/or method involves the use of one or more smart susceptors in the die to obtain a desired heating profile of the die during the forming process and/or to reduce thermal shock to the die during the forming process.

Still yet another and/or alternative object of the present invention is the provision of an apparatus and/or method, as defined above, which apparatus and/or method involves the use of a quick disconnect system to facilitate in easily and controllably coupling the induction heating and/or cooling system of the die while allowing ease of insertion and removal of the metal blank within the die.

A further and/or alternative object of the present invention is the provision of an apparatus and/or method, as defined above, which apparatus and/or method involves the use of a durable cavity or shell section on one or more surfaces of the die to enhance the strength and durability of the die, create tailored heating profiles of the die during the forming process, and/or reduced thermal shock of the die during the forming process. The cavity or shell sections can be formed of metal laminates and/or composite matrixes and/or other types of materials. The cavity or shell sections can have various thicknesses, various electrical conducting properties, and/or various strengths to obtain the desired physical and structural properties of the surface of the die for proper forming of a metal blank within the die.

Still a further and/or alternative object of the present invention is the provision of an apparatus and/or method, as defined above, which apparatus and/or method is able to form a variety of materials. Such materials can include, stainless steel, carbon steel, aluminum, aluminum alloys, magnesium, magnesium alloys, copper, copper alloys, nickel, nickel alloys, stainless steel, titanium, titanium alloys, metal alloys that include electrically conductive materials (e.g., Al—Fe, etc.) and any other material that can be heated and/or formed by a hot metal gas forming process.

Yet a further and/or alternative object of the present invention is the provision of an apparatus and/or method, as defined above, which apparatus and/or method includes the use of one or more induction heating coils within the die which induction heating coils have a uniform or varied space location from the surface of the die surface, so as to provide desired heating profiles to the metal blank and/or to reduce thermal shock to the die during the forming process.

Still yet a further and/or alternative object of the present invention is the provision of an apparatus and/or method, as defined above, which apparatus and/or method includes a die member that is divided longitudinally in a plurality of subdivisions to form a a modular designed die.

These and other objects and advantages will become apparent from the following description taken together with the accompanying drawing.

BRIEF DESCRIPTION OF DRAWINGS

Reference may now be made to the drawings, which illustrate various embodiments that the invention may take in physical form and in certain parts and arrangements of parts wherein;

FIG. 27 is a cross sectional view showing two induction heating coils around the forming cavity or shell with the coils separated to provide distinct induction heating cycles during the forming of the shaped blank;

FIGS. 28A and 28B are views similar to FIG. 27 illustrating operating characteristics of the selectively controlled induction heating during the forming of the shaped blank;

PREFERRED EMBODIMENTS OF THE INVENTION

Figure 1:
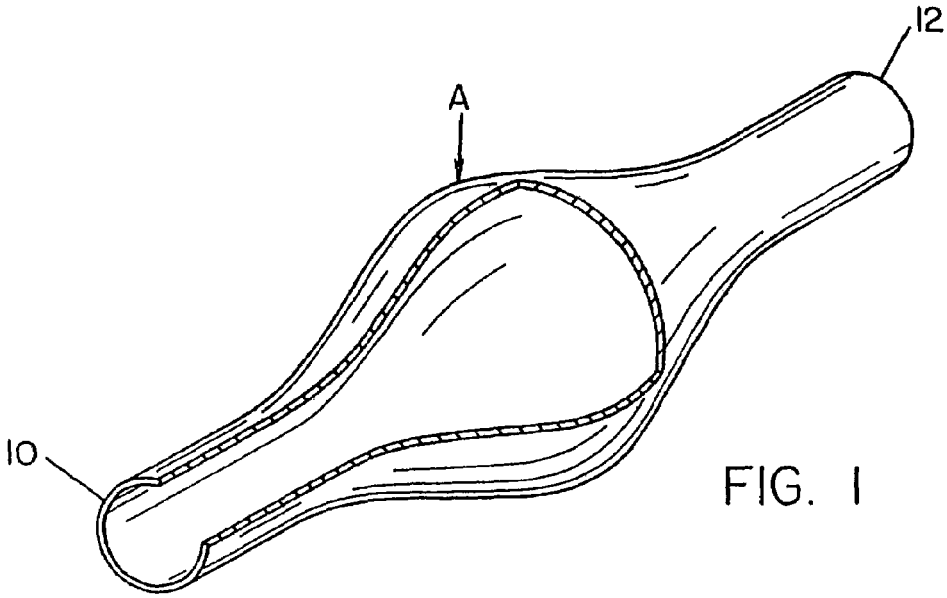
FIG. 1 is a pictorial view of a representative tubular structural component formed by use of the present invention.

Referring now to the drawings wherein the showings are for the purpose of illustrating the preferred embodiments only and not for the purpose of limiting same, FIG. 1 illustrates a finished tubular structural component A formed by using the preferred embodiment of the present invention as schematically illustrated as machine 20 in FIGS. 2–6.

Structural component A is illustrated as a quite simple shape for ease of discussion. Other more complex shapes of the structural component are illustrated in FIGS. 7–9, 39A, 39B, and 40–43B. As can be appreciated, many other shapes of the structural component can be formed in accordance with the present invention. For purposes of illustrating the present invention, the disclosure associated with the simple shape of component A applies to all shapes. Structural component A is typically made of a metal material such as, but not limited to, carbon steel, stainless steel, aluminum, magnesium and the like. As will be described in more detail below, the structural component can be made of one or more materials.

Figure 2:
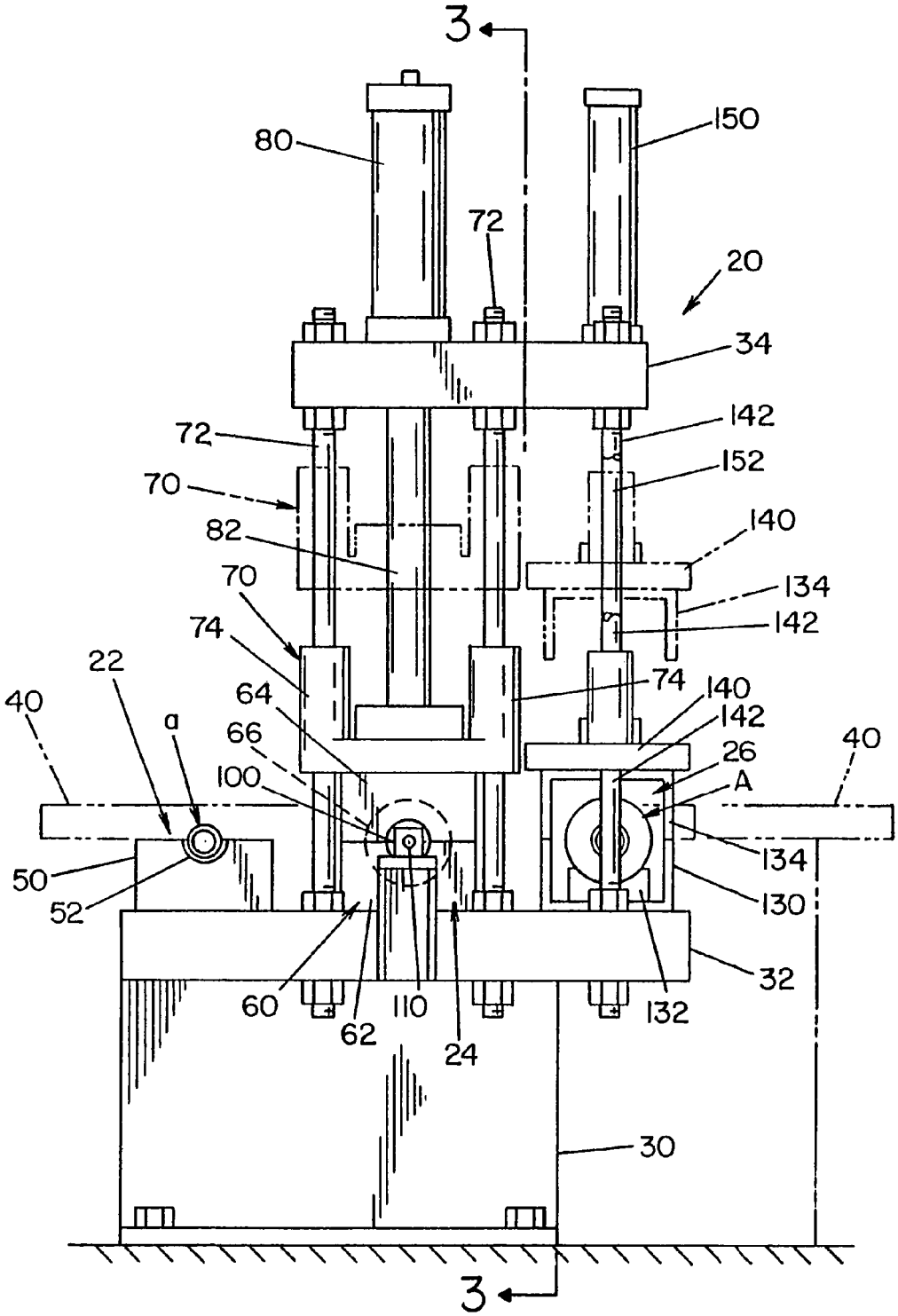
FIG. 2 is a side elevational view showing a machine for practicing the present invention.

Referring now to FIGS. 2–6, machine 20 includes an inlet station 22 for preprocessing a metal blank a which will be described later. Metal blank a is referred to herein as a metal tube or other metal structure that is to be formed by the hot metal gas forming process of the present invention. Structural component A is referred to herein as the formed metal blank. The preforming operation can involve bending the shaped blank axially into a preselected general contour or profile. The preforming of the metal blank is typically performed by standard bending techniques (e.g., hydraulic presses, etc.). The preprocessing of the metal blank can also involve preheating the metal blank. When the metal blank is preheated, the preheating is typically conducted by the use of resistance heating; however, other or additional types of heating can be used to preheat the metal blank. When the metal blank is preheated, typically the total metal blank is preheated; however, it can be appreciate that one or more portions of the metal blank can only be preheated. The preforming and/or preheating of the metal blank can occur at input station 22. When resistance preheating is preformed on the metal blank at input station 22, the resistance heating of the metal blank preparatory to forming by hot gas in accordance with the invention is typically performed by directing an alternating current through the metal blank. Resistance preheat can be direct 60 cycle heating; however, other cycle heating can be used. The induction resistance heating can be used to change the thermal profile of the metal blank during the preheat step. For illustration purposes, FIG. 2 illustrates metal blank a in station 22, which station can be considered merely a loading station when preforming and/or preheating is not used. As a result, input station 22 is used for preforming, preheating or merely loading of the metal blank. The preforming operation and/or the preheating operation reduces the amount of time and energy needed to form metal blank into structural component A at the processing station 24. The preforming and/or preheating of the metal blank is an optional step for forming the metal blank in accordance with the present invention.

Processing station 24 performs the essence of the invention wherein a metal blank a is heated while a high pressure is directed into the metal blank to expand the metal blank into a cavity or shell. Typically the metal blank is heated by a plurality of coils or conductors spaced along metal blank a at station 24 while a high pressure gas, such as air, nitrogen, argon or the like, is directed into the metal blank. As can be appreciated, additional or alternative heating techniques can be used to heat the metal blank. As can also be appreciated, other or additional types of gas can be use to expand the metal blank. During the heating of the metal blank, a coiling fluid is typically runs through the coils to cool the coils to inhibit or prevent damage to the coils. Various types of coolants can be used. Typically a coolant having boiling point that is higher than water is used; however, water can be used to cool induction heating coils. When a cooling fluid that has a higher boiling point than water is used, the die can be operated at higher temperatures. Additionally, the use of a cooling fluid that has a higher boiling point than water can reduce the thermal shock to the die during the formation of one or more metal blanks. Many different types of high boiling point coolants can be used (e.g., Dynatherm, etc.). After metal blank a has been heated and formed by gas into the desired structural configuration shown in FIG. 1, the formed structural component A is transferred into cooling or quench station 26 where a cooling or quench liquid and/or gas is directed toward the outer surface of the heated and formed structural component to cool the component at a rate determining the necessary metallurgical properties of the finished product. In summary, the invention is the expansion of a metal blank a into the desired shape shown in FIG. 1 by heating the metal blank along its length while expanding the metal blank into a predetermined shape determined by a die cavity or shell with a gas and then moving the hot formed structural component into a cooling or quenching station where a cooling or quenching operation creates the desired metallurgical physical properties of the formed structural component. When the formed structural component is cooled by rapid cooling or quenching, a hardened structural component is maintained and/or created. Slow cooling or quenching by liquid or gas could be used to process or temper one or more portions of the structural component along the length of the finished structural component A. Consequently, by heating and selectively cooling or quenching the hot metal gas formed structural component, the shape of the structural component is obtained at the same time metallurgical properties along the length of the structural component are obtained. This is a novel and heretofore unobtainable result for a metal structural component.

The metal blank, when formed of steel, generally has a wall thickness of about 0.40–0.35 inches, and typically less than about 0.20 inches. As can be appreciated other thicknesses can be used. As can further be appreciated, one portion of the structural component can have a thickness and/or type of metal that is different from another portion of the structural component. The steel used to form the metal blank is generally a single or dual phase high strength steel. When aluminum is used for the metal blank, 5083 aluminum and several other 5000 series aluminum alloys are generally used with a wall thickness of 0.1–0.3 inch. As can be appreciated other thicknesses and/or other types of aluminum can be used. As can further be appreciated, one portion of the structural component can have a thickness and/or different type of metal that is different from another portion of the structural component.

Although a number of machines and mechanical components can be used to practice the present invention, one embodiment of the invention involves a multi-station machine 20 shown in FIGS. 2–6 having the loading or preprocessing station 22, a hot metal gas forming station 24 and the cooling or quench station 26. In the illustrated machine 20, there is a lower support frame 30 having an upper fixed table 32 overlaid by an upper fixed head 34. Transfer mechanism 40, shown in phantom lines, is a walking beam type of transfer mechanism for shifting the metal blank a into station 22 for moving the metal blank to station 24 where the metal blank is hot metal gas formed in accordance with the invention and for then moving the formed structural element A to cooling or quench station 26 where the heated and formed structural component is cooled or quenched along its length by liquid and/or gas cooling or quenching.

Referring now to initial or loading station 22, a generally rectangular holder 50 has a nest 52 for receiving the metal blank a. As can be appreciated, holder 50 can have other shapes. The optional preforming and/or preheating can occur at loading station 22. From loading station 22, metal blank a is moved to the hot metal gas forming station which includes a die set 60 having a lower die member 62 and an upper die member 64 which are brought together to form a cavity or shell 66 defining the desired outer configuration of structural component A after it has been processed in accordance with the present invention. Lower die member 62 is supported on fixed table 32, whereas the upper die member is carried by a platen 70 movable on rods or posts 72 by four spaced bearing housings 74 between a closed lower position shown in the solid lines of FIG. 2 and an upper open position shown by the phantom lines in FIG. 2. Post 72 not only reciprocally mounts the upper die member 4, but also fix machine head 34 with respect to the lower fixed machine table 32. Movement of die member 64 is accomplished by cylinder 80 fixed on head 34 and joined to platen 70 by rod 82. Movement of rod 82 by cylinder 80 raises and lowers die member 64 to open and close the die member 60 for loading and unloading station 24. As can be appreciated, the lower die member 62 and an upper die member 64 can be mounted in a variety of other ways. It can also be appreciated, that die member can be mounted such that the upper die member 64 remains fixed and the lower die member is moved upwardly to engage the upper die member to form the cavity or shell. Alternatively, it can be appreciated, that die member can be mounted such that the upper die member and lower die members are both movable so as to engage one another.

Figure 4:
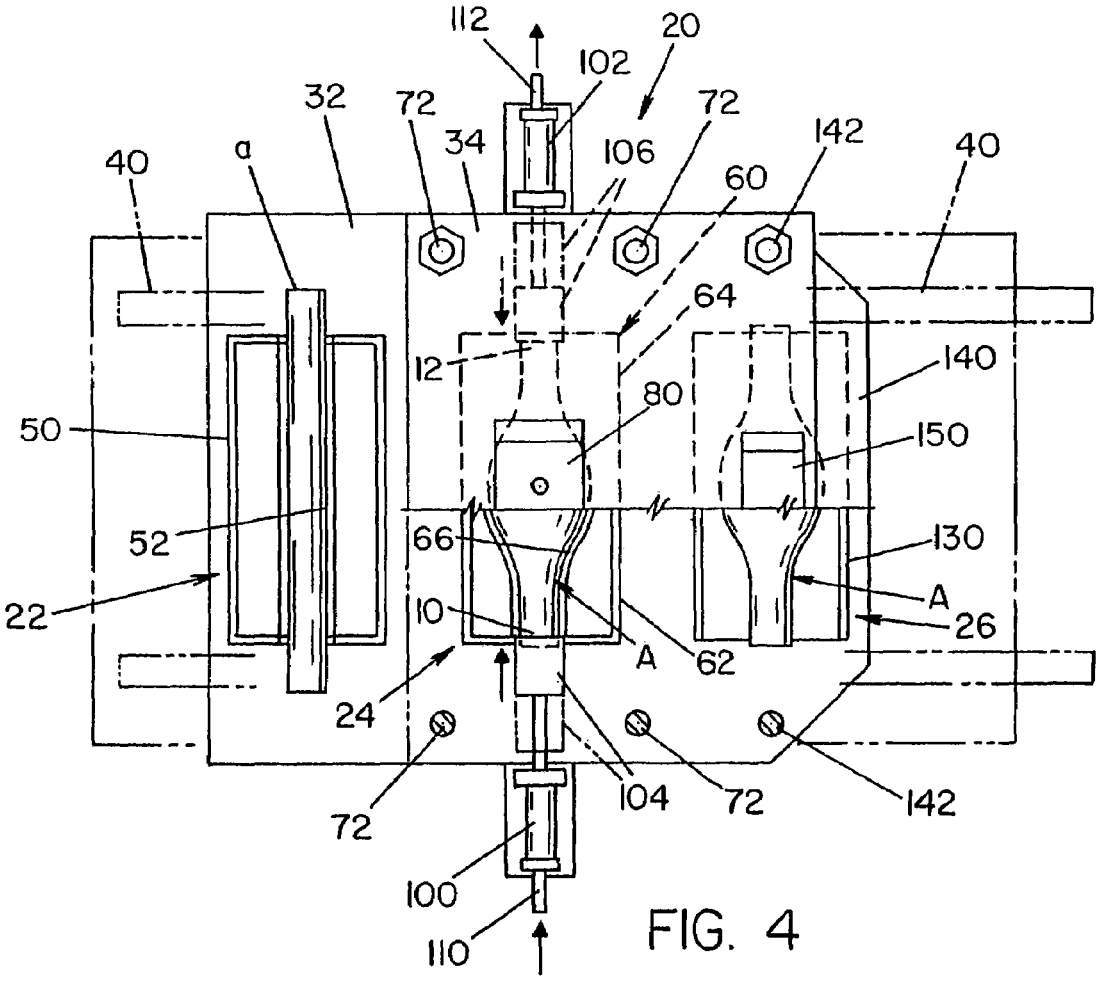
FIG. 4 is a top view of a machine illustrated in FIG. 2.
Figure 3:
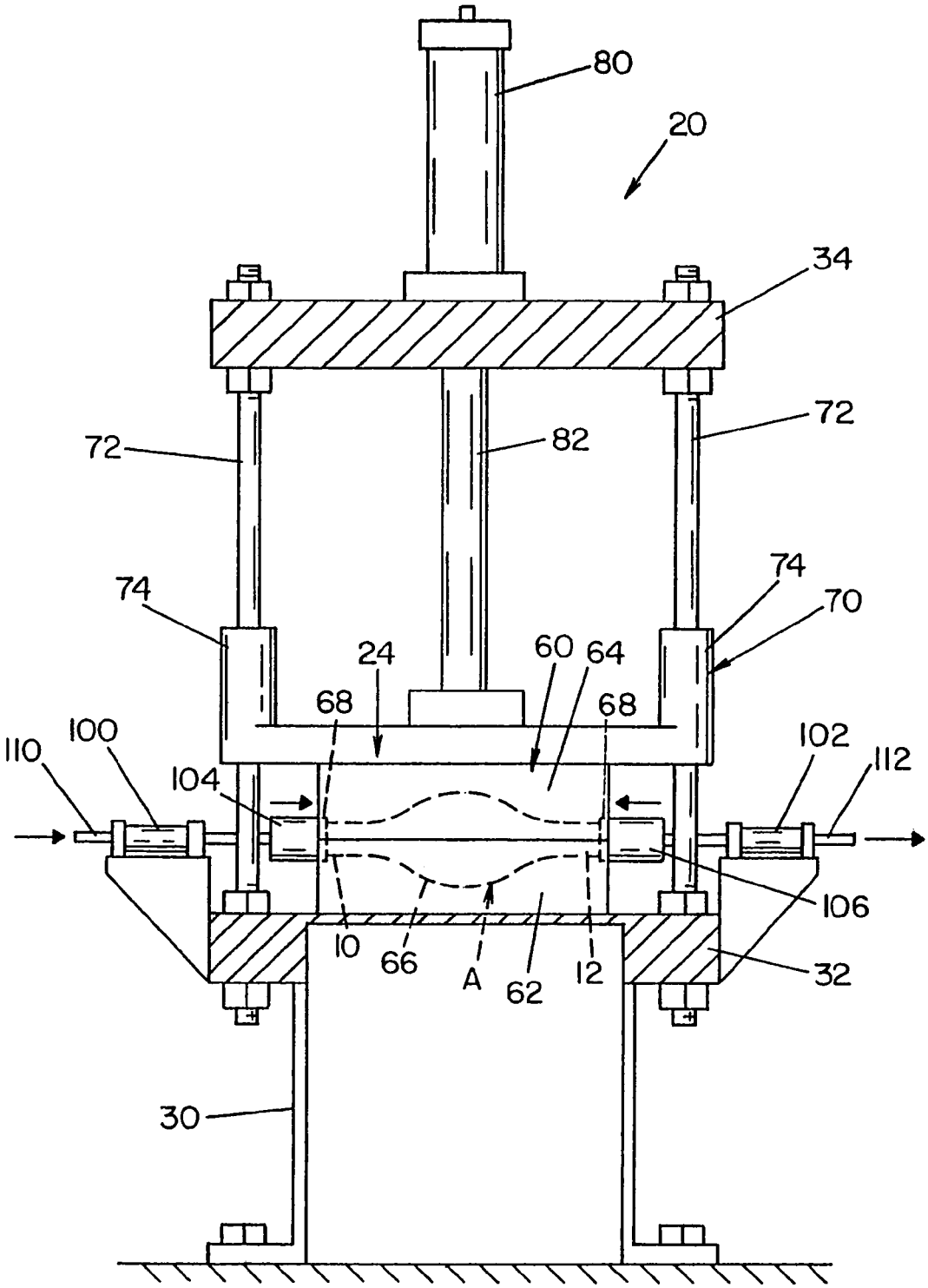
FIG. 3 is a cross sectional view taken generally along line 3—3 of FIG. 2.

As will be described later, one or both die members include a number of axially spaced heaters to heat the metal of metal blank a. One type of heating arrangement that can be used, which will later be described in more detail, is heating by the use of induction heating conductors or coils partially or fully embedded within the die members to heat metal blank. The temperature that the metal blank is heated can be varied along the length of the metal blank. Such heating can be done by induction heating which raises the temperature of the metal blank by inducing voltage differentials using an alternating current in the coils or conductors at least partially surrounding the metal blank during the forming operation. In one particular design, collets 104, 106 surround ends 10, 12 which extend outwardly from holes 68 in die set 60 as best shown in FIGS. 3 and 4. These collets are forced inwardly by feed cylinders 100, 102, respectively, so that metal is fed into the cavity or shell 66 during the hot metal gas forming process in a manner similar to such in-feed of metal during hydroforming of steel. A gas (e.g., air, inert gas, nitrogen, argon, etc.), at sufficiently high pressure is forced into the heated metal blank to expand the metal blank into cavity or shell 66. For instance, when using a carbon steel metal blank, the metal blank is heated to a temperature of about 1800° F. and subjected to gas pressure of about 200–1000 psi. This forming process normally takes less than a minute, typically less than about 20 seconds and more typically about 10 seconds. The speed of forming the metal blank can be controlled by controlling the heating temperature of the metal blank and the gas pressure in the metal blank during the forming of the metal blank.

In practice, the hydraulic pressure from cylinder 80 exerts a compressive force between die members 62, 64 which is about 50–150 tons; however, other pressure can be used. With this high holding force on die set 60, the hot metal gas forming process does not separate die members 62, 64 during the forming operation. When the hot metal has been formed in station 24, cylinder 80 moves upper die member 64 by moving platen 70 upward. After the die has been opened, the formed structural element A is moved by transfer mechanism 40 from station 24 to station 26 best shown in FIGS. 2 and 4.

Lower support base 130 has upstanding cooling or quench stands 132 contoured to support and direct cooling or quenching fluid against the outer surface of structural component A resting on stands 132. A spray controlling cover 134 is carried on platen 140 movable on post 142 by cylinder 150 on head or crown 34 that actuates reciprocal rod 152. In FIG. 2, cover 134 is shown in its operative position. After the hot metal gas formed structural component A is moved to station 26, cover 134 is lowered to the solid line position and fluid in the form of cooling or quenching liquid and/or a cooling or quenching gas is used along the length of component A to selectively cool or quench the various portions of the structural component. The desired mechanical and metallurgical properties are created along the length of the final structural component. This subsequent cooling or quenching is useful for controlling the characteristics along the length of the finished structural component after it has been hot metal gas formed in station 24. Although transfer element 40 can mechanically transfer metal blank a and finished structural component A between stations 22, 24 and 26, in practice, the transfer can be accomplished manually. Machine 20 is only one of many mechanical arrangements that can be used for performing the present invention.

Figure 5:
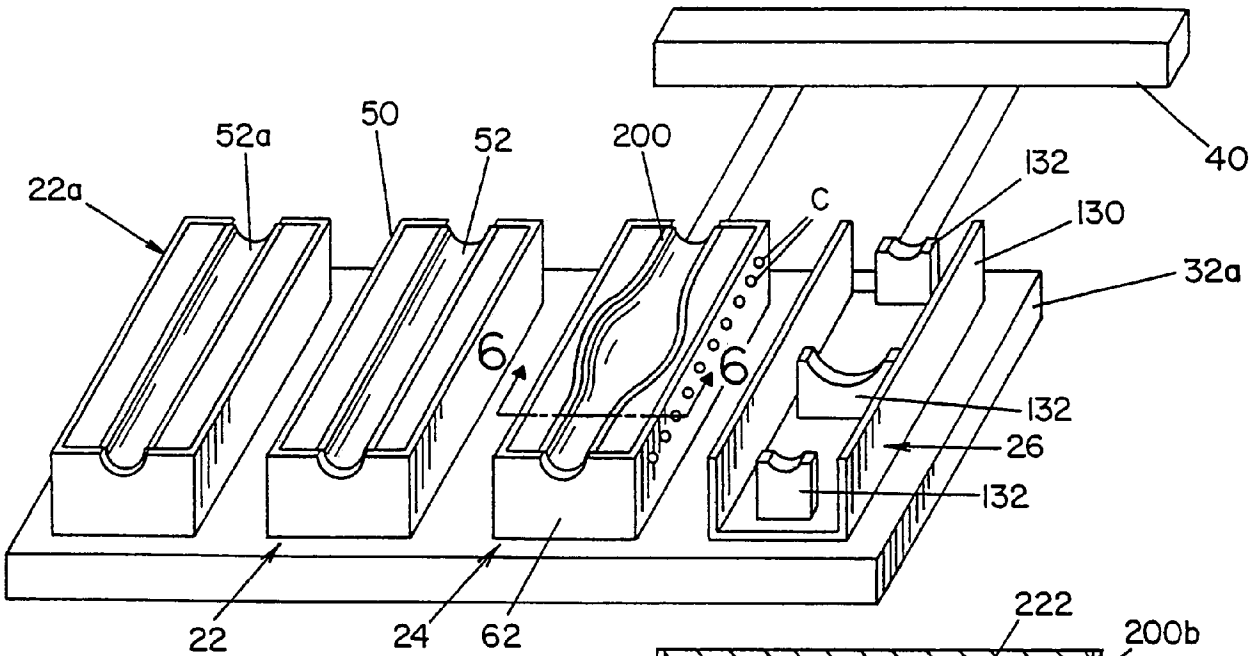
FIG. 5 is a pictorial view of a multi-station platform for processing the metal blank shown in FIG. 1 by using the present invention with an additional processing step.

A modification of machine 20 is illustrated in FIG. 5 wherein four stations are employed on platform or table 32*a*. In this modification, a preformed station 22*a* is provided with a nest 52*a*. Nest 52*a* is used for resistance heating. At station 24, the shape defining cavity or shell 200 of the lower die member 62 is illustrated along with induction heating coils or conductors C. In using this modified machine, metal blank a is placed in nest 52*a* and shaped into the desired profile. Thereafter, walking beam transfer mechanism 40 shifts the metal blank to nest 52*a* where the metal blank is subjected to preheating (e.g., resistance heating using A.C. current), if such heating is desired. The metal blank is then transferred to cavity or shell 200 of die member 62. The upper die member is then closed and the metal blank is hot metal gas formed. The hot formed structural component is then moved to station 26 and cooled or quenched as previously described.

Figure 6:
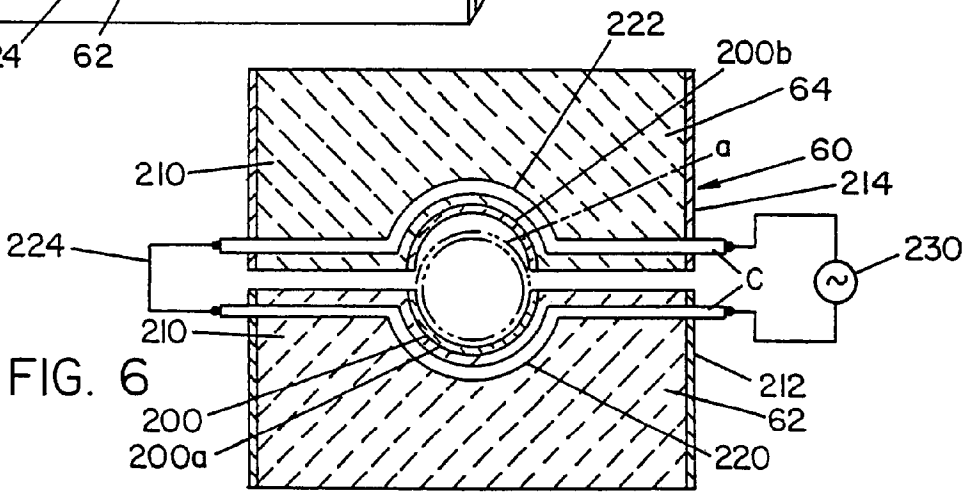
FIG. 6 is a cross sectional view taken generally along line 6—6 of FIG. 5.
Figure 7:
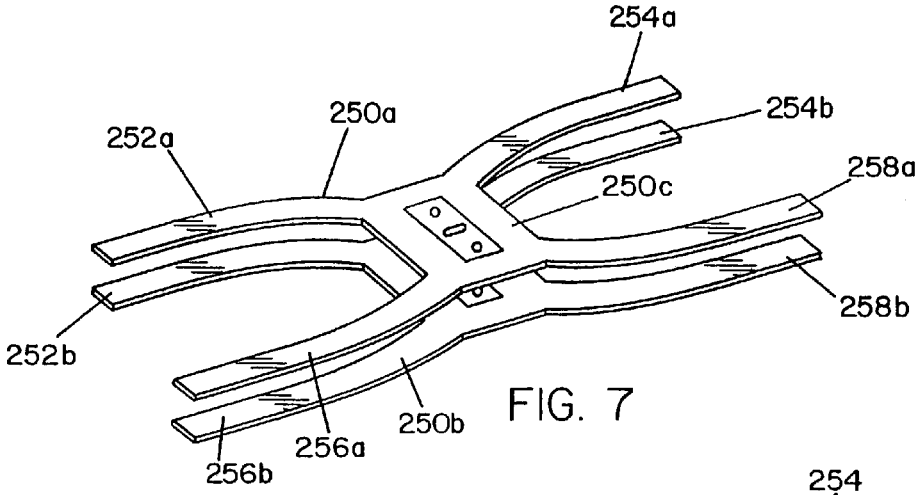
FIG. 7 is a pictorial view of sheet metal portions for making a complex H-shaped shaped blank to be formed by the method of the present invention.
Figure 8:
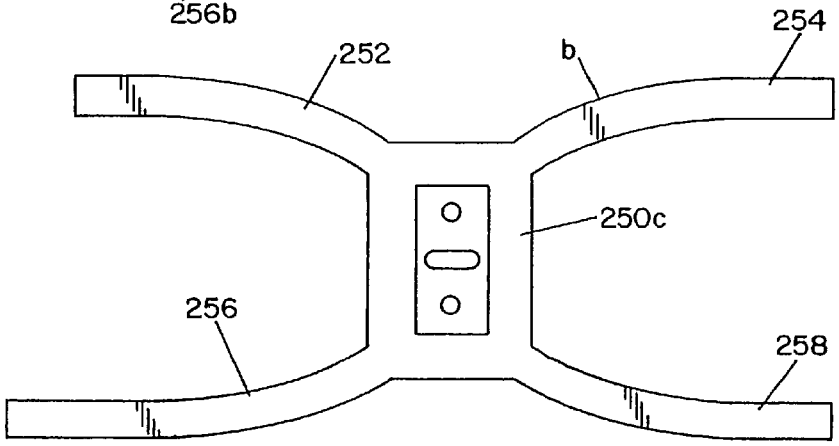
FIG. 8 is a top plan view of the shaped blank using the plates of FIG. 7 after the edges have been welded, but before the blank is trimmed.

Details of die set 60 are illustrated in FIG. 6 wherein die set 62, 64 include an inner cavity or shell 200 having half cavity or shell section 200*a*, 200*b*, respectively. The cavity or shell sections are formed from material having a high hardness. Typically the cavity or shell sections are formed from material having low permeability and high rigidity. Many types of materials can be used to form the cavity or shell sections. In practice, the cavity or shell section cab be formed of monolithic oxide (e.g., fused silica, alumina, mullite, zirconia, beryllium oxide, boron oxide, etc.), monolithic nitride (e.g., $Si_3N_4$, etc.), monolithic carbide (e.g., SiC, etc.), composite oxides (e.g., silica/alumina, silica/mullite, silica/zirconia, alumina/zirconia, alumina/mullite, and/or mullite/zirconia), and/or a ceramic matrix composites (e.g., silicon carbide, alumino-boro-silicate, polymeric/sol-gel). In one particular design, the cavity or shell sections include silicon nitride and have a wall thickness of about 1/16–1.5 inches. A coating of dense ceramic can be applied to the inner surface of the cavity or shell section by sputtering or chemical vapor deposition. In this particular cavity or shell section design, the cavity or shell section design is formed of non-sintered silicon nitride having a dense ceramic inner layer. Another design of the cavity or shell section includes the use of powdered silica compressed to about 50%–70% and then machined to the desired shape. The machined compressed silica is then vacuum exhausted while nitrogen is impregnated into the cavity or shell section. The material used to form the cavity or shell sections is selected for its wear resistance and maintenance of the desired shape without deterioration over many forming cycles. In prior hydroforming operations, a hard, rigid shell was not used for creating the forming cavity between die member. By using a separate rigid cavity or shell section for the cavity in the die set of the present invention, a less expensive and compressive force resisting fill material 210 can be selected for the body portion of die members 62, 64. Fill material 210 is a compression resistant material. Fill material 210 can also be a nonmagnetic material. The material used to form the fill material 210 is selected for its pressure resistance and its ability to maintain the rigidity of cavity or shell sections 200. In one design, fill material 210 is formed of a ceramic material for its compression resistance characteristics. One type of ceramic material that can be used is a castable ceramic having a strength and a hardness that is less than the rigid ceramic cavity or shell section 200. As can be appreciated, any of a number of castable ceramics, such as fused silica or cement can be used for the support of the rigid, hard cavity or shell sections 200. Another type of fill material that can be used is a strong, heat resistant polymer (e.g., G10, G11 etc.). Die members 62, 64 are held together with a durable framework 212, 214. The framework is typically a metal material such as aluminum or stainless steel; however, other metals can be used. When the fill material is formed of a strong, heat resistant polymer, a separate metal frame work can be eliminated. The framework can be made of a nonmagnetic material. The 50–150 tons of pressure are applied between fill material 210 of die members 62, 64 to holding rigid, hard cavity or shell sections 200 in place during the forming process in station 24.

Fill material 210 supports the number of axially spaced conductors C forming the induction heating mechanism of die set 60. When a cast material is used, the cast material can also encapsulate the axially spaced conductors C. In one design as shown in FIG. 6, conductors C include arcuate portions 220, 222 conforming to the outer configuration of cavity or shell section 200. Conductors or coils C are connected in series, as shown by connector 224 and are powered by an alternating current power source 230 which, in practice, operates at a frequency greater than about 3 kHz and typically greater than about 10 kHz. Axially spaced conductors C are joined by connectors 224 to place them in series with the power supply 230 in accordance with standard induction heating practice. Encircling coils about cavity or shell section 200 are formed by joining upper and lower conductors C as shown in FIG. 6. Various arrangements can be used for connecting the set of conductors C in die member 62 and die member 64. The conductors extend across the dies and are connected in a series circuit with a power supply such as power supply 230. This power supply is typically an inverter. When die set 60 is opened, metal blank a is placed in the cavity defined by cavity or shell sections 200. The die set is then closed to maintain metal blank a in the cavity or shell sections 200 wherein the metal blank is heated inductively along its length and formed by introducing hot gas into the interior of the metal blank. In practice, the conductors for the induction heating of the metal blank are nonmagnetic, high resistivity steel (Inconel) tubes with water cooling. These conductors have greater strength and are better suited modules than copper tubes.

Figure 9:
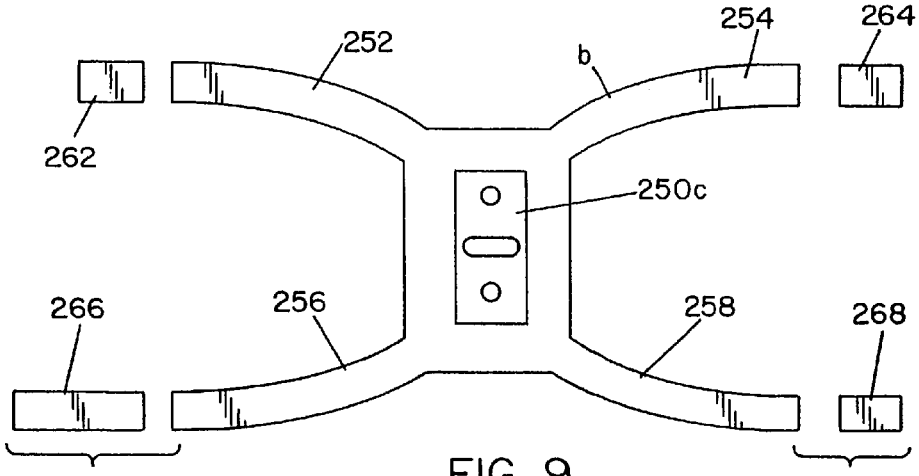
FIG. 9 is a view similar to FIG. 8 with the shaped blank with the four legs trimmed to the desired length.

The present invention can be used for producing a large variety of structural components. To illustrate the versatility of the present invention, an H-shaped structural element B is formed by the method of the present invention. This H-shaped metal blank b is shown in FIGS. 7–12. Two H-shaped steel plates 250*a*, 250*b* with a welded center portion 250*c* are joined together in a manner where legs 252*a*, 254*a*, 256*a*, 258*a* are seam welded to legs 252*b*, 254*b*, 256*b* and 258*b*, respectively, to form shaped blanks identified as legs 252, 254, 256 and 258 in FIG. 8. The outer edges of the plates can be laser welded together as shown at seam W in FIG. 10 or by some other welding techniques. Overlying welded legs 252 and 254 form a single hollow metal blank. In a like manner, seam legs 256, 258 form a single hollow metal blank. These hollow legs are similar to metal blank a shown in FIGS. 2 and 4. Center portion 250*c* is welded together to form a generally flat structural element, but it does not constitute necessarily a portion of the metal blank to be formed. After seam welding legs 252, 254, 256 and 258 to form metal blank b, the legs can be trimmed to the desired length by removing excess portions 262, 264, 266 and 268 by trimming the ends of the respective legs. This trimming action produces a metal blank b, as shown in FIG. 9, which metal blank is in the form of two generally parallel shaped blanks.

Figure 10:
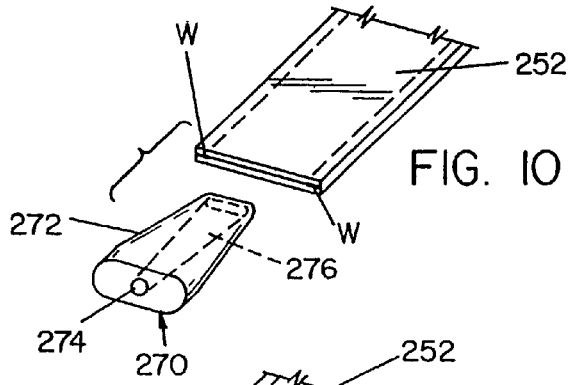
FIGS. 10 and 11 are pictorial views showing the operation of plugging one of the open ends of a leg of the shaped blank shown in FIGS. 8 and 9.
Figure 11:
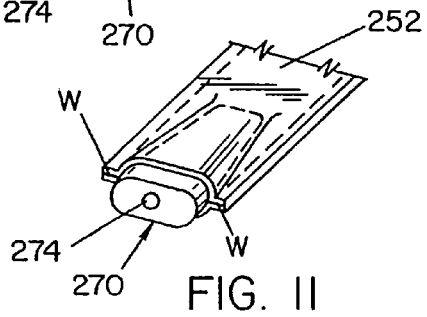
Figure 12:
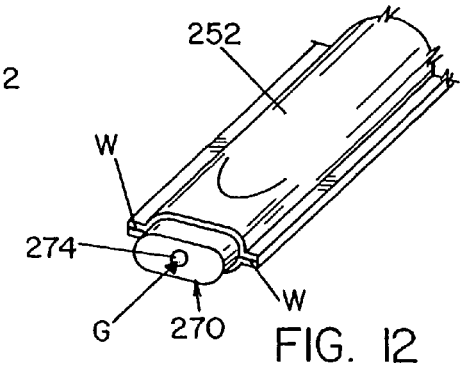
FIG. 12 is a pictorial view similar to FIGS. 10 and 11 illustrating the plugged end of a shaped blank as it is being formed by air pressure introduced through the plug.
Figure 13:
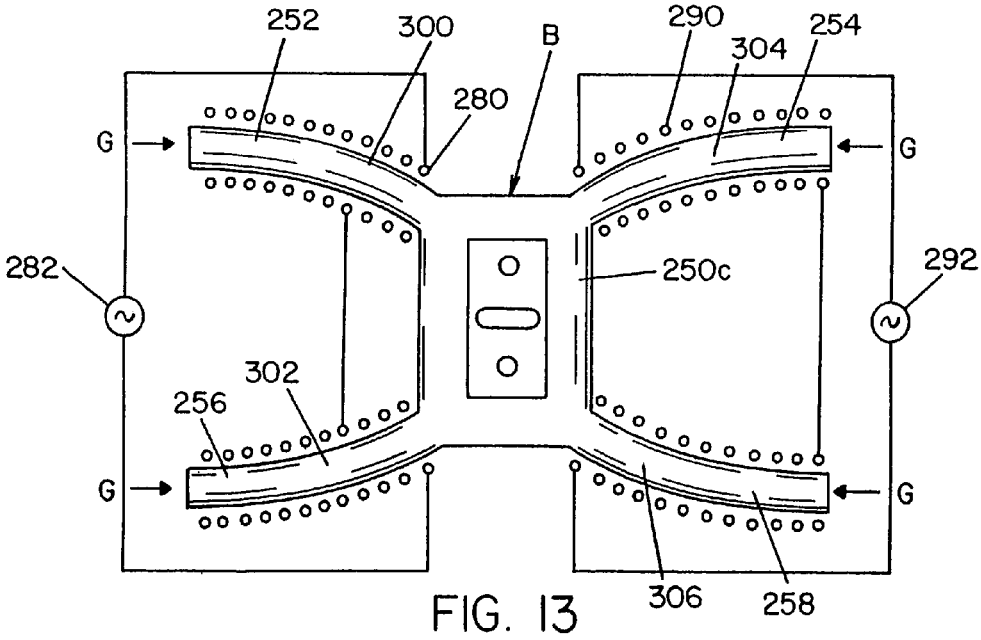
FIG. 13 is a top plan view of the shaped blank shown in FIGS. 7—12 as it is being formed by pressurized gas while being selectively induction heated.

In accordance with the invention, one or more ends of metal blank b can be plugged by a plug 270. As shown in FIGS. 10 and 11, plug 270 has a wedge shaped nose 272. As can be appreciated, other plug shapes can be used. When a plug is used, the plug is forced into one or more of the ends of each of the legs 252, 254, 256 and 258. The plug or plugs can be forced into the ends by hydraulics or some other means. One or more of the plugs 270 can include a gas inlet 274. The gas inlet can include a flared gas passage 276. As shown in FIGS. 10–12, plugs 270 are inserted in the end of each of the legs so gas G can be forced into each of the legs to expand the legs into the shape of the H-shaped cavity or shell section of die members 60, 62 having cavity or shell sections formed in accordance with the desired shape of structural component B illustrated in FIG. 13. During the forming process, metal blank b is heated inductively by coil 280 encircling legs 252, 256 and driven by high frequency power supply 282. In a like manner, induction heating coil 290 encircles legs 254, 258 and is energized by a high frequency power supply 292. As can be appreciated, a single power source can be used to heat all the legs of metal blank b. It can also be appreciated that a power source can be provided for each leg of metal blank b. In one design, coils 280, 290 are operated at different cycles. Such different heating can result in the legs being heated differently and/or at different rates. In this design, portions 300, 302 of legs 252, 256, respectively, can be heated less than portions 304 and 306 of legs 254, 258. This representation of the present invention illustrates that the induction heating equipment associated with the die set allows processing of the metal blank being formed at different temperatures to obtain the desired forming rate. It is part of the invention that a greater portion of legs 254, 258 can be heated during the forming process than the portion being heated in legs 252, 256. However, when a carbon steel metal blank is used, all of the metal being formed must be at a temperature of at least about 1400–1500° F. If the metal blank is formed of another type of metal and/or portions of the metal blank are formed of different metals, the forming temperature can be different. This is a novel concept of heating portions of the metal blank differently. In the past, when heating was used for superplastic deformation of sheet material, the total sheet material was heated the same. As can be appreciated, the legs can be heated at the same rate.

Figure 14:
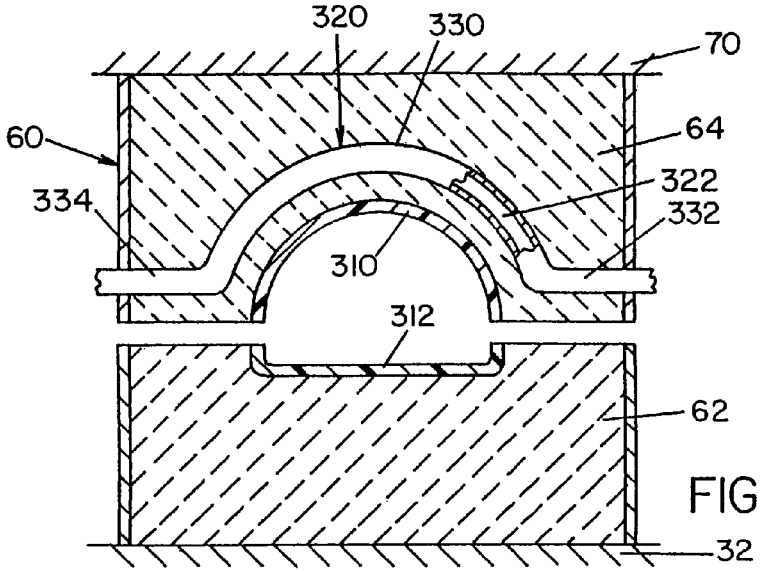
FIG. 14 is a cross sectional view of the two die members used in practicing the present invention with a differently shaped part where the induction heating coils or conductors are positioned along only one side of the die member.
Figure 14A:
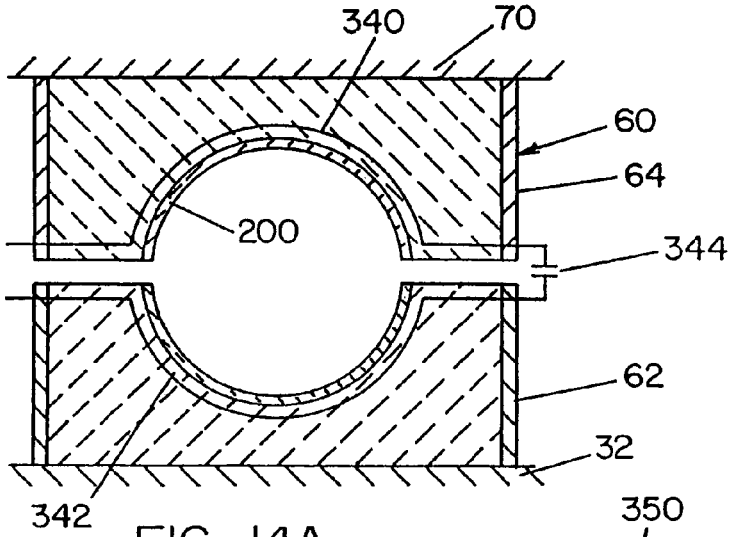
FIG. 14A is a cross sectional view of the two die members used in practicing the present invention illustrating the use of a connector for joining the conductors, shown as solid lines, in the induction heating mechanism of the invention.

As mentioned above, one feature of the present invention is the ability of the induction heating equipment associated with the die set 60 to selectively heat different portions of the shaped metal blank being formed by high pressure gas. This ability to "tune" the induction heating along various sections of the metal blank being formed is novel and has not been done previously. Variations in the induction heating of the metal blank being formed by high pressure gas, in accordance with the invention, can be accomplished by using various induction heating arrangements. One of these arrangements is illustrated in FIG. 14. The cross sectional shape of the forming cavity or shell section includes a dome portion 310 in upper die member 64 and a generally flat portion 312 in lower die member 62. In this configuration, it can be desirable to heat the top portion of the metal blank being formed greater adjacent the dome shaped portion 310. As a result, axially spaced conductors 320 with water passage 322 are spaced along the dome portion of the cavity or shell section 310 in upper die member 64. These conductors 320, several of which are aligned along the axis of the metal blank, have an arcuate segment 330 with straight legs 332, 334. No conductors are positioned adjacent flat portion of cavity or shell section 312 in lower die member 62. By using this configuration, induction heating is accomplished at the top side of the metal blank, which side has the most movement of metal during the forming process. A metal blank a having a generally circular cross-sectional shape is placed between cavity or shell section potions 310, 312 and is expanded by gas as it is being heated by induction heating on the side adjacent the dome portion through the induction heating effect of the arcuate segments 330 of axially spaced conductors 320. This implementation of the present invention shows how the heating can be accomplished along the length of the metal blank at different heating cycles or different magnitudes. This can be done by encircling conductors such as conductors 340, 342 placed in series by connector 344 as shown in FIG. 14A, by the arrangement shown in FIG. 14, or by the selective heating arrangement illustrated in FIG. 14B.

Figure 14B:
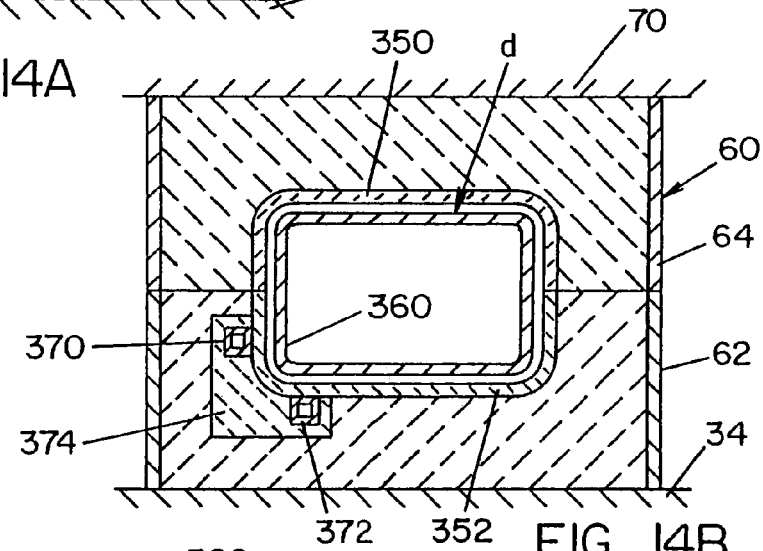
FIG. 14B is a cross sectional view illustrating induction heating of a selected area of the shaped blank as it is being formed in the die members.

In FIG. 14B, a metal blank d having a generally uniform rectangular cross-sectional shape is formed in half cavity or shell sections 350, 352, which forms an encircling configuration when die set 60 is closed. In this implementation of the present invention, corner 360 of metal blank d is heated during the forming process. This is accomplished by conductors 370, 372 at the opposite ends of flux concentrator 374 formed of a high permeability material such as, but not limited to, FERROCON. As shown in FIGS. 14, 14A and 14B, induction heating of selected portions of the metal blank along the length of the metal blank being formed by high pressure gas is used to control the forming process. This is also employed for the purposes of controlling the metallurgical properties of the final product, as will be explained later. By changing the conductors 340, 342 along the length of the metal blank being formed, as shown in FIG. 14A, a different amount of heating can be accomplished along the length of the metal blank or on one side of the metal blank.

Figure 14C:
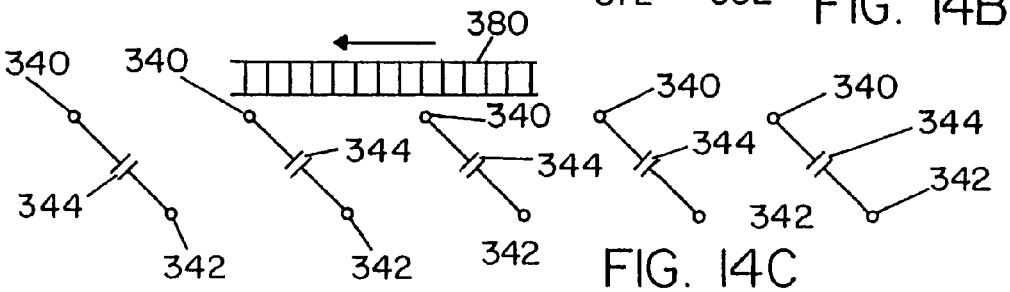
FIG. 14C is a schematic view of a flux yoke to selectively increase the induction heating in specific areas along the shaped blank as the blank is being formed.

Another arrangement for changing the heating effect along the length of the metal blank is illustrated in FIG. 14C, wherein the axially spaced conductors 340 are joined in series with conductors 342 by connectors 344 as previously described. In one or both of the die members, there is provided a flux yoke 380 formed of high permeability material, which is located along the axial length of the metal blank to shunt the induction heating effect of the coils 340, 342. In this manner, throughout the length of the metal blank, a constant encircling coil for induction heating is provided. To change the amount of heating caused by this continuous encircling coil, the die set is provided with a flux yoke 380 positioned axially along the metal blank. This changes the heating effect at various axial positions along the metal blank without really changing the induction heating coil arrangement.

Figure 14D:
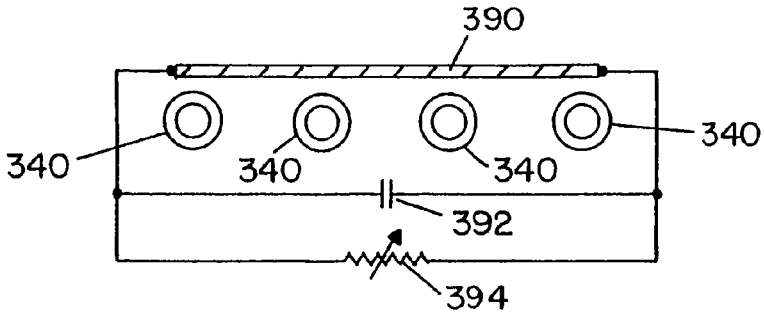
FIG. 14D is a schematic view illustrating the use of a Faraday shield shiftable along certain areas of the induction heating conductors to alter the heat profile along the length of a blank being formed.

Another system for changing the induction heating is illustrated in FIG. 14D where Faraday shield 390, including a capacitor 392 and an adjusting resistor 394, is provided at various locations along the length of the metal blank. The effect of the Faraday shield is adjusted at various positions to decrease the amount of induction heating caused by certain portions of the coil encircling the metal blank, as schematically illustrated in FIGS. 14A, 14C. As illustrated in these figures, a variety of electrical options are available to change the amount of heating along the length of the metal blank or at different sections of the metal blank while the metal blank is being expanded by gas in accordance with the invention. The coils or conductors C are spaced above cavity or shell section 200 and the heating effect is changed to control the amount of, and location of, different heating effects.

Figure 15:
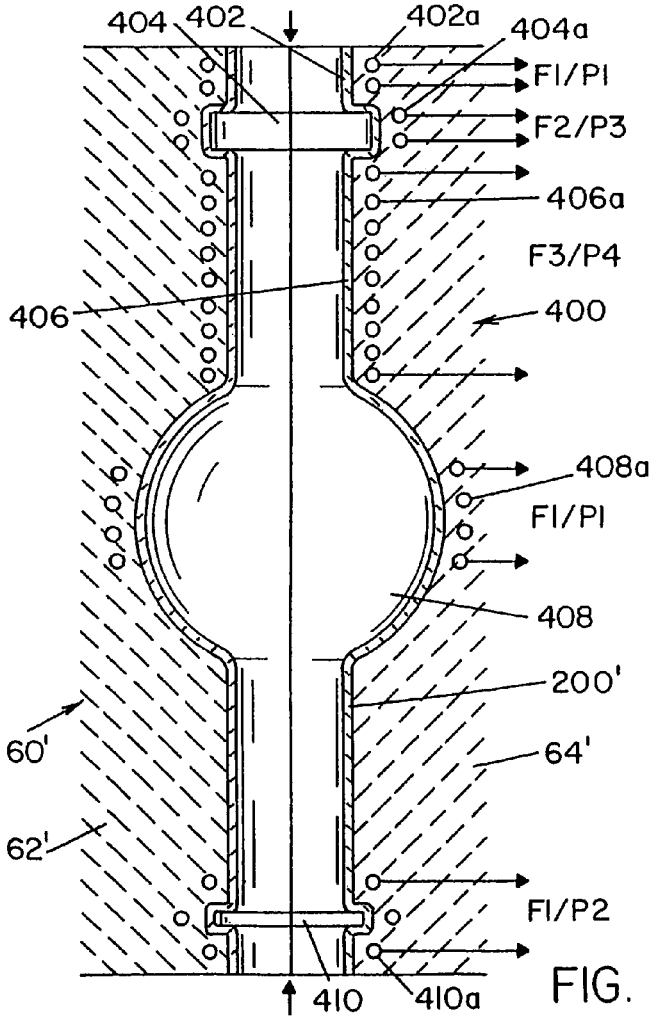
FIG. 15 is a cross sectional view of the two die members used in practicing the present invention for producing a particularly tubular structural component with a different expanded shape and illustrating the distribution of induction heating coils along the length of the cavity for forming the shaped blank.

The versatility of tuning the induction heating along the length of the metal blank is illustrated in another embodiment of the invention, wherein a metal blank is to be formed into a complex tubular structural shape as defined by cavity or shell 200' in die members 62', 64' of die set 60' as shown in FIG. 15. The cavity or shell section will cause the metal blank to have different diameters and shapes in areas 402, 404, 406, 408 and 410. In these different areas, a different amount of heat is required for deformation and the desired characteristics of the metal blank. Consequently, the die members are provided with a plurality of encircling induction heating coils 402*a*, 404*a*, 406*a*, 408*a* and 410*a*, respectively. These encircling coils are spaced axially along the cavity or shell 400 defining the final outer shape of the metal blank being formed. Each of the separate coils has a specific frequency and a specific power level; however, this is not required. Several power supplies PS1, PS2, PS3, and PS4 are provided to create the different frequencies and power levels for coils 402*a*–410*a*. As illustrated, power supply PS1 has a frequency F1 and a power level P1. This power supply is connected to encircling inductors 402*a* and 408*a*. In the same fashion, power supply PS2 has a frequency F1 which is the same as PS1 but a different power level P2. This power supply energizes encircling coil 410*a*. In a like manner, power supply PS3 has a frequency of F2 and a power level of P3. This power supply drives encircling inductor 404*a*. In a like manner, power supply PS4 has a frequency of F3 and a power level P4 for energizing encircling coil 406*a*. By changing the heating frequency and power level, the heating cycle, during the forming process, is modulated and changed along the length of the metal blank. This is used not only for controlling the amount of heat for the purposes of optimizing the forming operation, but also, to optimize the metallurgical processing of different sections of the metal blank. The induction coils raise the temperature of the metal blank to a desired forming temperature. The areas of cavity or shell section 200' without coils or conductors will be short, if such areas exist at all. A large number of conductors can be used with the heating effect is changed, such as shown in FIG. 15.

Figure 15A:
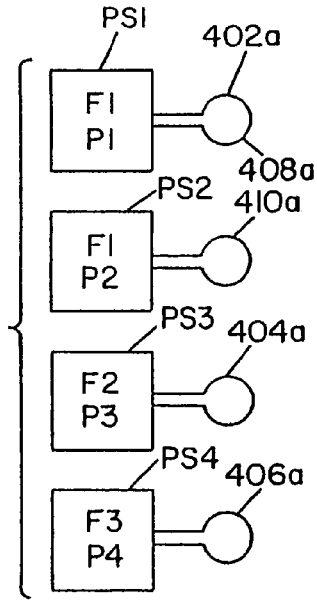
FIG. 15A is a schematic block diagram showing power supplies to develop the induction heating parameters used in the conductors or heating coils shown in FIG. 15.
Figure 16:
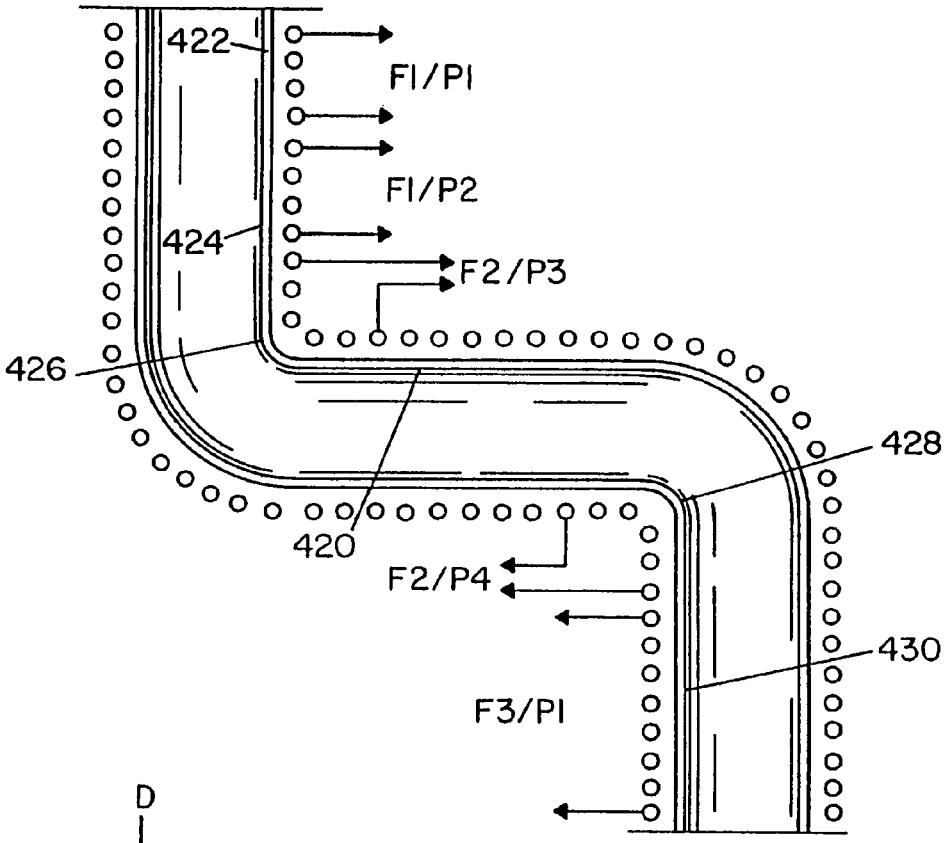
FIG. 16 is a schematic cross sectional view of a die member for forming a shaped blank having an undulating profile wherein selective induction heating coils or conductors are positioned at different areas in the die member to inductively heat the tubular metal blank during the forming operation using different induction heating cycles.
Figure 17:
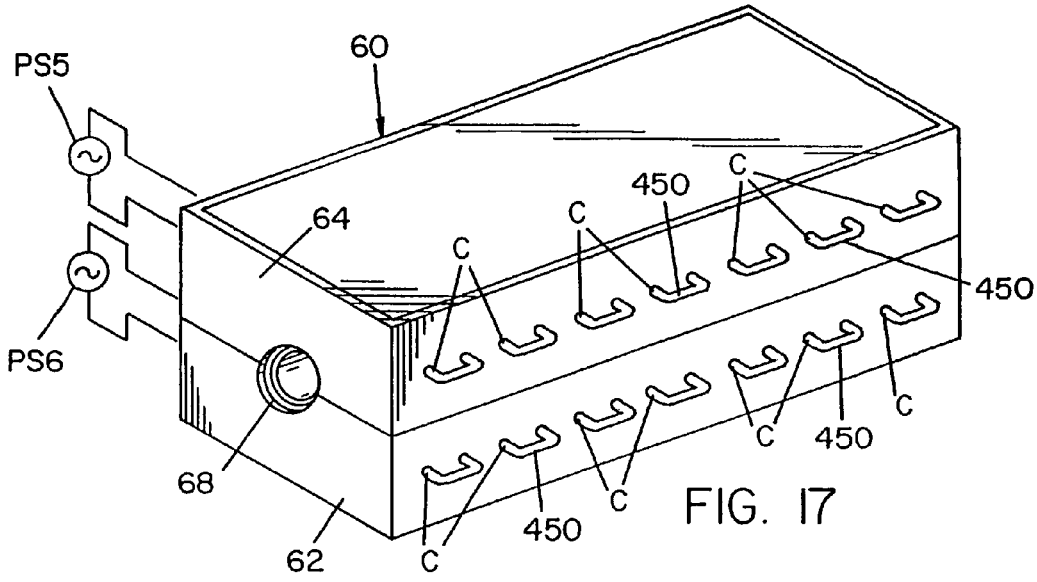
FIG. 17 is a pictorial view of a closed die set for use in practicing the present invention, wherein the coils or conductors along the length of the die set are connected in series in each of the die members.
Figure 18:
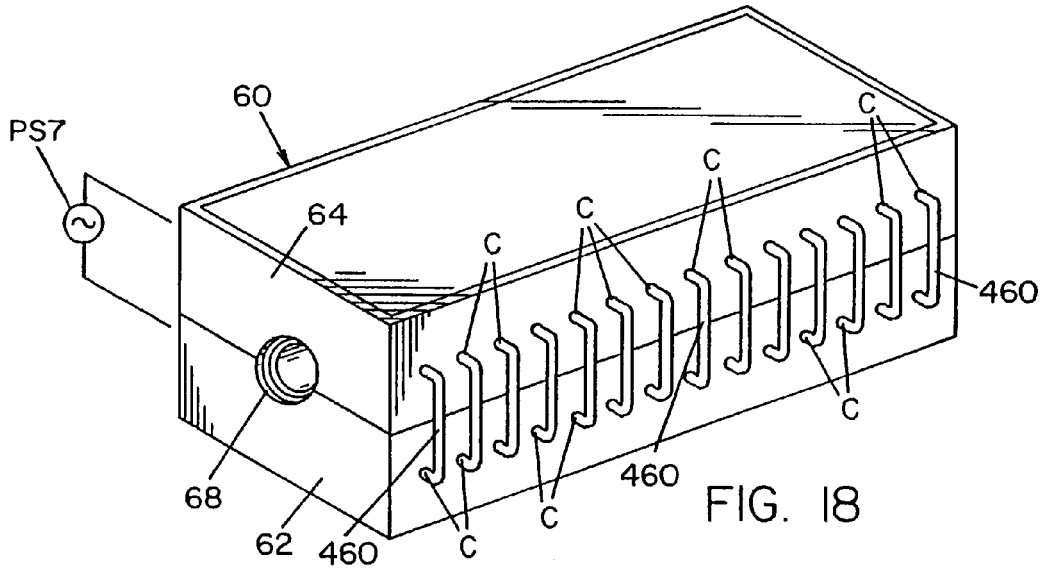
FIG. 18 is a pictorial view, similar to FIG. 17, wherein the conductor or coils are connected in series from one die member to the other. This requires flexible connectors or other movable connectors to allow separation of the die members for loading and unloading the shaped blank.

Another feature employed of the present invention is illustrated in FIG. 16 wherein cavity or shell 420 has a modified profile, but a uniform cross section. In this arrangement, an induction heating coil is provided around the total length of the metal blank being formed as opposed to the arrangement shown in FIG. 15 wherein selective areas of the metal blank are provided with encircling inductors. Where all areas have encircling inductors, the heating along the length of the metal blank is accomplished by using different power supplies as shown in FIG. 15A. Different regions of the metal blank can be heated sequentially, or with adjustable heating power, to achieve desired strain distribution. However, as shown in FIG. 15, it is also possible to not energize a portion of the encircling inductors or energize a portion for a shorter time at a lower power. The cavity or shell 420 is divided into sections 422, 424, 426, 428 and 430. Between cavity or shell sections 426 and 428 there are encircling inductors that could be used for induction heating; however, these induction heating coils may not be energized for certain applications. Thus, such induction coils do not cause induction heating even though they are present. Such uniform distribution of the induction heating coils is illustrated in FIGS. 17 and 18. Conductors C are connected in series by connectors 450 and powered by separate power supplies PS5 for upper die member 64 and PS6 for lower die member 62. In FIG. 18, flexible connectors 460 are between the upper and lower die member in a single power supply PS7 is used. In FIG. 18, connectors 460 are flexible to allow for opening and closing of the die set for loading and unloading the metal blank. Opening 68 at the end of the die set accommodates protruding ends 10, 12 of the metal blank as schematically illustrated in FIG. 1. These ends are necessary for plugs to introduce the high pressure gas.

Figure 19:
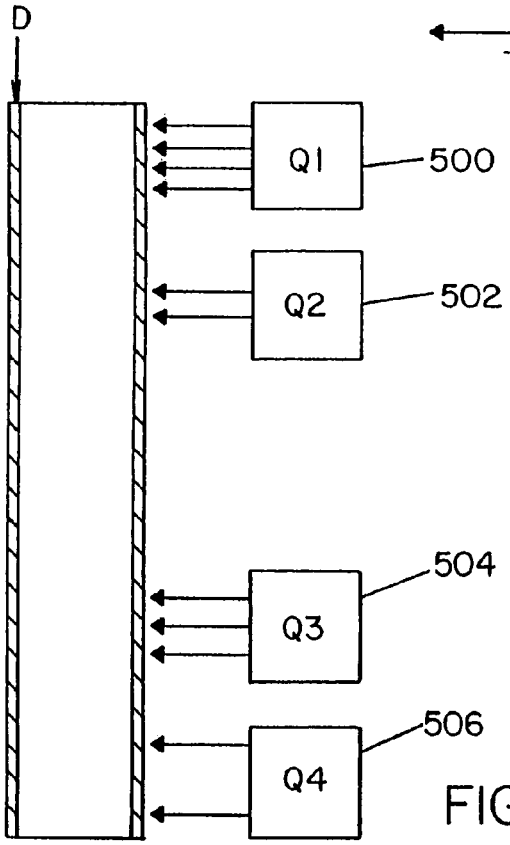
FIG. 19 is a schematic view of the tubular structural component after it has been formed and inductively heated along its length with selected cooling or quenching stages illustrated.

After the metal blank has been formed into a structural component A, the structural component can undergo controlled cooling or quenching. This controlled cooling or quenching occurs at station 26. The controlled cooling process is either a quenching operation, or an operation cooling the structural component at a reduced rate, depending on the metallurgical characteristics desired of the structural component and the performance requirements of the final structural component. The use of the terminology of "quench" is to represent the general on-line heat treating process and to explain the capability of the new forming process for optimizing the material performance. This feature is schematically illustrated in FIG. 19, wherein a finished hot formed structural component is positioned in the cooling or quench station 26. Along the length of the structural component, different cooling or quenching orifices are used. This is illustrated as cooling or quench stations 500, 502, 504 and 506, each of which is individually controlled in either liquid or gas cooling or quenching. By using a precise cooling or quenching cycle with a specific heating cycle during the processing of the structural component D, the metallurgical properties of the finished product are controlled. The modulation of induction heating along the length of the metal blank during expansion of the metal blank, in combination with the precise control of the cooling or quenching along the expanded metal blank, creates an improved finished product wherein the metallurgical properties along the formed structural component are optimized based upon the desired amount of heating, the temperature of the heating cycle and the cooling or quenching cycle. The ability to control the metallurgical properties of the finished product is a further aspect of the present invention and is a significant improvement over prior procedures used to form metal sheets. Metal blank that include or are formed of steel are typically subjected to the controlled cooling or quenching process since such metal has the capability of modified metallurgical properties. As can be appreciated, other metals can be subjected to the controlled cooling or quenching process.

The cooling or quench station 26 can use distortion controlling restraints to give size control to the structural component. When cooling aluminum, a high rate of uniform cooling, as by sprays, is typically used with such mechanical restraints.

Figure 20:
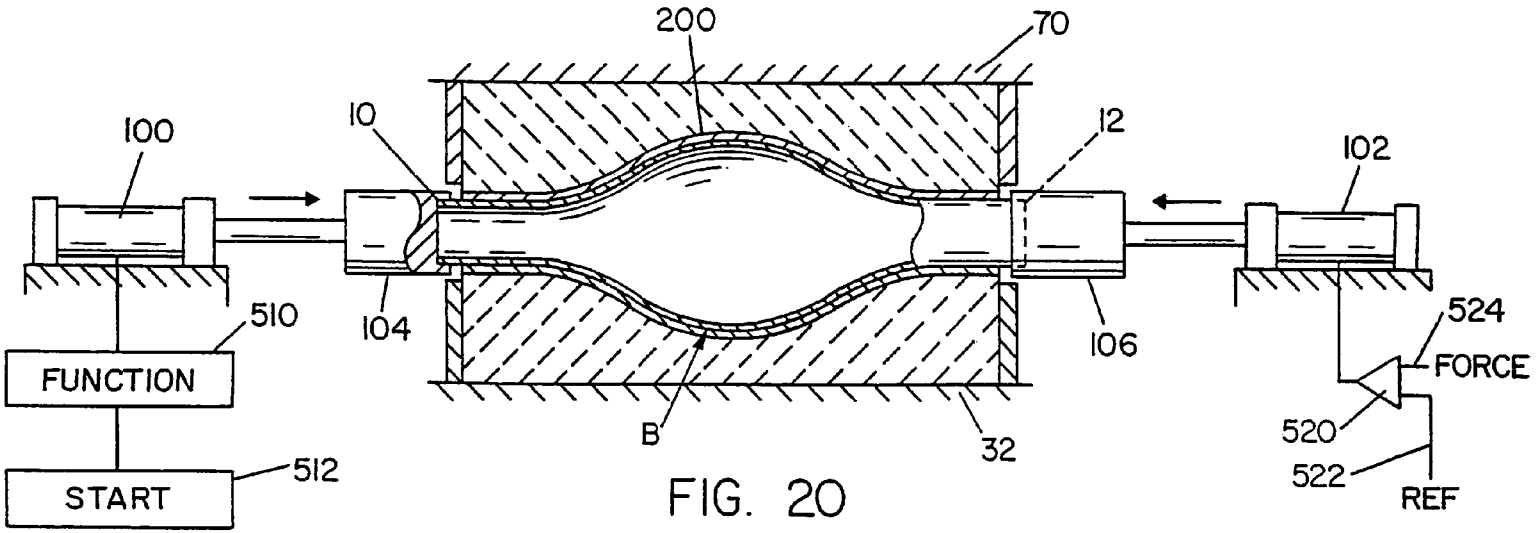
FIG. 20 is a side elevational view illustrating an aspect of the machine for in-feeding a metal as the shaped blank is being formed into the tubular structural component.

The present invention can use the concept of positively feeding metal into the cavity or shell of the die set as the metal is formed. This concept is schematically illustrated in FIG. 20 wherein a function generator 510 controls servo cylinder 100 forcing the collet 104 inward slightly during the hot metal gas forming process. The process is started as indicated by block 512. In a like manner, cylinder 102 is moved inwardly by a signal from error amplifier 520 having a sensed force signal in line 524. The level of the actual force applied by cylinder 102 is compared to the level of a reference signal in line 522. The error signal controls servo cylinder 102. The illustration in FIG. 20 is representative of this concept. As can be appreciated, only one end of the metal blank can be moved into the cavity or shell during the forming process. The amount of insertion of metal into one or more ends of the metal blank during the forming process can depend on several factor such the degree of expansion of a particular section of the metal blank, the desired thickness of the expanded metal blank, etc.

Figure 21:
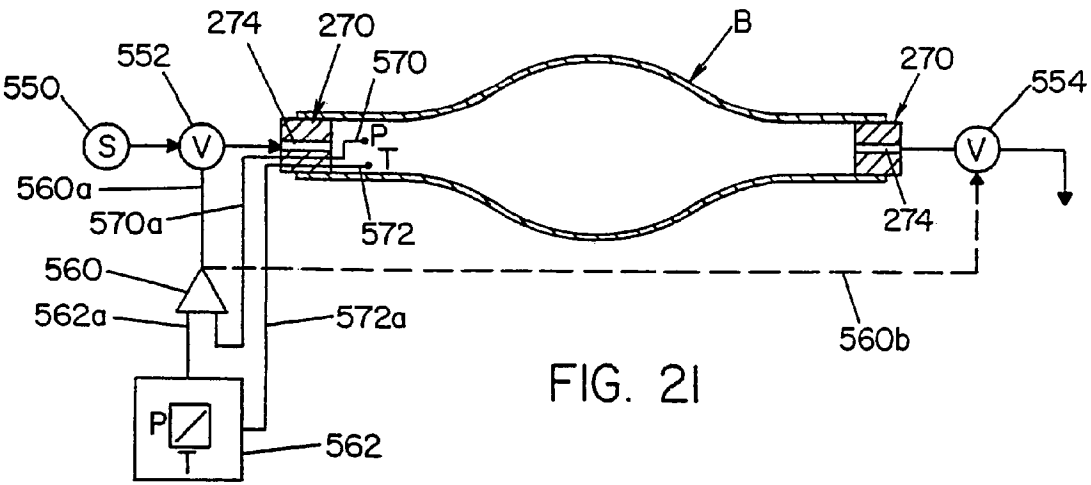
FIG. 21 is a view similar to FIG. 20 showing control elements in block diagram form as used in a control system of the preferred embodiment of the present invention.

The gas pressure into the metal blank during the forming of the metal blank can be controlled in various ways. As schematically represented in FIG. 21, plugs 270 have gas inlets or outlets 274. Gas supply 550 provides a gas (e,g, air, nitrogen, argon, etc.) at a desired pressure (e.g., 200–1000 psi) into the interior of the metal blank. The gas is directed to metal blank b by an inlet valve 552. An exhaust valve 554 allows decrease in the internal pressure of metal blank B. Valve 552 increases the gas pressure while exhaust valve 554 decreases the pressure. These valves are controlled by an error amplifier 560 having an outlet 560*a* that operates valve 552. Alternatively or additionally, line 560*b* controls exhaust valve 554. Function generator 562 provides one input 562*a* to error amplifier 560. The other input 570*a* is created by pressure sensor 570 within metal blank B. Pressure sensor 570 provides a signal in lines 570*a* that is compared with the output of function generator 562 at line 562*a*. This determines whether, at a given temperature represented by the signal in line 572*a* from sensor 572, additional pressure or less pressure should be provided in metal blank B. Consequently, the pressure is maintained at the desired selected level associated with a given temperature. Control arrangements, analog and/or digital, can be used.

Figure 22:
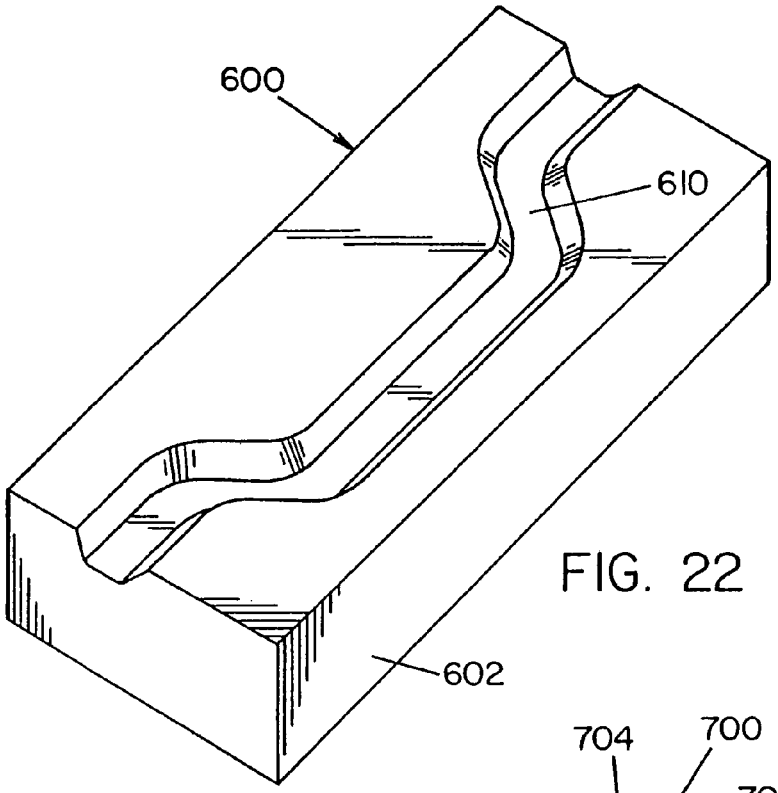
FIG. 22 is a pictorial view showing the preform die used in the preferred embodiment of the present invention with a curved metal blank.
Figure 23:
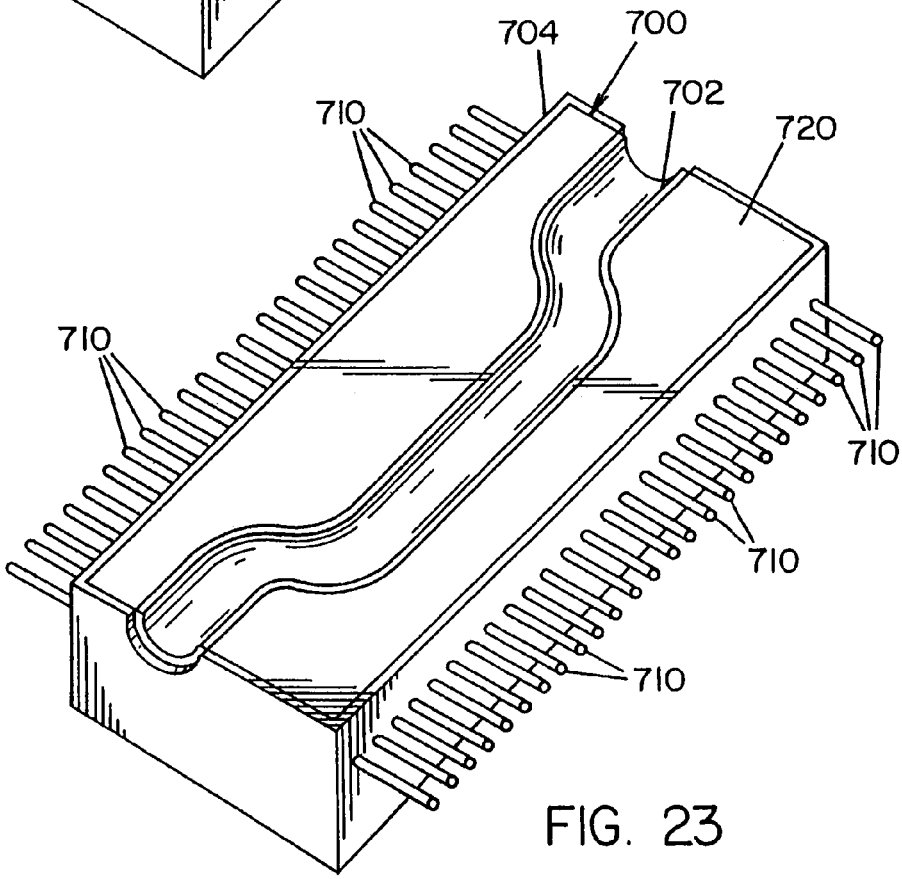
FIG. 23 is a pictorial view of the lower die member used to form a curved metal blank preformed by the preform die in FIG. 22.

The present invention has primarily been described with the formation of a simple shaped metal blank. In one arrangement, the metal blank is to be formed into a tubular structural component having an undulating profile in the axial direction. To form such a structural component, a preform step is typically used to prepare the metal blank. This preform step is typically followed by preheating the metal blank and then, hot metal gas forming the metal blank in station 24. Consequently, a preform die 600, as shown in FIG. 22, is mounted by base 602 at station 22 of machine 20 as shown in FIGS. 2–4. This die has an elongated nest 610 with the desired profile to be imparted to the cylindrical metal blank preparatory to the forming operation. In this manner, the cylindrical sheet metal blank is preformed in nest 610. This forms the cylindrical metal blank so it will easily fit in the cavity of die set 60 for the subsequent forming operation. FIG. 23 illustrates lower die member 700 for the metal blank preformed by the die 600 in FIG. 22. This lower die member is matched with a similar upper die member for the gas forming operation. It includes cavity or shell section 702, framework 704 and a large number of axially spaced conductors 710. These axially spaced conductors of the induction heating equipment are embedded within the ceramic fill material 720 of lower die 700. As can be appreciated, the framework 704 can be formed of a molded or machined material to enable the conductors or coils to be removably inserted in the framework, as will be discussed in more detail below. Conductors C are spaced along the cavity or shell section a small distance (e.g., 0.1–1.5 inch).

Figure 24:
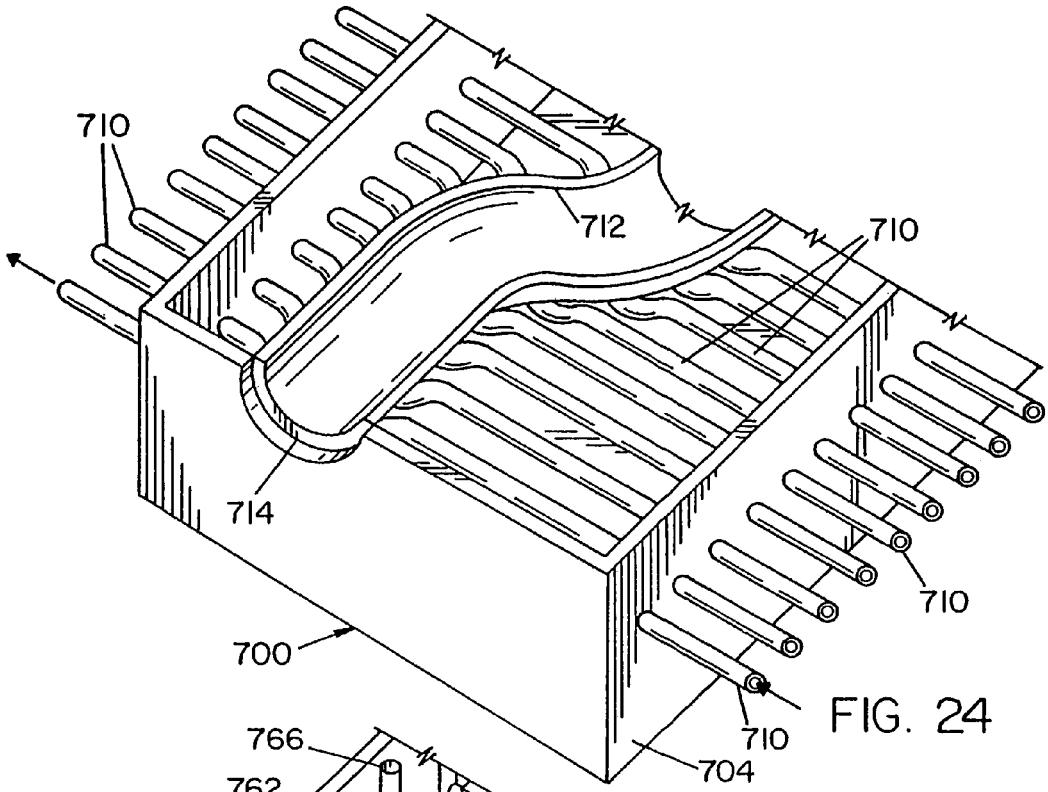
FIG. 24 is a partial pictorial view illustrating the end portion of the lower die member used in the preferred embodiment of the present invention.
Figure 25:
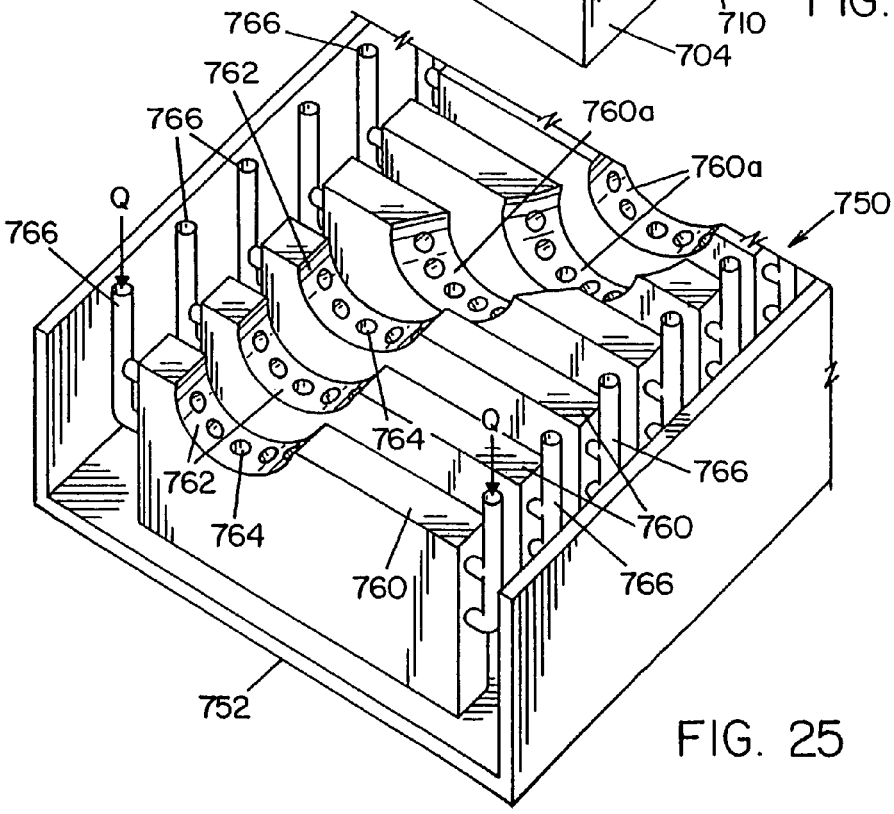
FIG. 25 is a pictorial view of the end portion of the cooling or quench station for selectively cooling or quenching previously inductively heated portions of the final tubular structural component.
Figure 26:
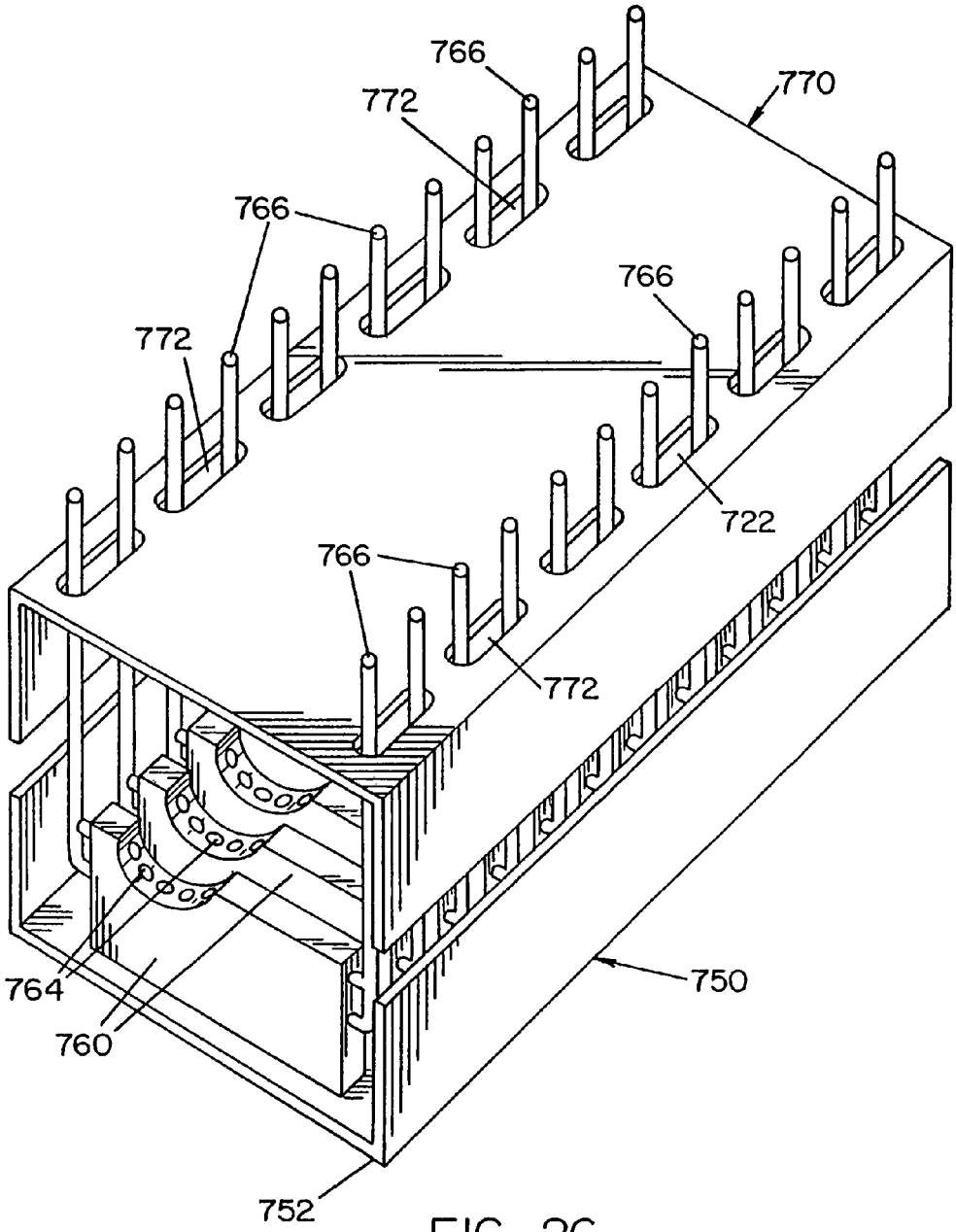
FIG. 26 is a pictorial view showing the cooling or quench station used in the preferred embodiment of the present invention.

FIG. 24 is a pictorial enlarged view of one end of lower die member 700 as shown in FIG. 23 with a cavity or shell section 712 and opening 714. Fill material 720 is removed to illustrate the encircling closely spaced conductors 710 supported in framework 704. For the preformed metal blank processed by the die set shown in FIG. 22 and the lower die member shown in FIGS. 23 and 24, there can be provided a cooling or quench unit 750 mounted at station 26 of machine 20. This cooling or quench unit is illustrated in FIGS. 5, 25 and 26 as including a lower support base 752 having upstanding cooling or quench stands 760 and support stands 760*a* which may not be used for cooling or quenching. In cooling or quench stands 760, the heated formed metal blank is supported by nest 762 having cooling or quenching holes 764 directing cooling or quench liquid onto the heated metal blank from inlets 766. A cover 770 shown in FIG. 26 is positioned over base 752 during the cooling or quenching operation to allow proper quenching of the metal blank. Opening 772 provides clearance for cooling or quench inlets 766. Nest 762*a* in stands 760*a* merely support the heated metal blank during the cooling or quenching operation. However, they can be used for cooling or quenching of this area of the metal blank if needed. Cooling or quench stands 760 receive the desired amount of cooling or quenching liquid for the cooling or quench operation as discussed in connection with FIG. 19. By using selective cooling or quenching, together with selective heating, the forming operation is optimized. In addition, the metallurgical properties of the final formed structural component are optimized. In accordance with one arrangement of the present invention, coils or conductors are closely spaced along the die members, and cooling or quench stands are closely spaced along quench unit 750. However, the amount of heating and the amount of cooling or quenching is controlled to give effective forming and desired properties of the finished product.

A further feature of the present invention is illustrated in FIGS. 27, 28A and 28B wherein a central multi-turn induction heating coil 780 surrounds the cavity into which the hollow metal blank illustrated as a single sheet E is to be formed by gas. A second induction heating coil 782 includes spaced sections 782*a*, 782*b* on opposite ends of central coil 780. A profile formed by coil sections 782*a*, 782*b* with coil 780 is the shape of the cavity or shell 200 into which metal blank E is to be formed. Since coils 782*a*, 782*b* are close to metal blank E, before it is formed, the coils heat the axially spaced sections X before the center portion Y of the metal blank is heated. Thus, the forming operation first causes movement of sheet E in area X, as shown in FIG. 28B. Thus, during the initial heating of the metal blank, the metal blank deforms first in areas adjacent the closer induction heating coil section 782*a*, 782*b*. If the heating operation were discontinued at that time, the invention would still have been performed in that the portions X were formed into the shape of the cavity or shell 200. With continued heating and gas pressure, metal blank E eventually shifts into the full cavity or shell 200, defined by the contour of the coils 780, 782, as shown in FIGS. 27, 28A and 28B. These schematic representations are used to illustrate that the induction heating affects the ease of forming the metal blank during the hot metal gas forming process. The closer the coils are to the metal constituting the metal blank E, the greater the heating effect. However, the heating equalizes as the metal blank assumes the final shape of the cavity or shell 200.

By providing controllable pressures for the gases inserted in the metal blank, selective location or operation of the induction heating conductors, along and at various positions around the cavity or shell section and selective, controlled cooling or quenching, the forming process is controlled to avoid a necking and/or wrinkle condition. Coordination of these acts with controlled in-feeding of metal produces uniform end products. Indeed, with the use of proper end feeding, the proper thickness of the expanded metal blank is obtained. During the process, the induction heating at certain areas can be performed in die set 60 before final heating and forming. During the forming, the gas pressure can be modified and in some examples is modified together with the induction heating being modified on a time basis. By selective heating and modified heating during the forming process, the flow of metal is controlled. This is thermal enhanced intelligent forming. The invention is not restricted to heating of a metal blank to a given amount during gas forming at a fixed pressure.

The metal blank being formed by the invention is a hollow structure or blank formed from a thin material (e.g., 0.1–0.5 inch) and is typically an electrically conductive material, (e.g., steel, aluminum); however, brass and titanium can be used. After the metal blank has been inductively heated (e.g., by cycles where areas are heated selectively, at different times, different temperatures, etc.), the formed metal blank is selectively cooled or quenched at station 26 by liquid and/or air at controlled times and cycles. This cooling or quenching operation gives steel and aluminum dimensional stability and/or the desired metallurgical properties. The cooling or quenching operation is typically by a uniform cooling or rapid quench cycle with liquid and/or gas, or an arrested cooling quench to achieve isothermal transformation in the metal material of the metal blank as disclosed in U.S. Pat. No. 4,637,844, which is incorporated herein by reference. Combinations of uniform cooling or rapid quenching and arrested cooling can be used at different portions of the inductively heated and formed metal blank. It has been found that some steels used for the automobile industry should be cooled at a slower rate to maintain their high strength whereas other steels are quenched to be hardened after heated for forming. Mist cooling, arrested cooling, and rapid quenching are selectively used to obtain the desired final metallurgical properties in all areas of the final product. This procedure is also used for various aluminum alloys formed in accordance with the invention.

Figure 29:
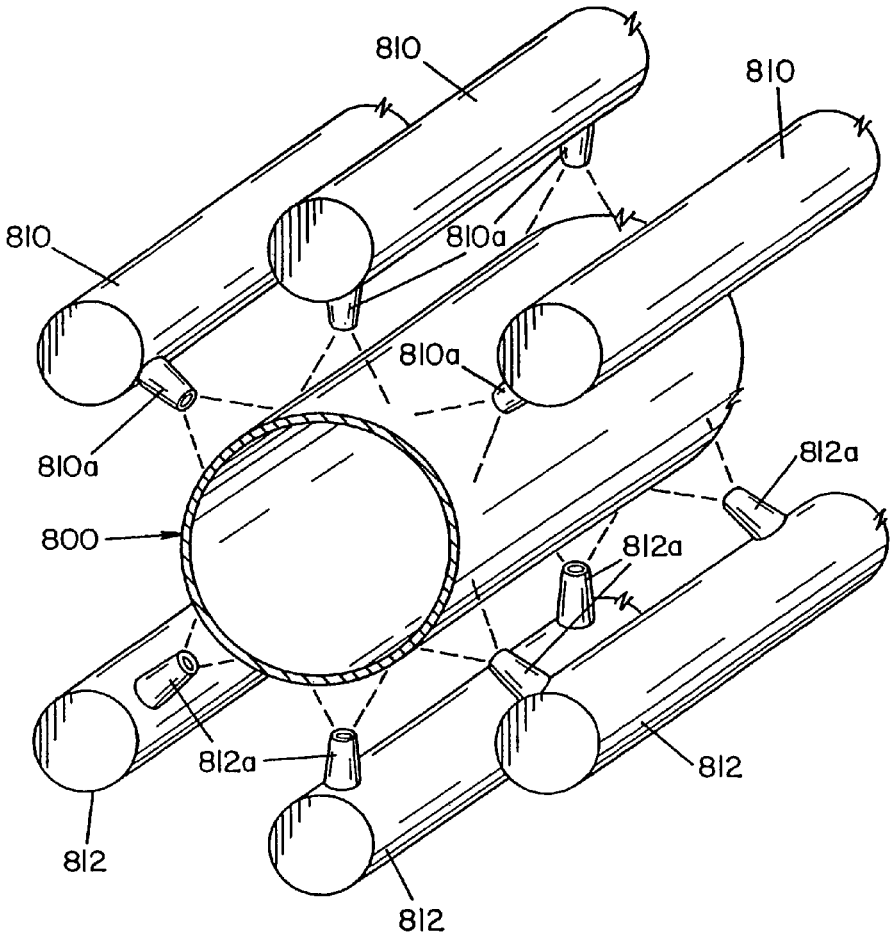
FIG. 29 is an end view of a cooling mechanism for causing arrested cooling of the heated metal blank after it has been formed.

In some processes, arrested cooling is used wherein the metal blank is cooling or quenched to a given temperature and held at that temperature for a selected time. Such procedure is illustrated in FIG. 29 wherein metal blank 800 is surrounded by hot fluid manifolds 810 and 812 for directing fluid at a given temperature above ambient from nozzles 810*a*, 812*a* (only a few of which are shown). This action cools metal blank 800 to the temperature of the hot fluid where it is held until the fluid flow is stopped. This process can be used to obtain banite or to obtain other processing objectives.

Figure 30:
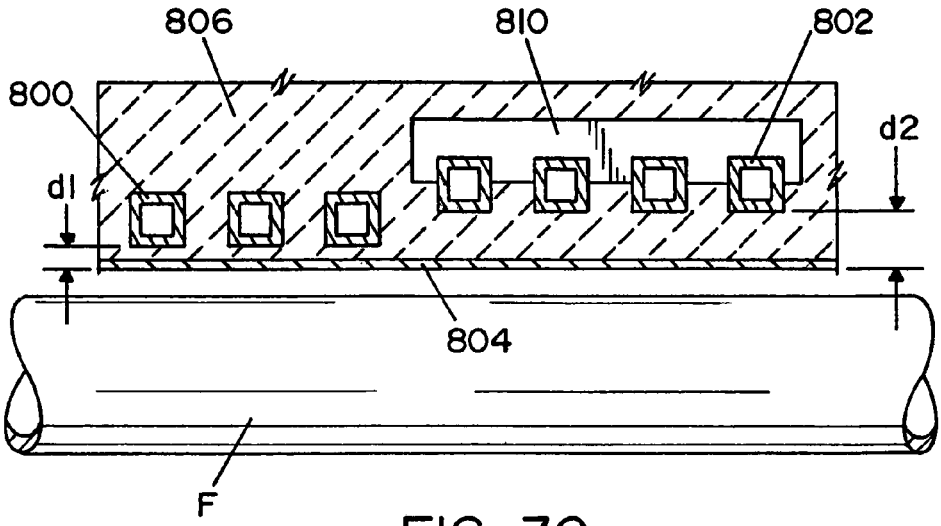
FIG. 30 is a cross sectional view of a portion of a die member used in practicing the present invention where the induction heating coils or conductors are positioned along only one side of the die member at different spacing from the inner surface of the die member and one or more if the heating coils or conductors include a flux concentrator.

Referring now to FIG. 30, there is an illustration of a portion of induction heating coil 800 positioned about the cavity into which the hollow metal blank F is to be formed. Heating coil 800 is positioned in fill material 806 a distance d1 from the inner surface of the cavity or shell 804. A second induction heating coil 802 is positioned about the cavity a distance d2 from the inner surface of the cavity or shell 804, which distance is greater than d1. As previously discussed with respect to FIGS. 27–28B, the closer the coils are to the metal constituting the metal blank, the greater the heating effect provided by the coils. When the coils are positioned close to the inner surface of the cavity or shell, a large heat gradient is formed between the heated metal body and the coils. This large heat gradient can result in thermal shock to cavity or shell 804 which can result in damage to the cavity or shell thereby reduce the life of the cavity or shell. Thermal shock to the cavity or shell can be reduced by moving the coils farther from the inner surface of the cavity or shell; however, increased heating times of the metal blank typically result from such positioning of the coils. One arrangement for overcoming such increased heating times is by the use of flux concentrators. As illustrated in FIG. 30, flux concentrator 810 is used in conjunction with coils 802 to increase the coupling efficiency of the coils. The flux concentrator can also be used to vary the inductive current path along one or more portions of the length of an induction heating coil, thus achieving tailored heating profiles of a metal blank within the die during the forming process. As such the differing distance of the coils 800 and 802 from the inner surface of cavity or shell 804 can be used to vary the heating profile of metal blank F. The use of the flux concentrator in conjunction with coils 802 adds further control of the heating profile of the metal blank.

Figure 31:
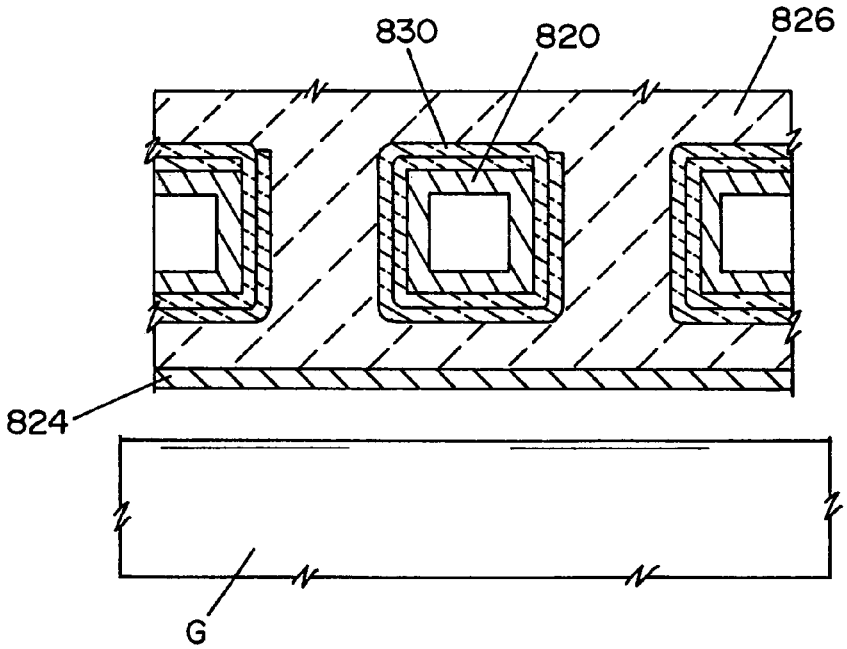
FIG. 31 is a cross sectional view of a portion of a die member used in practicing the present invention where one or more induction heating coils or conductors include the use of thermal insulation wrapped about the one or more induction heating coils.

Referring now to FIG. 31, there is an illustration of a portion of induction heating coil 820 positioned in fill material 826 about the cavity into which the hollow metal blank G is to be formed. Heating coil 820 is wrapped with an insulation material 830. Many types of thermal insulation material can be used. FIG. 31 illustrates one of many ways in which all or a portion of one or more induction heating coils can be insulated. As can be appreciated, the insulation of one or more portions of one or more induction heating coils within a die can achieve tailored heating profiles of the metal blank within the die during the forming process. The use of a thermal insulation on the induction coils allows the die to operate at elevated temperatures, thereby resulting in less thermal shock to the cavity or shell sections 824. Insulation of one or more portions of one or more induction heating coils can also be varied so that tailored heating profiles of the metal blank within the die can be obtained.

Figure 32:
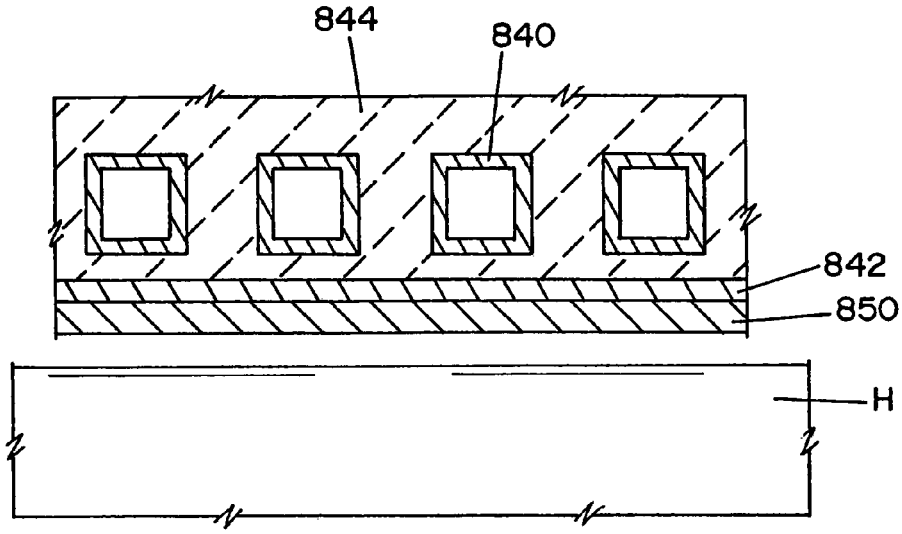
FIG. 32 is a cross sectional view of a portion of a die member used in practicing the present invention where the die includes a cavity or shell section on the inner surface of at least a portion of a die.

Referring now to FIG. 32, there is an illustration of a portion of induction heating coil 840 positioned in fill material 844 about the cavity into which the hollow metal blank H is to be formed. The inner surface of the cavity or shell section 842 includes a layer 850 that is formed of a magnetic material and/or an electrically conductive material. The inner layer 850 can be a liner material (e.g., metal strip, composite strip, etc.) or a material that has been coated on the surface of the cavity or shell section. The inner layer can be used to increase the electrical conductivity of the surface of the cavity or shell section so that the surface of the cavity or shell section can be increased in temperature to thereby reduce the thermal shock to the cavity or shell section and/or to obtain a desired tailored heating profile of the metal blank within the die. The material used to form the inner layer can include a variety of materials such as, but not limited to, metallic fibers, electrically conductive polymeric materials, metal powders, electrically conductive oxides of metals (i.e. aluminum oxide), and the like. The material used to form the inner layer can be selected to increase the strength and/or durability of the surface of the die. For instance, the inner layer can be formed over a cavity or shell section that is made of or includes silicon nitride, silicon carbide, and/or polymeric matrix materials to thereby increase the strength and durability of the cavity or shell section.

Figure 33:
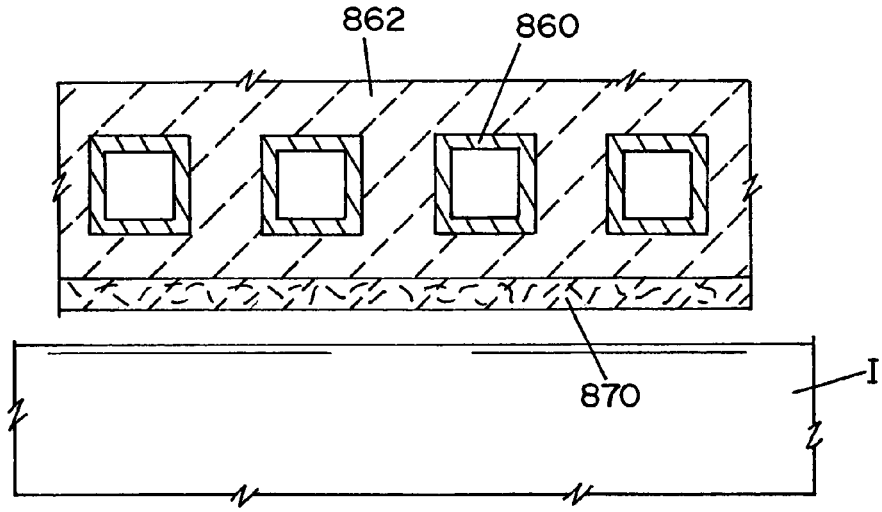
FIG. 33 is a cross sectional view of a portion of a die member used in practicing the present invention where the die includes an electrically conductive material in the body of the die and/or in the cavity or shell section of the die.

Referring now to FIG. 33, there is an illustration of a portion of induction heating coil 860 positioned in filler material 862 about the cavity into which the hollow metal blank I is to be formed. The cavity or shell section 870 includes a magnetic material and/or an electrically conductive material. Such a cavity or shell section can be used to increase the electrical conductivity of the cavity or shell section so that the cavity or shell section can be increased in temperature to thereby reduce the thermal shock to the cavity or shell section and/or to obtain a desired tailored heating profile of the metal blank within the die. The material used in the cavity or shell section can include a variety of materials such as, but not limited to, metallic fibers, electrically conductive polymeric materials, metal powders, electrically conductive oxides of metals (e.g., aluminum oxide, etc.), and the like. The material used in the cavity or shell section can be selected to increase the strength and/or durability of the surface of the die. As can be appreciated, the cavity or shell section does not have to include a magnetic and/or an electrically conductive material. As can also be appreciated, a magnetic and/or an electrically conductive material can be included in the materials used to support the cavity or shell sections. For instance, plates, rods, metal powder and/or the like of electrically conductive and/or magnetic material can be imbedded in the fill material. The magnetic and/or electrically conductive material in the fill material can be positioned at a uniform distance from the surface of the die and/or positioned at varying distances from the die so as to create desired heating profiles during the formation of a metal blank within the die. In addition, the concentration and/or degree of magnetic and/or electrical conductivity of the material within the filler material can be varied to tailor the heating profile of the metal blank within the die during the forming process.

Figure 34:
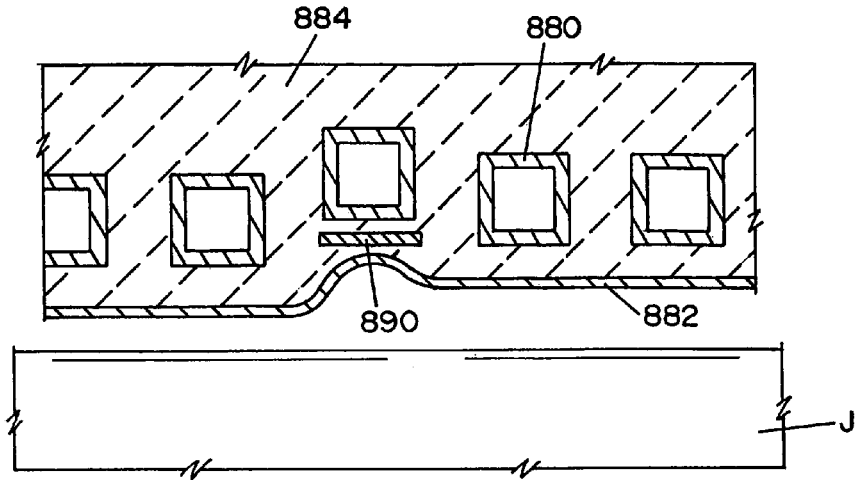
FIG. 34 is a cross sectional view of a portion of a die member used in practicing the present invention where the die includes one or more smart susceptors.

Referring now to FIG. 34, there is an illustration of a portion of induction heating coil 880 positioned in fill material 884 about the cavity into which the hollow metal blank J is to be formed. Positioned adjacent to one of the heating coils is a susceptor 890. The susceptor is positioned in the fill material and spaced from the cavity or shell section 882. As can be appreciated, the susceptor can be positioned so as to contact the cavity or shell section and/or be at least partially positioned in the cavity or shell section. The susceptor can be designed to be electrically activated and/or deactivated at uniform or varying times to obtain a desired tailored heating profile of the metal blank within the die. The distance of the one or more susceptors from the inner surface of the die can be uniform or varied, so as to once again obtain a tailored heating profile of the metal blank within the die. The materials used to form the susceptors can be uniform or varied to once again obtain a desired heating profile of the metal blank within the die. The size of one or more of the susceptors can be uniform or varied to obtain a desired heating profile of the metal blank in the die. One or more switches can be activated and/or deactivated in a controlled (e.g., program sequence, time sequence, temperature dependent, time dependent, etc.) or in a random manner to activate and/or deactivate one or more susceptors.

Figure 35:
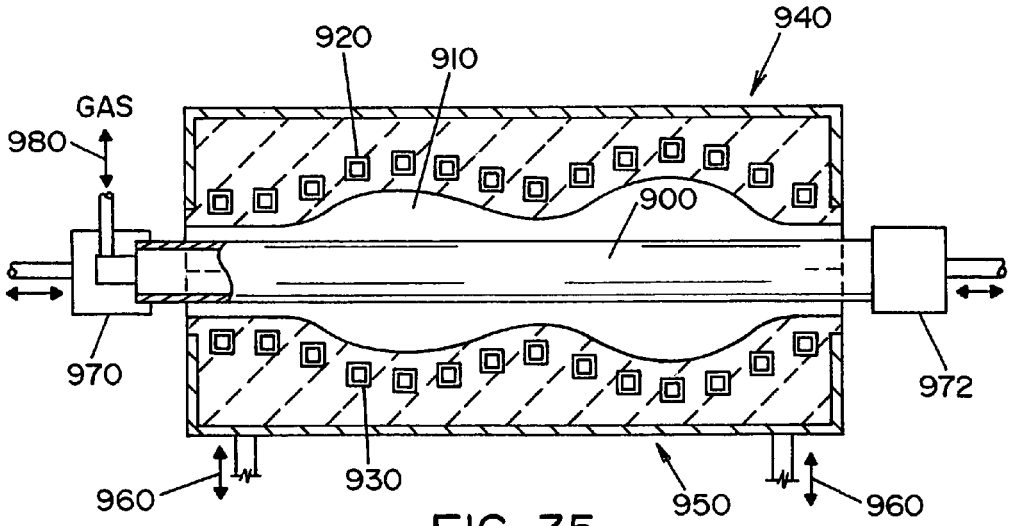
FIG. 35 is a cross sectional view of a die used in practicing the present invention where the die includes the use of end clamping devices for the metal blank that mechanically stimulate the metal blank within the die or the die itself can mechanically stimulate the metal blank to achieve the proper forming of the metal blank in the die.

Referring now to FIG. 35, there illustrated an arrangement to facilitate in the formation of the metal blank in the die by the use of one or more stimulation techniques. A metal blank 900 is to be formed in a complex tubular structural shape as defined by cavity or shell 910 in die members 940, 950. The die members are provided with a plurality of encircling induction heating coils 920, 930. These encircling coils are spaced axially along the cavity or shell defining the final outer shape of the metal blank being formed. The induction coils raise the temperature of the metal blank to a desired forming temperature. Prior to, during, and/or after the metal blank is heated by the induction coils, a fluid (e.g., gas) is inserted into the metal blank at one or more openings in the metal blank (e.g, end openings, etc.) to cause the metal blank to expand and form into the shape defiled by the inner surface of the cavity or shell. The stimulation can be applied to the metal blank during this expansion process to facilitate in the formation of the metal blank within the die. The stimulation can be applied axially to the metal blank and/or in some other manner. The stimulation can be in one or more forms (e.g., pneumatic, electromagnetic, mechanical). As shown in FIG. 35, die member 950 is vibrated as indicated by arrows 960. The vibration of the die member can be by any number of means (e.g., vibration motor, etc.). As can be appreciated, die member 940 can be alternatively or additionally vibrated. Another type of stimulation can be induced by vibrating one or more end clamps 970, 972 that are attached to the ends of the metal blank. The end clamps can be vibrated a number of means such as, but not limited to, moving one or more end clamps back and forth as indicated by the arrows, attaching a vibration motor to one or more end clamps, etc. Another type of stimulation can induced by pulsing the gas into the metal blank as indicated by arrows 980. The pulsing of the gas can be accomplished in a number of ways (e.g., increasing and reducing the gas pressure, etc.). The frequency of the vibrations induced on the metal blank by one or more of the arrangements described above can be a constant frequency, random frequency, controlled sequence, and/or a controlled variable frequency.

Figure 36:
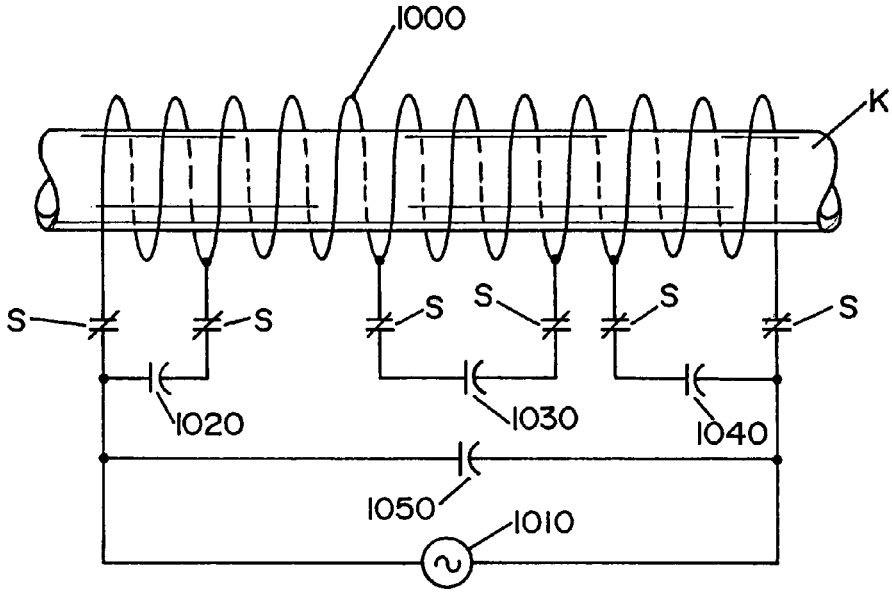
FIG. 36 is an illustration of the use of one or more capacitance shunts on one or more induction coils in a die used to for tailor heating of the metal blank.

Referring now to FIG. 36, there is an illustration of electrical heating arrangement for metal blank K that is to be formed in a die. An induction coil 1000 is illustrated as encircling the metal blank. A power source 1010 is used to energize the induction coil used to heat the metal blank during the forming of the metal blank in a die. Several capacitors 1020, 1030, 1040, 1050 are connected to the induction coil. The capacitors are used to tailor the heating profile of the metal blank during the forming process. The capacitors are use to adjust the energy distribution axially along one or more of the induction coils by capacitor shunting appropriate sections of the induction coils. This can be done statically or can be arranged to be done dynamically during the heating operation. As is illustrated in FIG. 36, the capacitor shunting can be along any portion of the induction coil and/or can be done for one or more induction heating coils in a die. Switches S are used to capacitor shunting one or more sections of the induction coil. One or more switches can be manually and/or automatically activated and/or deactivated. One or more switches can be activated and/or deactivated in a controlled (e.g., program sequence, time sequence, temperature dependent, time dependent, etc.) or in a random manner.

Figure 37A:
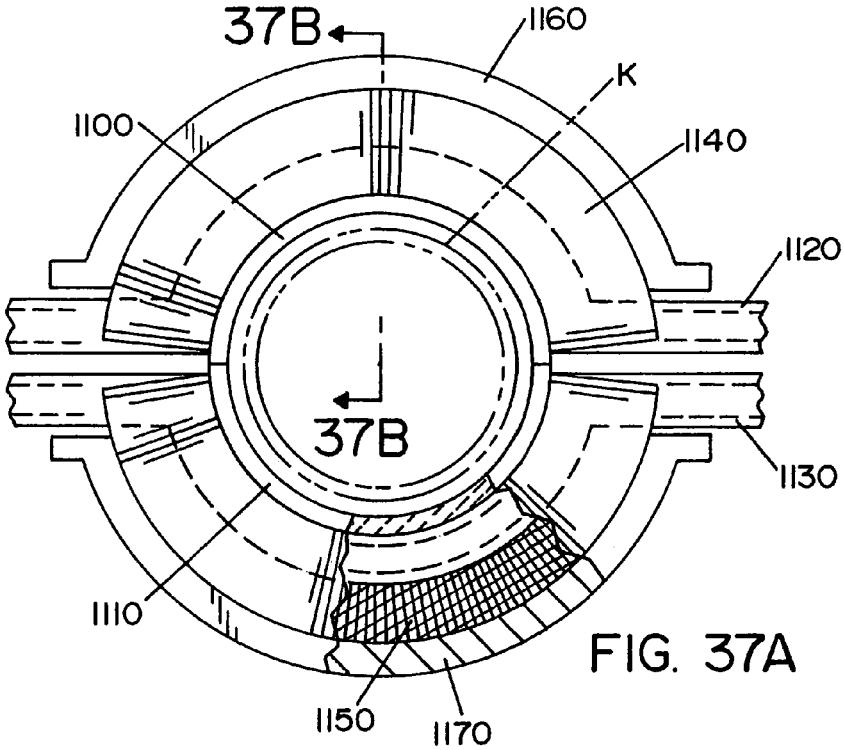
FIG. 37A is a cross sectional view of a die used in practicing the present invention where the die includes flux concentrators about one or more induction heating coils and/or are positioned in one or more locations on one or more induction coils in the die to achieve a tailored heating profile of a metal blank in a die.
Figure 37B:
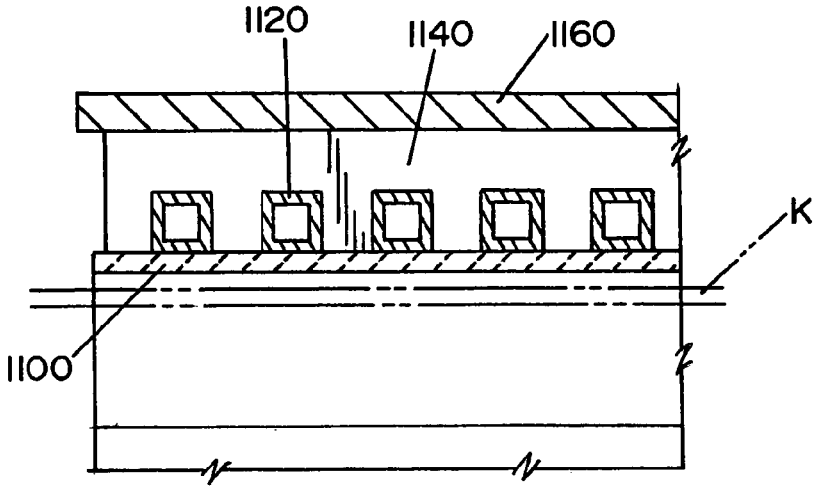
FIG. 37B is a cross sectional view taken generally along line 37B—37B of FIG. 37A.

Referring now to FIGS. 37A and 37B, there is illustrated a cross-section of a die showing a metal blank K in dotted line representation having a generally uniform circular cross-sectional shape. The metal blank is positioned shell sections 1100, 1110, which forms an encircling configuration when the die set is closed. Conductors 1120, 1130 are positioned about each shell section. Positioned below the filler material 1160, 1170 and about the conductors is a flux concentration material 1140, 1150. The flux concentrators are used to at least partially shield, prevent, and/or concentrate inductive heating of various portions of a metal blank during the forming process. The flux concentration material is illustrated as being positioned completely about the induction coil; however, the flux concentration material can be selectively positioned in the die member to obtain the desired tailored heating of the metal blank during the forming process. The flux concentration material can be inserted into the filler material and/or form a separate layer from the filler material as shown in FIGS. 37A and 37B. The flux concentration material can be spaced outwardly from the induction coils as shown in FIGS. 37A and 37B, and/or be positioned inwardly of the induction coils.

Figure 38A:
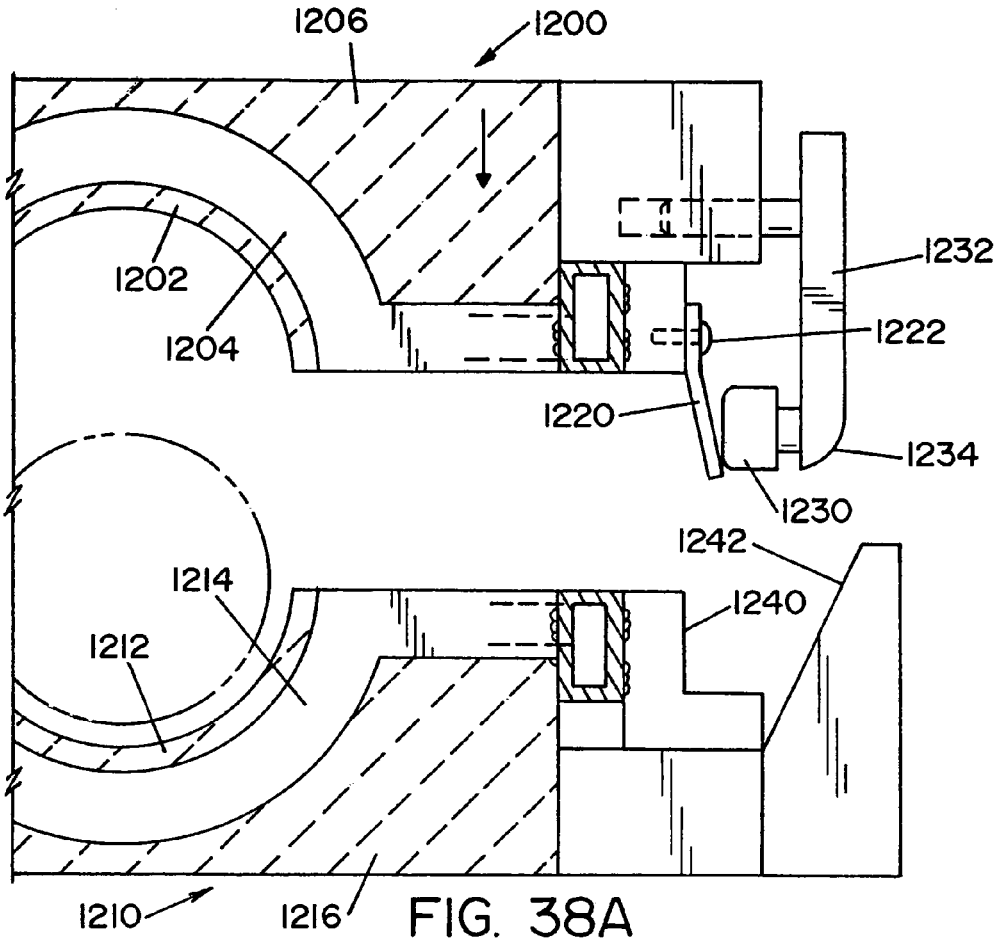
FIGS. 38A and 38B are cross sectional views of a portion of a die member used in practicing the present invention illustrating a quick disconnect switch assembly for connecting the induction heating coils and/or cooling system for the induction heating coils in one or more portions of the die.
Figure 38B:
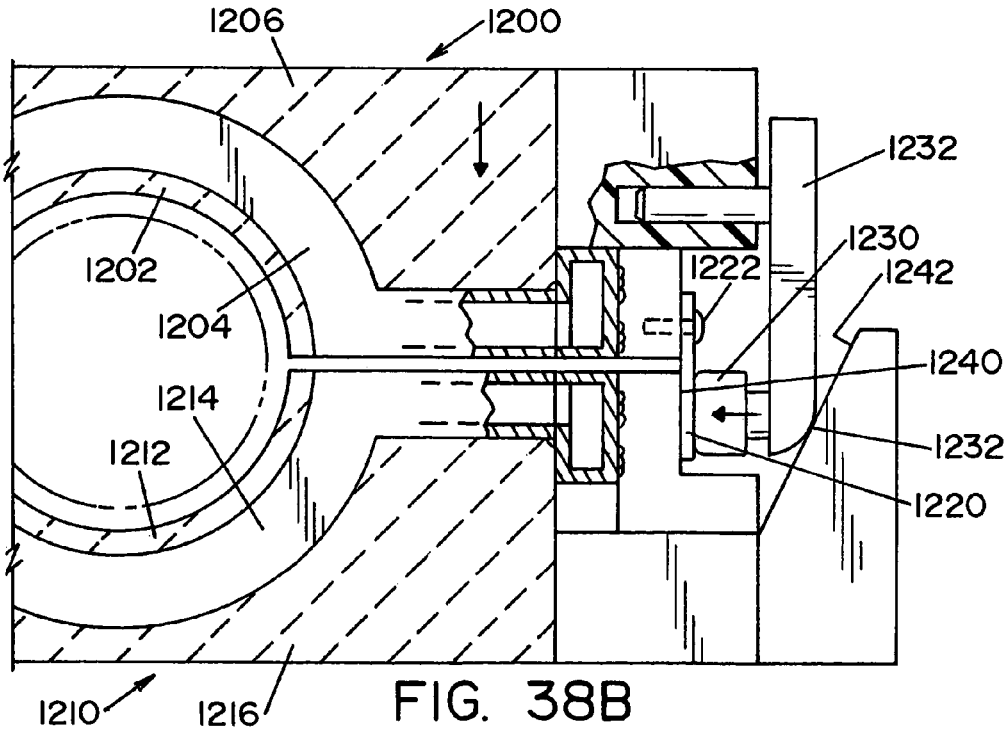

Referring now to FIGS. 38A and 38B, there illustrated a quick disconnect switch assembly for the induction heating coils in the die. The quick disconnect switching for the coil assembly allows for use of a more efficient type of induction heating coil configuration, along with the ability to have a split opening type die to allow for easier metal blank entry and exit. The switching mechanism can be designed to have a high current density and/or individual electrical connect/disconnect capability for each coil turn with a unique contact wiping action. In addition, the quick disconnect switch assembly allows for the cooling requirements for the induction heating coils to be handled independently for each portion of the die. FIGS. 38A and 38B illustrate one of many ways to form a quick disconnect relationship between two die portions. FIGS. 38A and 38B show a cross-section of a die having an upper die portion 1200 and a lower die portion 1210. Upper and lower die portions include shell sections 1202, 1212, which forms an encircling configuration when the die portions are closed. Conductors 1204, 1214 are positioned about each shell section. A filler material 1206, 1216 is positioned about the conductors and secures the conductor and shell sections in position. The upper die portion includes a conductor flap 1220 that is secured to conductor 1204 by rivet 1222. The upper die portion also includes a flap bumper 1230 that engages flap 1220. Flap bumper 1230 is secured to one end of a vertically extending leg 1232 having a tapered base 1234. The upper end of leg 1232 is secured to an upper region of the die portion 1200. The lower die portion includes a conductor contact 1240 and a sloped landing 1242. As shown in FIG. 38B, as the upper die portion 1200 is lowered toward the lower die portion, the tapered base of leg 1232 engages sloped landing 1242 and causes flap bumper 1230 to move flap 1220 into electrical contact with conductor contact 1240. The contact between flap 1220 and conductor contact 1240 results in an electrical circuit forming between conductors 1204 and 1214. As shown in FIG. 38A, when the die portions are separated from one another, the electrical circuit between conductors 1204 and 1214 is broken.

Figure 39A:
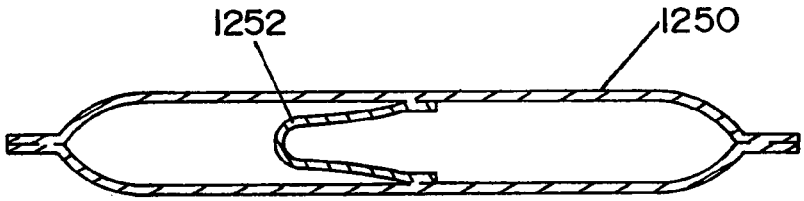
FIGS. 39A and 39B are cross sectional views of a metal blank having an internal stiffening members in one or more portions of a metal blanks.
Figure 39B:
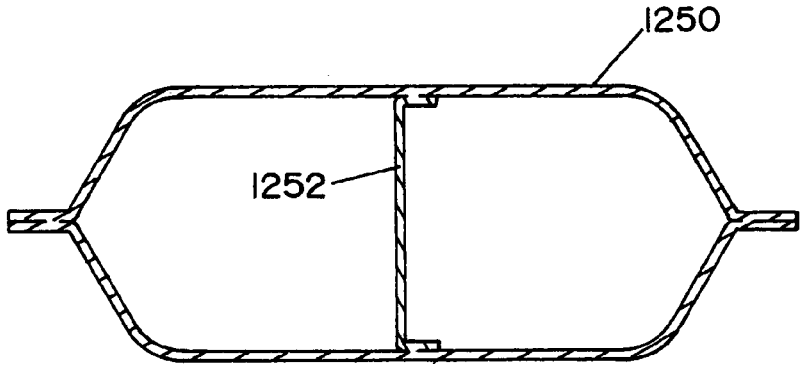

Referring now to FIGS. 39A and 39B, a metal blank 1250 is illustrated having a structural or stiffening member 1252 inserted in the interior of the metal blank. FIG. 39A shows the metal blank prior to being expanded in the die. FIG. 39B shows the metal blank after being expanded in the die. The structural or stiffening member is typically welded to the interior of the metal blank; however, it can be connected in other ways. The structural or stiffening member can be made of the same or a different material than the material forming the shell of the metal blank. The internal structural or stiffening member within a metal blank can be used to provide internal stiffening of the metal blank after the forming process, and/or to control the shape of the metal blank during the forming process. Although only a single structural or stiffening member is illustrated, it will be appreciated that the metal blank can have a plurality of structural or stiffening members. The structural or stiffening member is illustrates as being fully extended; however, it can be appreciated that the structural or stiffening member can have other configuration after the metal blank has been expanded.

Figure 40:
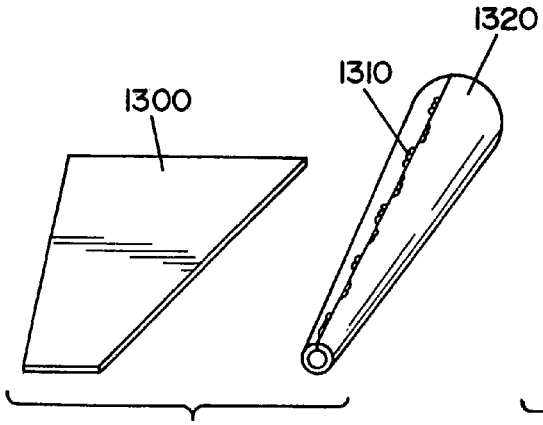
FIGS. 40–43B are illustrations of various tailor made metal blanks that can be formed by the die of the present invention.
Figure 41:
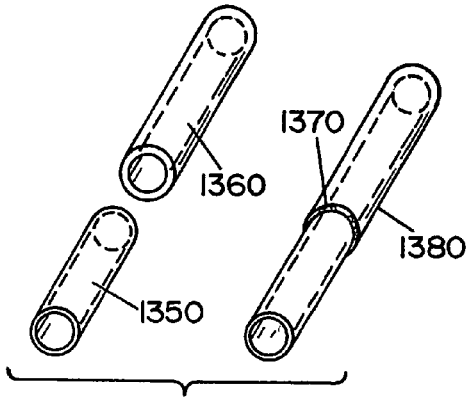
Figure 42A:
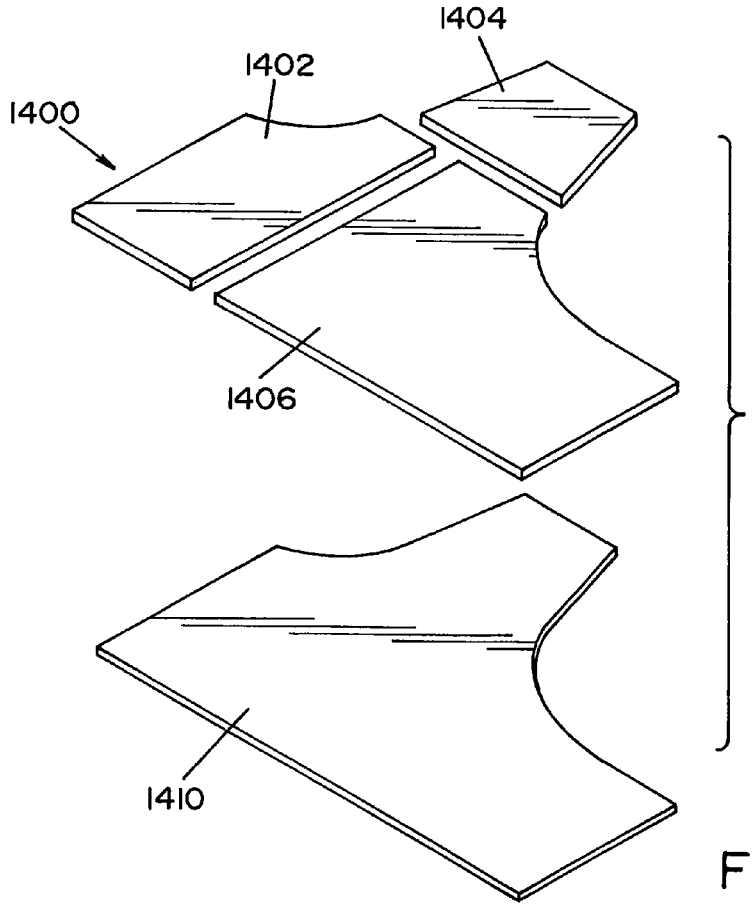
Figure 42B:
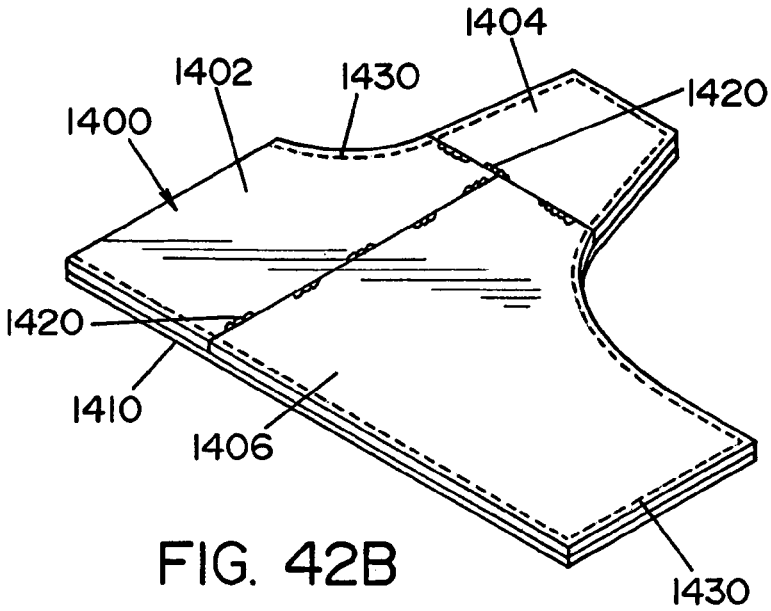
Figure 42C:
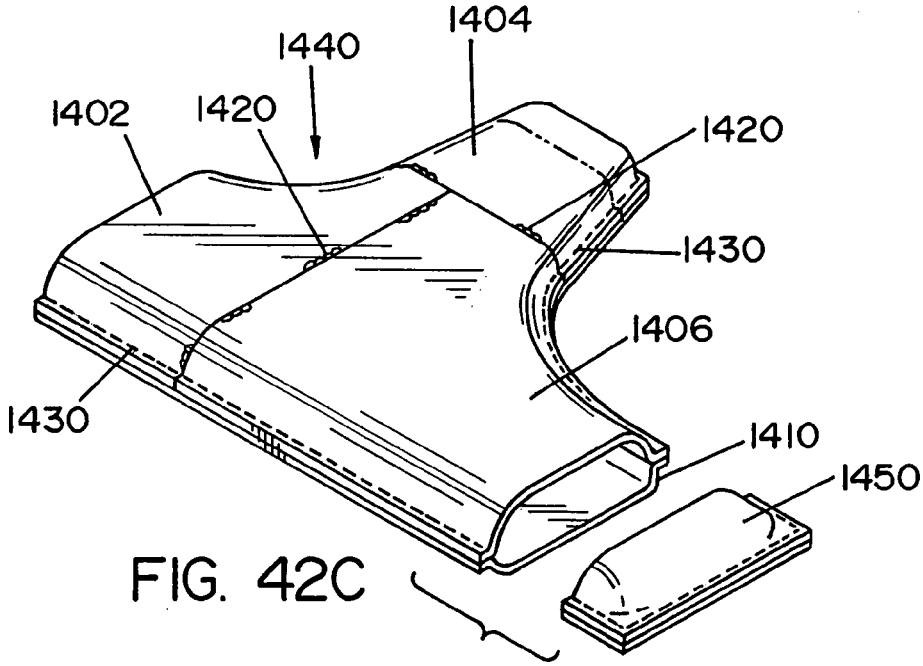
Figure 43A:
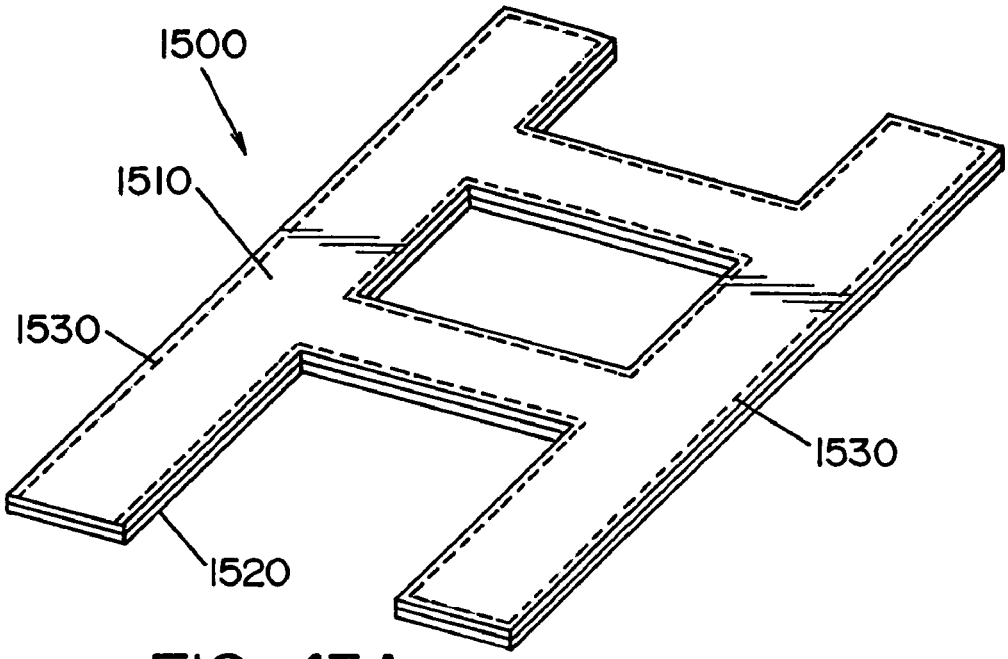
Figure 43B:
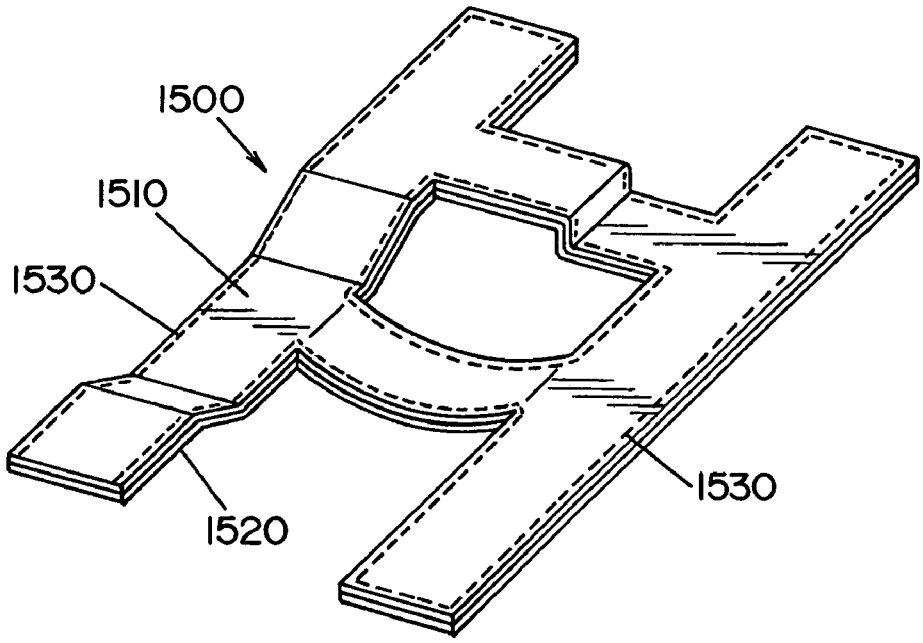

Referring now to FIGS. 40–43B, several non-limiting examples of tailored metal blanks are illustrated which can be used in the present invention. As can be appreciated, the examples are merely representative of some of the many types of tailored metal blanks that can be used in the present invention. The shape of the tailored metal blank can take any number of forms. The final form will typically depend of the shape of the desired final product. The materials used to form the tailored metal blank can be uniform or be varied throughout one or more portions of the metal blank. The metal blank can be formed by two or more pieces of material. Typically, these pieces of material are connected together by a weld; however, other connection mechanisms can be used, such as brazing, adhesive, bolting, and/or the like. The thicknesses of one or more portions of the metal blank can also be varied in one or more regions of the metal blank. Referring to FIG. 40, the is illustrated a single sheet of metal material (e.g., carbon steel, stainless steel, aluminum, etc.) having a generally trapezoidal shape 1300. The sheet of metal is rolled and then the edges are welded together by a weld 1310 to form a generally conically shaped metal blank 1320. Referring now to FIG. 41, another tailored blank is illustrated wherein two tubular metal components 1350, 1360 are connected together by a weld 1370 to form a metal blank 1380 having two distinct diameters. The two tubular metal components can be made of the same or a different metal. Tubular metal component 1360 is shown to be longer than tubular metal component 1350; however, the two tubular metal components can have the same length or tubular metal component 1350 can be longer than tubular metal component 1360. The thickness of the metal used to form the two tubular metal components can be the same or different. Referring now to FIGS. 42A–42C, another tailored blank is illustrated wherein the metal blank is formed from two sheets of metal 1400, 1410. Metal sheet 1400 is shown to be formed from three metal components 1402, 1404, 1406, each having a different shape. The metal components can be formed of the same or different material. The metal components can have the same or different thicknesses. As shown in FIG. 42B, the metal components are welded together by weld 1420. Metal sheet 1410 is illustrated as being formed of a single sheet of metal; however, it can be appreciated that the metal sheet can be form from a plurality of metal components. As shown in FIG. 42B, metal sheets 1400, 1410 are connected together at their respective edges to form the metal blank. Typically a weld 1430 is used to connect the edges together. FIG. 42C illustrates the metal blank after it has been expanded into a structural component 1440. The structural component can be finished, if desired, by cutting and/or further mechanical bending of the structural component. As shown in FIG. 42C, an end 1450 of the structural component is cut off after the metal blank has been expanded. As can be appreciated, other modifications to structural component 1440 can be made, if desired, prior to the formation of the final product. Referring now to FIGS. 43A and 43B, another tailored made metal blank is shown. The metal blank 1500 is formed from two metal sheets 1510, 1520 that are welded together by weld 1530. The two sheets of metal can be formed of the same metal or be a different metal. The two sheets of metal can have the same or a different thickness. Metal sheets 1510, 1520 are illustrated as being formed of a single sheet of metal; however, it can be appreciated that one or more of the metal sheets can be form from a plurality of metal components. FIG. 43B illustrates the prebending of metal blank 1500 prior to being expanded in the die. The prebending is typically performed by standard mechanical bending techniques (hydraulic press, etc.). As illustrated in FIG. 43B, various types of prebending can be performed on one or more portions of the metal blank. The prebending of the metal blank is used to facilitate in the formation of the final structural product in the die. After the metal blank has been expanded in the die, the structural component can undergo one or more finishing steps as illustrated and discussed above with respect to FIG. 42C.

Figure 44:
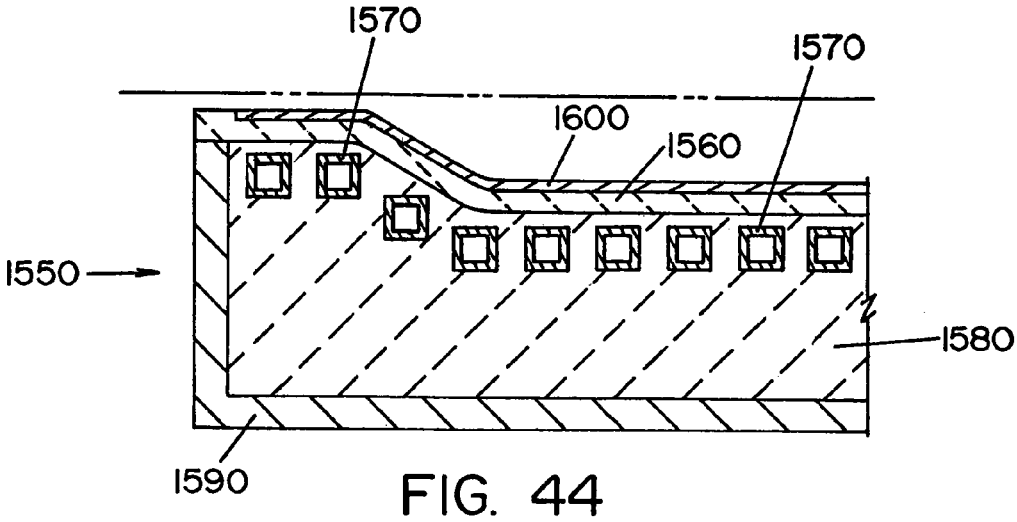
FIG. 44 is a cross sectional view of a portion of a die member used in practicing the present invention where the die includes a cavity or shell section on the inner surface of at least a portion of a die and a susceptor in the inner surface of the cavity or shell section.

Referring now to FIG. 44, there is illustrated a portion of a die member 1550 which includes a durable cavity or shell section 1560 that is designed to enhance the durability of the die during the forming process. The cavity or shell section is positioned above a plurality of induction coils 1570 that are used to heat a metal blank. The cavity or shell section and induction coils are supported in the die member by a filler material 1580. The filler material can be a cast ceramic material; however, other materials can be used. A die frame 1590, typically made of metal (e.g. aluminum, etc.) defines the outer structure of the die member. The durable cavity or shell section can be made of many different types of materials such as, but not limited to, silicon nitrate, silicon carbide, polymeric mesh materials, and the like. The use of a durable die material allows the die member to be used for higher temperature operations, improves the thermal shock resistance of the components of the die member, and/or improves the structural integrity of the component of the die member. The thickness of the cavity or shell section can be uniform or vary in thickness along the surface of the die. As indicated in FIG. 44, the cavity or shell section can have a non-planar contour. The position of the induction coils relative to the cavity or shell section and/or the spacing of the induction coils from one another can be uniformed or be varied depending on the desired heating profile of the metal blank in the die. A durable die liner 1600 is shown to be secured to the inner surface of the cavity or shell section. The durable liner can be used to enhance the life of the cavity or shell section and/or increase or decrease the heating on a particular location on the cavity or shell section. As can be appreciated, the use of a durable liner is not required.

Figure 45A:
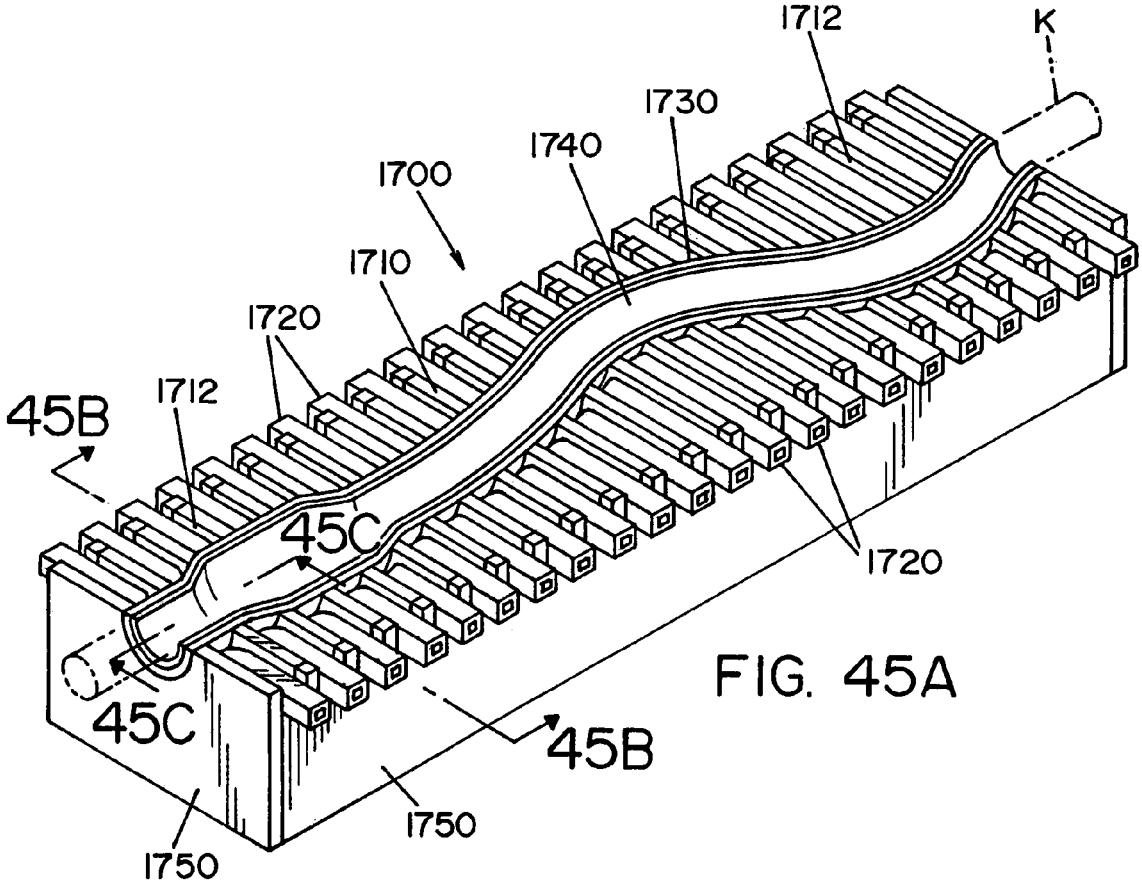
FIG. 45A is a top plan view of another arrangement of a machine for practicing the present invention.
Figure 45B:
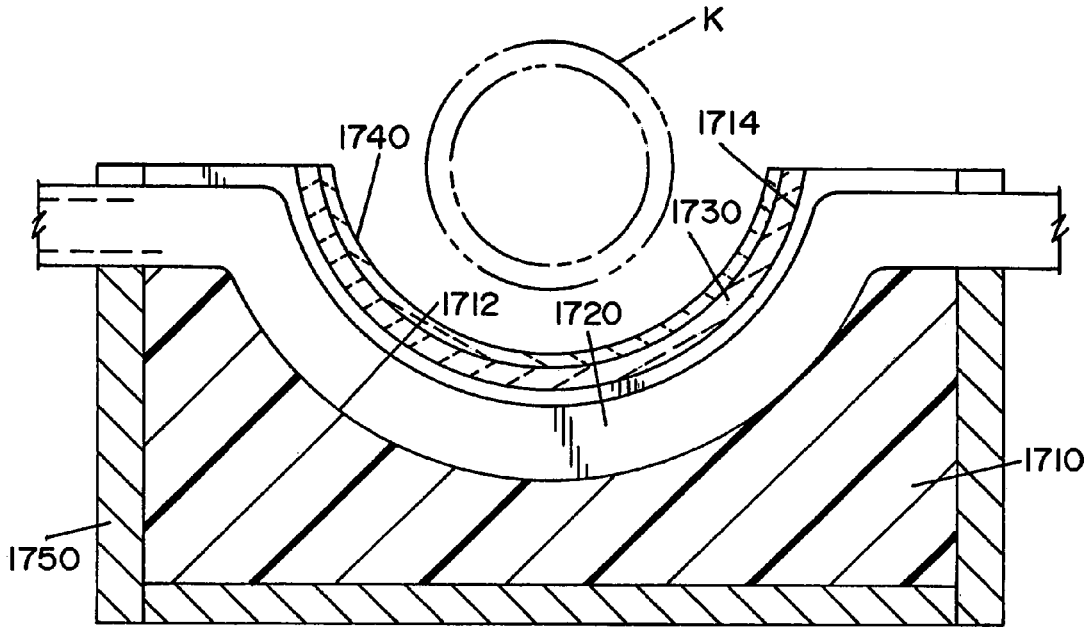
FIG. 45B is a cross sectional view taken generally along line 45B—45B of FIG. 45A.
Figure 45C:
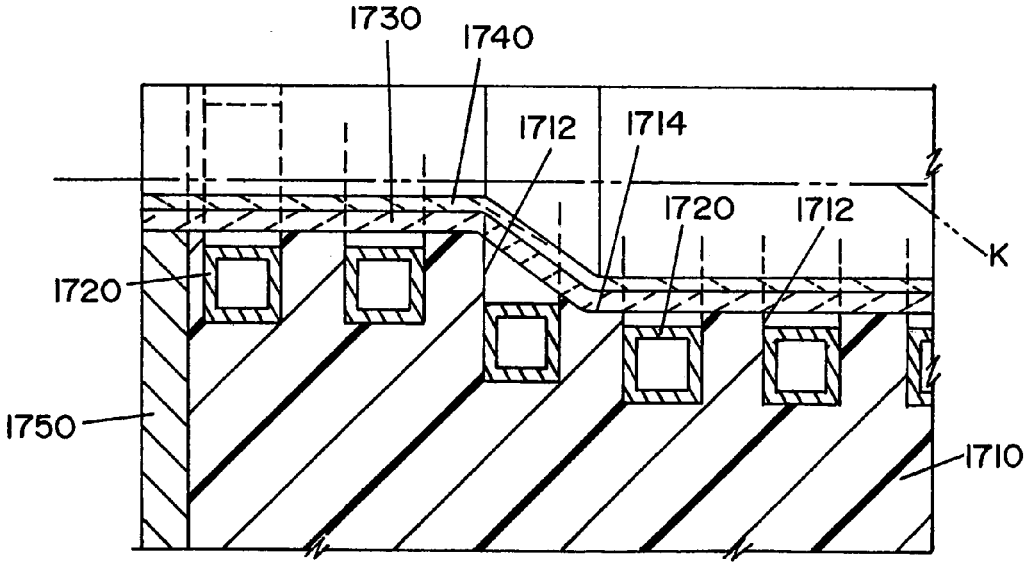
FIG. 45C is a cross sectional view taken generally along line 45C—45C of FIG. 45A; and, FIG. 46 is a top plan view of a machine for practicing the present invention showing the cavity or shell section and the corresponding portions of the die member divided in a plurality of subdivisions.

Referring now to FIGS. 45A–45C, a modification to the die of the present invention is illustrated. As described with respect to FIG. 44, the filler material 1580 can be a cast ceramic material which is used to secure the induction coils and the cavity or shell section in position. When a cast material is used, the induction coils are typically embedded in the cast material and the cavity or shell section adheres to the surface of the cast material. As such, a generally permanent die structure is formed. Consequently, replacement of a damaged induction coil and/or cavity or shell section is difficult and time consuming (e.g. drilling out components which was time consuming and could result in damage to other components). FIGS. 45A–454C illustrates an arrangement for a die member that enables easier and more convenient replacement of components in a die member. The die member 1700 includes a filler material 1710 that is formed of a machined and/or moldable material. One such material is a heat resistant polymer offered under name G10 or G11. This polymer is a high strength-high temperature polymer. In one arrangement, a block of G10 polymer is machined to form a plurality of slots 1712 along the lateral axis of the block of machined polymer, which slots are used to support the induction coils 1720. The G10 polymer is also machined to form a curvilinear rut 1714 along the longitudinal length of the die member. The curvilinear rut supports the cavity or shell section 1730 as illustrated in FIG. 45B. The depth of slots 1712 about rut 1714 are selected to obtain the desired spacing of the induction coils from the cavity or shell section 1730 as illustrated in FIGS. 45B and 45C. The block of machined polymer can be positioned in a structural frame 1750. The structural frame is typically made of metal (e.g., aluminum, stainless steel, etc.). The cavity or shell section can include a die liner 1740. The die liner can be used to increase the life of the cavity or shell section and/or facilitate in the tailed heating of metal blank K. The use of a machined filler material 1710 enables one or more of the die components to be easily removed, replaced and/or serviced. For example, the cavity or shell section will typically become damaged (e.g. cracking, etc.) after several metal blanks have been expanded in the die member. After the useful life of the cavity or shell section has been used, the damaged cavity or shell section can be simply removed from the rut in the filler material and replaced with a new cavity or shell section. In another example, if one or more induction coils becomes damaged (e.g., melted from over heating, etc.), the cavity or shell section can be removed and the one or more damaged induction coils can then be removed and replaced. After the damaged induction coils are replaced, the cavity or shell section can be reinserted in the rut and the die member can again be placed in service. Consequently, the use of a machined or molded filler material for the die member significantly simplifies and significantly reduces the time for the servicing of the die member.

Figure 46:
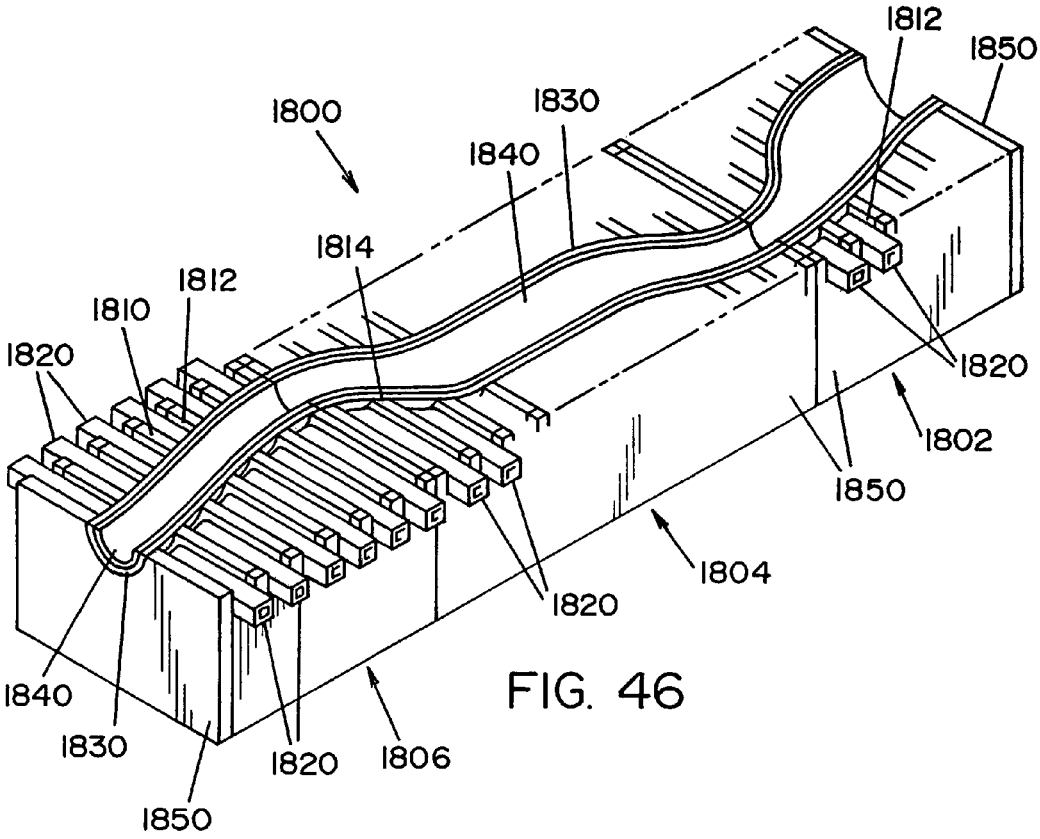

Referring now to FIG. 46, a die member 1800 is illustrated wherein the die member is formed of a plurality of subdivisions 1802, 1804, 1806 along the longitudinal length of the die. The die member is formed in a similar manner as the die member illustrated and discussed in FIGS. 45A–45C. As such, each subdivision of the die member includes a filler material 1810 that is formed of a machined and/or moldable material. The filler material includes a plurality of machined slots 1812 along the lateral axis of the filler material, which slots are used to support the induction coils 1820. The filler material also includes a machined curvilinear rut 1814 along the longitudinal length of the die member. The curvilinear rut supports the cavity or shell section 1830. The filler material is positioned in a structural frame 1850. The cavity or shell section includes a die liner 1840. The dividing of the die member into two or more subdivisions enable long structural component to be formed in the die. In addition, a modular die member can be used when a material used when a particular material used to form the cavity or shell section may not perform well when having a large length. As such, by dividing the length of the cavity or shell into multiple subdivisions, the material forming the cavity or shell section can be used to form long metal blanks. The modular design of the die member can also be used to allow for mixing and matching of cavity or shell subdivisions for form a desired cavity or shell having a certain shape or configuration.

The hot metal gas forming process as described and mentioned above is designed to improve metal formability, improve strength and toughness of structural materials, and improve dimensional precision of the finished products. A metal blank is generally welded into a desired preformed structure. As discussed above, the blank can be tailored to meet various structural and/or design requirements of the metal blank (e.g., various materials, various material thicknesses, prebending, etc.). The metal blank can be preheated prior to positioning the metal blank in the die and/or can be preheated while in the die. The preheating can be achieved by many different processes such as, but not limited to, induction heating. As can be appreciated, the die can also be preheated prior to or while the metal blank is at least partially positioned in the die. As stated above, the types of materials that can be used in the metal blank are typically magnesium, copper, stainless steel, carbon steel, titanium, and aluminum; however, many other different materials can be used. The heating of the metal blank within the die is typically performed by induction heating; however, other heating methods can be used alternatively or in combination with induction heating. As can be appreciated, the induction heating coils within the die can be uniformly positioned or positioned at various locations to modify the heating profile of the metal blank within the die. In addition or alternatively, the size and/or density of the induction coils within the die can be uniform or varied to obtain tailored heating of the metal blank in the die. Flux concentrators, flux insulators, susceptors, electrically conductive materials and/or magnetic materials within one or more components of the die can be used to tailor the heating profile of the metal blank within the die, reduce the thermal shock to one or more components of the die, increase the life of one or more components of the die, and/or increase structural integrity of the die during the forming process. As stated above, a variety of different electrically conductive materials can be used in the cavity or shell section and/or body of the die. The positioning of such electrically conductive materials in combination with or in addition to the positioning of the insulation materials, flux concentrators, and/or susceptor materials can be used to achieve a desired tailored heating profile of the metal blank within the die. When the metal blank is a carbon steel material, the metal blank is typically heated to a forming temperature of about 1500–2200° F. using induction heating coils positioned in the die. One or more openings of the metal blank are sealed and a fluid such as an air or nitrogen gas is injected into the metal blank at a relatively low temperature and/or pressure to cause the expansion of the metal blank to at least partially fill the cavity or shell of the die. The fluid inserted into the metal blank can be preheated. During the formation of the metal blank, the metal blank can be mechanically stimulated such as by vibration to facilitate in the formation of the metal blank. One or more ends of the metal blank can be adjustably fed into the die to ensure the proper thicknesses of the formed metal blank during the forming process. Once the metal blank is properly formed, the metal blank can be cooled and/or quenched to obtain the desired metallurgical properties of the formed metal blank. Use of the hot metal gas forming process of the present invention results in lower product costs, lower tooling costs, higher quality formed products, enhanced the life of the forming die, rapid production of high quality formed blanks, and/or expand the use of the forming process to a wide variety of materials and/or material shapes. The die can be formed from a molded or machined filler material in increase the simplicity and cost effectiveness of repair and/or replacement of components of the die. The die can have a modular design so that the die can be used to form large metal blanks.

The invention has been described in connection with either the preferred preformed metal blank or a non-preformed metal blank with a simple shape. The shape of the metal blank is not important. The various disclosed apparatus can be used interchangeably to form the desired hot metal gas formed hollow structural component of various metal blank shapes. The process involves a metal blank which is plugged and subject to gas pressure typically about 200–1000 psi. During this process, the metal is heated typically by induction heating. The heating process can be modulated along the length of the metal blank to accomplish the desired forming operation and desired heat distribution during the forming process. The heated metal blank is then cooled or quenched selectively along its length to create the desired metallurgical properties of the finished product. The induction heating while forming by gas followed by cooling or quenching of the final part to obtain the desired metallurgical properties is a significant advancement over prior hydroforming processes. Other modifications can be made in the present invention without departing from the intended spirit and scope as defined in the accompanying claims.

The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention.

Having thus defined the invention, the following is claimed:

1. A method of forming a formable blank into a structural component having a predetermined shape, said method comprising:

(a) providing a shape imparting shell formed from a rigid material, said shell being in the form of at least a first shell section and a second shell section, each of which includes an inner surface defining said predetermined shape, an outer support surface and spaced lateral edges which edges define a parting plane between said two shell sections when said two shell sections are brought together to at least partially form said shell;

(b) providing a first compression force transmitting material with an upper side and a lower side to support said first shell section, said first compression force transmitting material having different physical properties than said first shell section;

(c) providing a second compression force transmitting material with an upper side and a lower side to support said second shell section, said second compression force transmitting material having different physical properties than said second shell section;

(d) placing said formable blank at least partially into said second shell section;

(e) moving said shell sections together to at least partially capture said formable blank in said shape imparting shell; and, (f) at least partially heating at least a portion of said formable blank by at least one heating element until said formable blank at least partially conforms to at least a portion of the inner surfaces of said first and second shell sections to form said structural component.

2. The method as defined in claim 1, wherein said first shell section is harder and more rigid than said first compression force transmitting material, said second shell section is harder and more rigid than said second compression force transmitting material.

3. The method as defined in claim 1, wherein at least one of said compression force transmitting materials is substantially non-magnetic.

4. The method as defined in claim 1, including the step of forcing a fluid at a high pressure into said formable blank until said formable blank at least partially conforms to at least a portion of the inner surfaces of said first and second shells to at least partially form said component.

5. The method as defined in claim 4, including the step of sensing a pressure of said fluid in said formable blank and controlling the fluid pressure in said formable blank to a preselected value.

6. The method as defined in claim 5, wherein said formable blank is at least partially preheated prior to said forcing fluid into said formable blank.

7. The method as defined in claim 5, wherein said fluid is at least partially preheated prior to said forcing fluid into said formable blank.

8. The method as defined in claim 5, wherein said formable blank is heated at a time prior to said fluid is forced into said formable blank, while said fluid is forced into said formable blank, after said fluid is forced into said formable blank, and combinations thereof.

9. The method as defined in claim 1, wherein at least one of said shell sections includes a silicon nitride, a silicon carbide, alumino-boro-silicate, beryllium oxide, boron oxide, zirconia, and combinations thereof.

10. The method as defined in claim 1, wherein at least one of said shell sections includes a magnetic material, an electrically conductive material, and combinations thereof.

11. The method as defined in claim 1, wherein at least one of said first compression force transmitting materials includes a magnetic material, an electrically conductive material, and combinations thereof.

12. The method as defined in claim 1, wherein at least one of said compression force transmitting materials is a cast compression force material.

13. The method as defined in claim 1, wherein at least one of said first compression force transmitting materials is a machined polymer material.

14. The method as defined in claim 1, wherein said heating is varied along the length of said formable blank to modulate the temperature/time pattern along said length.

15. The method as defined in claim 1, wherein said heating element includes induction heating coils, said induction heating coils are at least partially supported in at least one of said compression force transmitting materials.

16. The method as defined in claim 15, wherein said induction heat coils are at least partially cooled by a coolant having a boiling point higher than water.

17. The method as defined in claim 15, wherein said heating is at least partially varied by varying the frequency of the alternating current of said induction heating coils, varying the spacing between said induction heating coils, varying the power to said induction heating coils, varying the distance of said induction heating coils from at least one of said shell sections, at least partially insulating at least one of said induction heating coils, using at least one capacitor shunt to control at least one of said induction heating coils, and combinations thereof.

18. The method as defined in claim 1, wherein said heating is at least partially varied by including at least one flux concentrator in at least one of said shell sections, at least one of said compression force transmitting materials, and combinations thereof.

19. The method as defined in claim 1, including the step of transferring said structural component into a cooling station to controllably cool said structural component to obtain desired physical properties of said structural component.

20. The method as defined in claim 1, wherein said formable blank is substantially made of metal.

21. The method as defined in claim 1, including the step of applying mechanical stimulation to said formable blank during the forming of said formable blank, said mechanical stimulation including a vibratory actuator at least partially contacting said formable blank, a vibratory actuator at least partially contacting said first die, a vibratory actuator at least partially contacting said second die, frequency pulsing said formable blank, pulsating fluid into said formable blank, and combinations thereof.

22. The method as defined in claim 1, wherein said formable blank includes at least two connected pieces connected by a weld, brazing, solder, adhesive, and combinations thereof.

23. The method as defined in claim 1, wherein said formable blank includes multiple thicknesses.

24. The method as defined in claim 1, wherein said formable blank includes a non-uniform composition.

25. The method as defined in claim 1, wherein said formable blank includes at least one internal stiffening member.

26. The method as defined in claim 1, wherein said at least one of said shell portions sections includes multiple subdivisions along a longitudinal length of said shell portion.

27. The method as defined in claim 1, wherein at least one of said compression force transmitting materials includes multiple subdivisions along a longitudinal length of said compression force transmitting materials.

28. The method as defined in claim 1, wherein at least one of said shell portions is separatable from said compression force transmitting materials.

29. The method as defined in claim 1, wherein at least one of said shell portions, at least one of said compression force transmitting materials, or combinations thereof are interchangable.

30. The method as defined in claim 1, wherein said at least one heating element, a concentrator, an electrically conductive material, a current carrying material, an insulating material, or combinations thereof are removably positioned in at least one of said shell portions, at least one of said compression force transmitting materials, between said at least one of said shell portions and said at least one of said compression force transmitting materials, or combinations thereof.

* * * * *